US009718611B2

(12) United States Patent
Rio Gonzalez

(10) Patent No.: US 9,718,611 B2
(45) Date of Patent: Aug. 1, 2017

(54) COLLAPSIBLE CONTAINER FOR CONSOLIDATED LOAD TRANSPORTATION AND ASSOCIATED METHOD FOR COLLAPSING

(71) Applicants: Claudio De Los Corazones Arteaga Reyes, Chiguayante (CL); Eduardo Araya Poblete, San Pedro de la Paz (CL)

(72) Inventor: Juan José Rio Gonzalez, San Pedro de la Paz Concepción (CL)

(73) Assignees: CLAUDIO DE LOS SAGRADOS CORAZONES ARTEAGA REYES, Chiguayante, VIII Región (CL); EDUARDO ARAYA POBLETE, San Pedro de la Paz, VIII Región (CL)

( * ) Notice: Subject to any disclaimer, the term of this patent is extended or adjusted under 35 U.S.C. 154(b) by 575 days.

(21) Appl. No.: 14/367,763

(22) PCT Filed: Dec. 21, 2012

(86) PCT No.: PCT/CL2012/000075
§ 371 (c)(1),
(2) Date: Jun. 20, 2014

(87) PCT Pub. No.: WO2013/091126
PCT Pub. Date: Jun. 27, 2013

(65) Prior Publication Data

US 2016/0039603 A1 Feb. 11, 2016

(30) Foreign Application Priority Data

Dec. 21, 2011 (CL) ..... 3232-2011

(51) Int. Cl.
*B65D 88/00* (2006.01)
*B65D 88/52* (2006.01)
*B65D 90/00* (2006.01)

(52) U.S. Cl.
CPC ..... *B65D 88/524* (2013.01); *B65D 90/0006* (2013.01)

(58) Field of Classification Search
CPC .... B65D 88/524; B65D 88/022; B65D 88/00; B65D 90/006; B65D 90/0026
(Continued)

(56) References Cited

U.S. PATENT DOCUMENTS 3,765,556 A * 10/1973 Baer ..... B65D 88/022 220/1.5
4,214,669 A * 7/1980 McQuiston ..... B65D 88/524 220/1.5
(Continued)

FOREIGN PATENT DOCUMENTS

AU 2010100432 A4 5/2010
ES 8300621 A1 1/1982
(Continued)

*Primary Examiner* — King M Chu
(74) *Attorney, Agent, or Firm* — Ladas & Parry LLP

(57) ABSTRACT

Collapsible container for use in marine and overland consolidated-load transportation, which can be collapsed and deployed using simple means external thereto, and stacked in the collapsed state. The container comprises, as basic elements: a floor; a ceiling; a rear panel; a front panel formed by an external structural pre-frame and a pair of doors secured to the pre-frame with hinges; side walls formed by an upper collapsible lateral panel, a lower collapsible lateral panel and a central element as a connected by means of hinges. The container has sliding bolt mechanisms for locking the front and rear panels to the ceiling, lateral anchoring devices for securing said panels to the side walls and hinged couplings at the remaining connections between
(Continued)

the basic elements, which hinged couplings allow the container to be collapsed by folding down, first, the front and rear panels onto the floor and then by collapsing the side walls, in bellows fashion, towards the inside of the container, and allow the container to be deployed by carrying out these steps in reverse.

16 Claims, 49 Drawing Sheets

(58) Field of Classification Search
USPC ..... 220/1.5, 6, 7
See application file for complete search history.

(56) References Cited

U.S. PATENT DOCUMENTS 4,684,034 A * 8/1987 Ono ..... B65D 7/24 220/1.5
5,161,709 A * 11/1992 Oestreich, Jr. ..... B65D 19/12 220/1.5
7,823,739 B2 * 11/2010 Sadkin ..... B65D 88/524 220/1.5
8,011,523 B2 * 9/2011 Kochanowski ..... B65D 88/005 206/503
8,381,927 B2 * 2/2013 Nam ..... B65D 90/008 16/78
8,540,098 B2 * 9/2013 Langh ..... B65D 85/66 220/1.5
8,573,433 B2 * 11/2013 Kochanowski ..... B65D 88/005 217/12 R
8,770,422 B2 * 7/2014 Cantin ..... E04B 1/3442 206/386
8,783,489 B2 * 7/2014 Bellehumeur ..... B65D 88/524 220/1.5
8,905,254 B2 * 12/2014 Joubert ..... B65D 19/12 206/386
8,991,134 B2 * 3/2015 Wheeler ..... E04B 1/343 220/1.5
9,056,709 B2 * 6/2015 Zhao ..... B65D 88/127
9,409,676 B2 * 8/2016 Kochanowski ..... B65D 88/005
9,517,879 B2 * 12/2016 Chawla ..... B65D 88/526

FOREIGN PATENT DOCUMENTS

WO 90/02084 A1 8/1990
WO 99/28215 A1 10/1999
WO 2006/024104 A1 9/2006
WO 2010/075607 8/2010
WO 2010/104378 A1 9/2010

* cited by examiner 4
16
116
117
118
119
119'
121
122
122'
124
125
126
126'
128
128'
117'

COLLAPSIBLE CONTAINER FOR CONSOLIDATED LOAD TRANSPORTATION AND ASSOCIATED METHOD FOR COLLAPSING

RELATED APPLICATION INFORMATION

This application is a 371 of International Application PCT/CL2012/000075 filed 21 Dec. 2012 entitled "Collapsible Container For Consolidated Load Transportation And Associated Method For Collapsing", which was published on 27 Jun. 2013 with International Publication Number WO 2013/091126, and which claims priority from Chilean Application No. 3232-2011 filed 21 Dec. 2011, the content of which is incorporated herein by reference.

FIELD OF THE INVENTION

The present invention relates to the field of containers for the maritime transport of goods according to the commonly used as standards. Specifically, the invention relates to the design of a collapsible model of container that can be rapidly and easily collapsed and/or uncollapsed with the objective to reduce to one-sixth the space of storage and/or transportation of the same when it is empty of cargo while maintaining and even improving the dimensional ISO standards and internal and external morphology commonly used in shipping of goods by sea. The collapsible container described in this invention also meets the minimum requirements of dynamic and static tensile strength, compression and torsion established by the different ISO standards for marine containers. The present invention also relates to a method of collapsing associated with said collapsible container, vertical stacking thereof and a system for locking or unlocking the collapsing of the container.

BACKGROUND OF THE INVENTION

As is known, in recent decades the market for maritime transport of goods increased and directed its logistics to cargo packed in containers, which are used by shipping companies as large transport crates that are rented to transportation users or customers to consolidate freight and standardize the methods of stowage and handling the same in ports worldwide. Similarly, these metal containers usually are directly used on trucks and/or trains to deliver the goods consolidated from the port to customers or end users via ground transportation. The shipping containers have been, therefore, from its beginnings in the early 50s of the twentieth century, a suitable method of transporting over long distances the consolidation and conservation of all types of goods from origin to destination and its use has been normalized and standardized worldwide to ensure the procedures and methodologies of handling them.

These norms and standards set out by the ISO organization have shaped with time the external and internal measures of containers, volume, mass, materials with which they are designed and built, their strength parameters, forms and/or strategic placement of elements of the container for facilitating both the access to the inside and handling by manual operations and/or equipment such as hoists and/or cranes to facilitate and accelerate the stevedoring, embarking, loading and unloading operations thereof.

These standards containers have been grouped into formats that include different sizes and capacity thereof, and have been denominated with a globally recognized encoding that determines the parameters that configure the container fully finished and with all the basic construction details that will trust the container its characteristic of a wrapping or package for transport.

The exponential increase in the use of these shipping containers has led to the need for large storage space for empty containers during the time that these are without relative use or are pending to be filled with the material to be transported.

The large volume occupied by a standard ISO container when it is empty of cargo has required from the ports and/or shipping companies, new investments to grow their storage areas for stationed or empty containers, reaching up to even double the storage areas and spaces, creating a new problem that directly affects the occupation of the land adjacent to ports. Even customers who regularly use these means of transport have also had to enable and increase their storage facilities to support the current stock of marine containers stationed at the facility until loading and shipment.

Also, logistically, shipping companies usually need to get these empty containers through merchant ships to ports with high traffic on export of products and where the containers, once filled with the goods to be transported, are again loaded onto ships to their destination. When these vessels transport containers empty of cargo they have a limited quantity and space, just as if the containers were loaded, since the volume occupied by the containers is identical whether they are full of goods or empty.

To solve these logistical problems there have been many attempts in the past 30 years in order to solve this problem, being by indisputable logic, as a suitable technical pathway of solution, that of achieving a design and construction of a model of disassemblable or collapsible container for use in the transportation of cargo by sea which may significantly reduce its volume when free of cargo, thus reducing the volume it occupies and therefore the costs of storage and/or transportation when empty.

Some examples of solutions in this direction can be found in the following documents: EP0152290, PCT/ES2008/070215, CR91/5935, MXPA/a/2001/003487, ES2335790, EP1851140, U.S. Pat. No. 4,577,772, WO2010104378 and U.S. Pat. No. 7,823,739.

In the most elemental solutions of this type the basic elements of the container, i.e. a bottom or floor, a pair of side walls, a rear panel, doors and a roof, are removed manually because these elements are joined together by bolts or anchorage systems. This leads to the problem of additional requirement in ports of human resources, cranes and/or elevators for handling the elements assembled or disassembled and of times of assembly and disassembly, which are totally dependent from such manipulations, with the consequent risk on work safety and high costs of operation.

On the other hand, mechanically more correct and automated solutions are known for solving the problem, which avoid the complete disassembly of the container by means of collapsing systems thereof, either by removing, entirely consolidated, one of its elements, such as the roof, for then performing the folding of the sides, rear panel and/or doors to the interior of the container itself by pivots or hinges, or else by performing a folding, pivoting or retracting towards the inside of the container without removing any component element but by using especially modified elements to do this. However, these approaches have failed because in order to fit to the design needs highly important standards in the container are changed, such as volume, size or position of the doors, missing anchorages, etc. Every change outside the ISO international standard forces shipping and/or logistics companies to change their handling systems globally, to which they are not prepared. Moreover, some of these designs use materials other than steel for the manufacturing the container, thus producing different results to the standards set out by the ISO standard for mechanical and dynamic response thereof.

In short, the background of the prior art have not yet satisfactorily solved the problem of drastic reduction of space on the storage and/or transport of empty shipping containers with the primary aim of gaining efficiency and profitability in both the storage of containers and transporting of the same to the stevedoring areas when they are empty of cargo and doing so in a way as to conform to the ISO standards in regard to structural dimensions, typical normalized position of the elements forming the container, materials with which it is designed and built, strength parameters and other variables.

Thus, considering the mistakes of previous developments, it would be desirable to provide a container for use in the transportation of sea or land consolidated cargo which besides being completely collapsible in an easy and quick manner in order to reduce drastically and economically the space occupied in the storage and/or transportation of containers empty of cargo, it meets the following additional conditions:

- the container must be able to be quickly collapsed, in a similar or lower time than that spent in the conventional operations in a port or ship, without the intervention of manual operation to thus reduce to zero the possibility of a work accidents during handling;
- the container must maintain a consolidated structure of its component parts, both when in an assembled or displayed state and when in a disassembled or collapsed state, thus avoiding the manipulation of loose elements capable of being lost;
- the container must also comply, when assembled, with all the rules and standards set out by the ISO standards organization, so that users of the same, whether the ports, shipping companies and/or end customers, continue to use the same methodologies, tools, resources, equipment and automation systems currently available, for each and every one of the operations typically performed in the stevedoring, loading, unloading, embarking and disembarking of containers;
- the container must have all the elements of anchoring, mooring and handling that are now a standard, so that the way it is operated remains the same as is currently used and the time spent on these operations remains at least the same, whether it is assembled or when it is disassembled;
- the container, when it is in a disassembled state, must have simple solutions to be consolidated and stacked using the same utensils and/or tools that are used today;
- the container developed, when assembled and ready for loading, must comply with each and every one of the dimensional parameters that mark the standards of mechanical construction of ISO shipping containers and all the anchoring, sealing, accessing and basic elements position norms and should equally comply with the dynamic and mechanical strength tests which are made to conventional ISO shipping containers;
- the final economic cost of the resulting collapsible containers and methods of collapsing or disassembling of the containers should not deviate greatly from the cost of a conventional container, or otherwise they will not be welcomed by transportation markets due to factors of non-repayment of the containers; and
- given the hard treatment when handling and the continued mobility of the containers, it must also comply with a standard of repair and maintenance which may be easy to carry out and operate (it should be considered that the use of complex anchoring elements subjected to inclement weather, salt spray environment of the seas and high handling cycles, make it very common to have repair and maintenance operations of the containers in ports).

The prior art experience and background coincide in that until this moment in which the present invention is presented always some of these determinants of success was not met.

Additionally, the new regulations tend to support ecology, the reduction and improvement of the carbon footprint and efficiency of the freight transport systems. It is therefore a further aim to develop a system that by using disassembled and/or collapsed containers as a solution to the transport of empty marine containers, make a significant reduction in the carbon footprint for the life of a container simply and directly by decreasing the number of ships needed to transport the same amount of traditional empty containers to their port of destination.

SUMMARY OF THE INVENTION

In a first aspect of the present invention it relates to a container for sea and/or ground transportation of consolidated goods, preferably made of metallic materials, of the type commonly used for this type of transportation and which are standardized by ISO norms, usually denominated with the name of their footage and which, together with their outside width and height, are part of the usual array of containers of the marine container market, wherein the container has such a form of construction in any of the formats and sizes normalized by the ISO standards that, by means of an arrangement of mobile elements joined together as hereinafter will be explained in detail, it can be fully collapsed and thus reduced in its volume when free of internal cargo up to a sixth of its original volume compared with the displayed or assembled position.

Given its hexahedral shape, the collapsible container of this invention has as primary and independent structural elements six basic components which form the faces which limit the inside and outside space of the collapsible container and which, according to the preferred embodiment of this invention, are created and configured by joining one or more metal structural components together by welding, bolts and/or rivets.

These basic structural elements that form the six faces of the collapsible container include a bed or floor with a front panel with access doors, a rear panel, a roof, a right side wall and a left side wall.

The floor of the collapsible container is formed mainly by: a rectangular outer structural frame or perimeter made up of metal structural profiles; transverse support stringers arranged perpendicular to the larger sides of the rectangle; longitudinal floor boards or panels positioned adjacent to one another on the inner surface of the floor over the transverse support stringers of the floor; and some bottom corner anchorage fittings at each vertex of the outer structural frame, said bottom corner anchorage fittings being of dimensions and shape similar to those commonly used in the ISO containers for maritime use of the market.

The rear panel mainly includes: a rectangular outer structural frame made of metal structural profiles; a horizontal crosspiece preferably also made of metal structural profile and located on the midpoint of the vertical members of the outer frame to provide structural strength to the structural frame of the rear panel against vertical loads on the container when assembled or uncollapsed; and corrugated metal sheet filling the space inside the profiles that form the structural frame and the horizontal crosspiece.

The front panel consists primarily of: a rectangular outer structural subframe constituted by metal structural profiles; and a pair of doors made of a frame of metal profiles and cover sheets secured to the subframe by a set of cap hinges attached to the side of the subframe.

The right and left side walls are identic and face each other in symmetric fashion with respect to a central longitudinal axis of the container. Each side wall consists of three parts: a foldable top side panel, a foldable bottom side panel and joining both panels by means of hinges a central pivoting, anti-fold locking and connecting element, which, as explained below, allows the side walls to fold in on themselves.

The top and bottom foldable side panels are identical and symmetrical about the central pivoting, anti-fold locking and connecting element and comprise a rectangular outer structural frame consisting of an extreme crossbar which constitutes one of the longer sides of the rectangular framework, a central rail which constitutes the other longer side of the rectangular frame and that is located adjacent the central pivoting, anti-fold locking and connecting element, some vertical pillars on each side, which constitute the shorter sides of the rectangular frame and corrugated metal sheet filling the interior space generated by the outer structural frame.

The roof as a basic structure comprises: a rectangular structural outer frame or perimeter, constituted of outer longitudinal structural profiles or tension members and outer transverse beams; roof transverse support stringers arranged perpendicular to the longer sides of the rectangle; and a top corner anchorage fittings at each vertex of the outer structural frame, wherein said top corner anchorage fittings are also of the same size and shape to those commonly used in ISO containers for marine use in the market. Also, the roof comprises metal sheet secured to said transverse support stringers and covering the inner space defined by the outer structural frame.

All these basic structural parts are joined together by hinged joints to achieve the goal of performing collapsing and assembling maneuvers of the collapsible container. Specifically, the collapsible container of the invention provides hinged joints or links that operatively connect the side walls to the floor, the side wall to the roof and the front and rear panels to the floor, so that these elements can pivot between each other at the time of collapsing or uncollapsing of the container.

Consequently and according to the concept proposed by the present invention, the container can be folded in on the vertical of the same in a sequence comprising, first, the folding of the front and rear panels to the floor and then the folding up of the top and bottom side panels with roof the attached into the container until the top and bottom foldable side panels and roof reach a horizontal position above the front and rear panels and the floor, so that once reduced to its minimum volume, the container maintains its original top and bottom outer structure, further allowing the vertical stacking of multiple collapsed or uncollapsed containers, transferring onto them the same type of stability that they commonly have when vertically stacked.

Both the floor and the roof include, secured to the corner anchorage fittings and extending along the longitudinal profiles that respectively comprise the basic rectangle of the floor and roof, respective support structures of the hinged joints with the side walls. In the case of the floor, said support structure stands above the inside level of the floor, formed and defined by the plane or top face of the longitudinal rails of the floor, up to a height equivalent, at least, to the maximum level of the assembly defined by the folded rear panel and front panel with access doors so as to allow the right and left side walls to fold above the previous folding of the rear panel and front panel with access doors in the collapsing process of the collapsible container.

Also, the present invention solves the problem of the mounting the front doors and the pivoting or folding of the front panel of the container, without for this reason having to modify their structural dimensions and typical normalized position thereof, by installing the doors on the foldable subframe. Said subframe is provided in the outer side faces of its structural profile with releasable anchoring means with the side walls that interacting with complementary means in said side walls. Preferably, said releasable anchoring means comprise hollows in the profiles forming the sides of the structural subframe, which as female elements receive in their interior bolts or pins strategically located as male elements on the side walls, so that when the container is in the uncollapsed or assembled position, they confer anchorage, jointing and rigidity points to the container structure and when collapsed, they release said anchors allowing the consequent folding of the container side walls into the same. An equivalent configuration is provided in the framework of the rear panel to act with said side walls.

The invention further provides a mechanical locking or unlocking system of the mobile elements of the collapsible container that allows its collapsing and is characterized by elements of the sliding lock type with movable pins accessible and operable from outside by simple mechanical operations without the need to access into the container and in a readily automatable form without removal of components thereof, thus avoiding the loss of detachable parts thereof and expediting the process of collapsing or uncollapsing the container.

Specifically for this purpose and to also ensure the verticality and resistance of the rear panel and subframe of the front panel with doors in the uncollapsed or assembled phase of the container, the invention provides an upper locking system of said elements so that when the container is in its upright position, it is impossible to collapse. For this effect, the invention proposes a system of top latch lock comprising a sliding plate and anchoring and locking means disposed on the structural profile which forms the subframe of the front panel and the frame of the rear panel and a corresponding mechanism which by way of a horizontal sliding movable latch lock is provided in the inside of the outer transverse beams of the roof to which said front panel subframe and rear panel frame panel align when the container is raised to its uncollapsed position. Preferably the anchoring and locking means of the front and rear panels comprise a series of cylindrical bolts located equidistantly which heads have arranged a slot which as a female element is used to achieve such locking with the plate of the sliding movable latch lock. The sliding movable latch lock mechanism is maneuverable from outside of the container and performs the function of locking and unlocking male together with emerging bolts of the front panel subframe and rear panel frame. In the unlocked position, said latch lock enables the release of the bolts and the subsequent pivoting and folding of the panel and in the locking position, the tongue and groove joint mechanism restricting the movement of the bolts and consequently the possible folding of the structural subframe, or frame in the case of the rear panel, giving them their verticality and ensuring the overall structural strength of the container.

The mechanical system of locking or unlocking of the mobile elements of the container for the collapsing or uncollapsing of the same also includes a mechanism in the form of a sliding latch lock contained in the central pivoting, anti-fold locking and connecting element of the side panels located along the bisector of the side walls in their mounted position. This sliding latch lock mechanism comprises a slide plate movable horizontally but which has vertical effect as it consolidates in its locked position both top and bottom structures that form the side wall. This effect is achieved by the introduction of bolts accommodated in a central support plate in the central pivoting, anti-fold locking and connecting element of the side panels which as male pins located along the entire container are introduced into the multiple female hollows facing them and made for that purpose in that sliding latch lock mechanism. A simple displacement of the sliding latch lock mechanism causes the release of the male pins of the foldable side panels and consequently the release of the pivoting of the hinge that will enable the folding in of these to the interior of the container. To act on said central pivoting, anti-fold locking and connecting element of the side panels, the invention proposes an access from the outside through rectangular cuts made in the structures of foldable side panels, manipulating through these cuts from the outside the displacement of the sliding latch lock mechanism form its lock to unlock position and vice versa.

The locking system of the doors is conveniently designed so that all elements are located to the interior of the plane level with the outer face or surface of the doors when they are closed. This locking system comprises a locking bar running through internally and vertically on each door and having pawls at the ends and handles fixed to the bar actuatable to open and close the door. The pawls engage in embedded closing casings disposed in the top profiles of the outer structural subframe front panel and the handle is housed in an interior cavity of the doors.

Finally, another aspect of the invention also contains a technical solution for the hermetical sealing or watertightness of the container, preventing leakage of fluid to the inside once uncollapsed and assembled. To this effect joints of elastomeric material for sealing have been included positioned longitudinally and strategically on the opposing or jointing faces of the mobile elements and in particular of the structural elements that are joined in the assembled container, so that upon uncollapsing the container said joints are sealed to the outside by the compression of the inside face of a structural element against the outside face of the opposite structural member, the elastomeric seal being pressed between the two and thus closing the intermediate free space which is necessary as tolerance to the turning operation of the hinges.

It is noteworthy that the external and internal dimensional format of the collapsing shipping container exposed herein, complies with each and every one of the dimensional standards, handling anchors, corner fittings, door location and opening, interior dimensions, useful volume, and even declared maximum tares for the containers for marine use, and nevertheless due to its special characteristics, a significant improvement has been achieved in the resulting overall interior volume, the latter being superior to the volume currently available in conventional containers, thus providing the possibility of an extra load inside.

The invention disclosed herein likewise technically solves the stiffness required for all the structural components so that once uncollapsed the container and ready for use with cargo, it may maintain its stability and mechanical response to vertical compression, torsions and tensile stresses upon common usage and handling.

As previously mentioned the present invention further proposes the method of collapsing the collapsible container as a technical innovation so as to achieve a one sixth reduction in the final height with respect to the uncollapsed container, maintaining nevertheless the vertical alignment of the plane generated by the roof, the floor and the outer structure of the container and with its top and bottom corner fittings ready to vertically receive stacking loads with total stability of multiple collapsed, uncollapsed or even conventional ISO containers by maintaining the horizontal condition of its top and bottom planes. In this manner the vertical stacking of up to six collapsed containers is, as a whole, equal in shape and dimensions as a single uncollapsed container or ISO standard container and perfectly handleable and transportable in a single operation.

The technical and mechanical solutions provided for collapsing or uncollapsing the container exposed herein avoid at all times that such operations are done by hand-held tools, so that the container may move from its "assembled or uncollapsed" sate to its "disassembled, or collapsed" state, and vice versa, with the intervention of simple machinery developed specifically for the purpose of performing said operation at high speed and without risks to operators that manipulate them. This machinery in any case does no form part of the object of the present invention.

In addition to this invention, fastening, anchoring and safety elements have been developed that allow the manipulation and storage of high stacked consolidated groups of the collapsible containers herein described in this invention when in collapsed state.

The technique provided in overall in this invention is applicable to all measures and dimensions commonly used in ISO sea containers and which are commonly known by their length, width and height in feet, and are commonly referred to as categories 1AAA, 1AA, 1A, 1AX, 1BBB, 1BB, 1B, 1BX, 1CCC, 1CC, 1C, 1CX, 1D and 1DX. The system of construction and method of collapsing perfectly allow adaptation of said collapsing position of the locks, bolts, panels, doors and rear panel in any one dimension defined by the ISO standard.

BRIEF DESCRIPTION OF THE DRAWINGS

To complement the description being made and in order to aid in a better understanding of the characteristics of the invention a description of the preferred practical embodiments thereof are provided, herein accompanied as an integral part of said description by a set of drawings in which, with an illustrative intention and not limitative, the following has been represented.

DESCRIPTION OF A PREFERRED EMBODIMENT OF THE INVENTION

Collapsible Container

Figure 1:
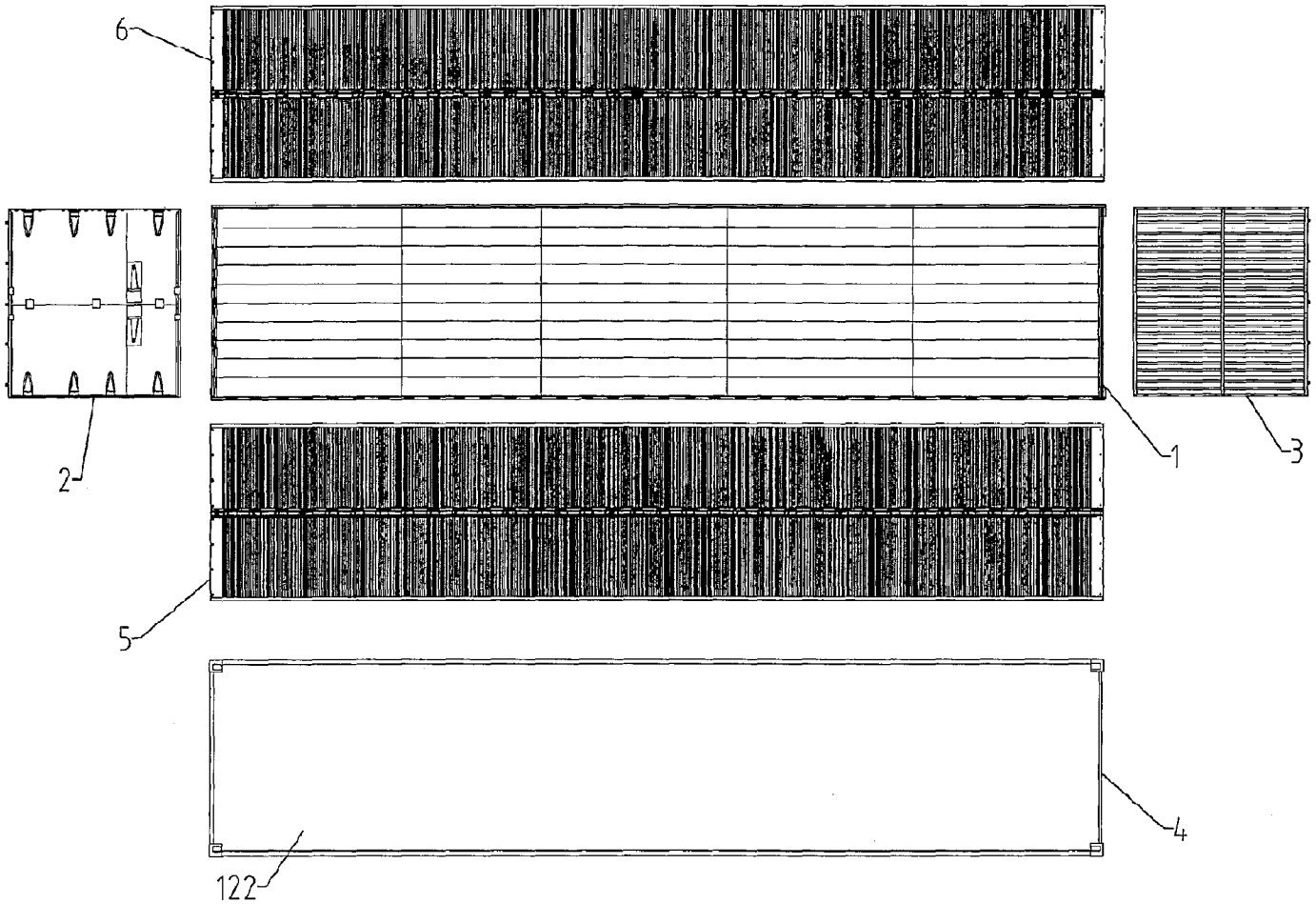
FIG. 1—Shows an exploded plan view of structural elements which are used in the construction of a collapsible container according to the embodiments herein presented in the current invention.

Referring to FIG. 1, the collapsible container of the invention essentially consists of six elements preferably made of metal components, a bed or floor (1), a front panel (2) with doors, a rear panel (3), a roof (4), a right side wall (5) and a left side wall (6), which are passed on to be described in more detail below.

Floor

Figure 2:
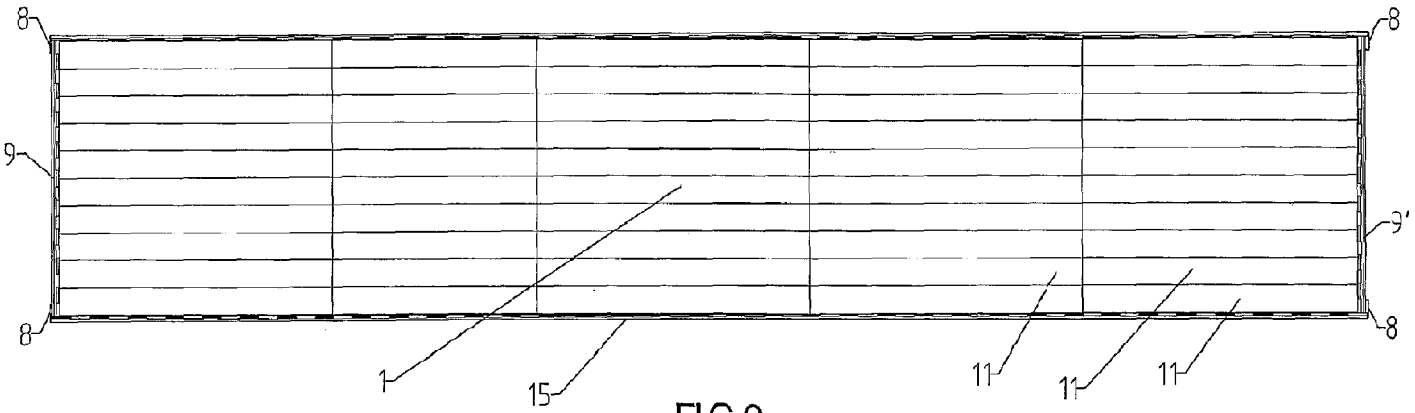
FIG. 2—Shows a top view of the structural assembly that makes up the floor of the collapsible container of the invention.
Figure 3:
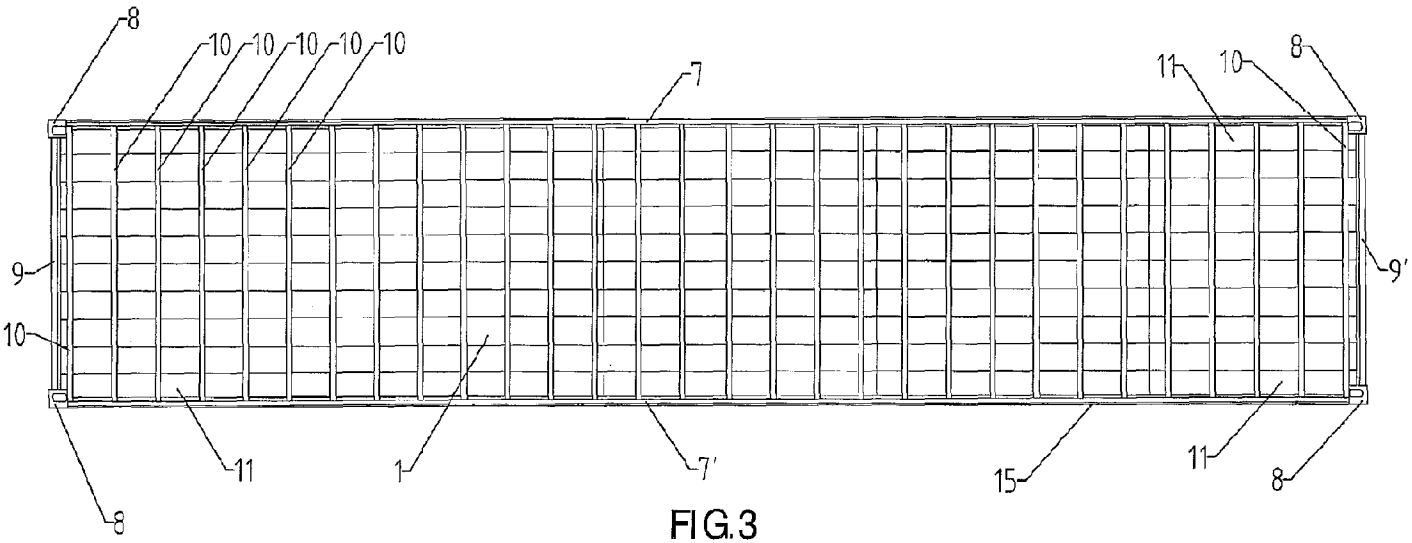
FIG. 3—Shows a bottom plan view of the structural assembly that makes up the floor of the collapsible container of the invention.

The bed or floor element (1) of the collapsible container is, as illustrated in FIGS. 2 and 3, basically a structure comprising first a rectangular outer perimeter frame (15) formed by a pair of longitudinal floor rails (7) (7') forming the sides of the rectangle and a pair of outer transverse rectangular metal structural profiles (9) (9') constituting the short sides of the rectangle.

In the embodiment illustrated in the figures, said longitudinal floor rails (7) (7') are formed by a metal U-shaped structural profile and are joined by welding to a bottom anchorage corner fitting (8) located on the vertices of the rectangle. The bottom anchorage corner fitting (8) are of dimensions and shape similar to those commonly used in ISO shipping containers used in the market and which are defined according to the ISO 1161 and ISO 668-1995 standards, and they are joined in turn, also by welding, to the outer transverse rectangular metal structural profiles (9) (9').

In the bottom of the floor and to give structural rigidity to the frame or outer perimeter (15) generated with the elements described above, a series of transverse floor support stringers (10) are arranged perpendicular, equidistant to each other and joined by welding to the longitudinal floor rails (7) (7') at a necessary and sufficient distance from each other and in necessary and sufficient quantity, wherein these elements are preferably in the form of C-shaped steel profiles of the type commonly used in the floors of the current containers.

Moreover, as shown in FIG. 2, the interior floor of the collapsible container contains attached to each other as a rectangular array, longitudinal floor boards (11), preferably of wood. These longitudinal floor boards (11) are positioned longitudinally to the collapsible container's structure and perpendicular to the transverse floor support stringers (10) to which they are consolidated by bolts or union rivets covering the entire inner surface of the container.

Figure 4:
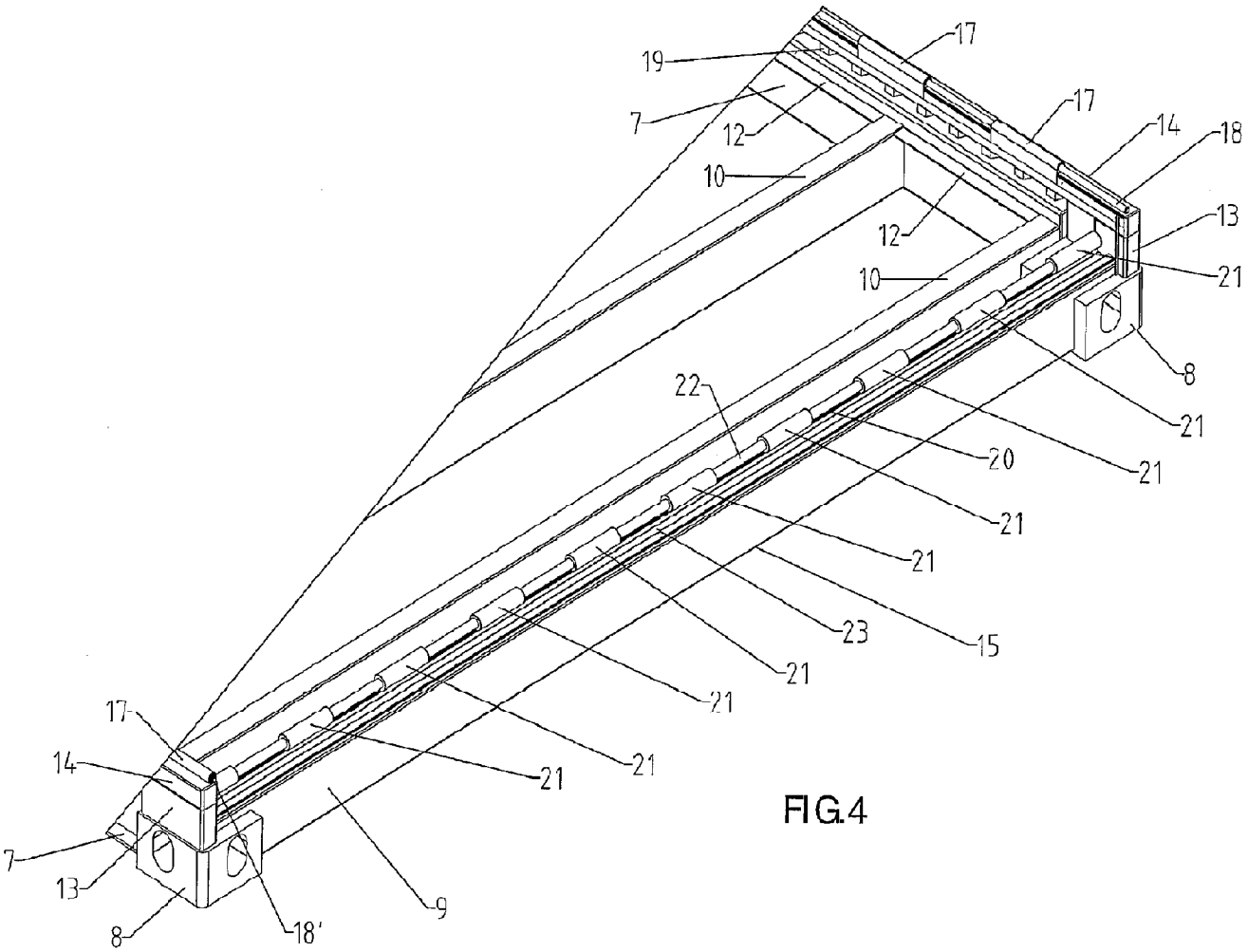
FIG. 4—Shows a perspective view of the floor element of the container detailing the position of the pivot bushings that are part of the hinged joint of the floor with the subframe of the doors of the collapsible container of the invention.

To avoid the possible openings between the lateral contact limits of the longitudinal floor boards (11) in its contact zone with the inner face of the longitudinal floor rails (7) (7'), there are disposed some floor closure metal profiles (12) in the form of 90 degree angled profile with its top surface flush to the bottom plane of the transverse floor support stringers (10), the profiles conveniently welded to the longitudinal floor rails (7) (7') in each of the intermediate spaces generated between the transverse floor support stringers (10), as shown in FIG. 4 of an isometric view of a portion of the front end of the floor (the rear end being identical), where the longitudinal floor boards (11) have been removed in order to clearly see the hidden elements behind these. Thus, a structure is formed which is sealed to the access of environmental agents from the bottom part of the collapsible container.

Figure 5:
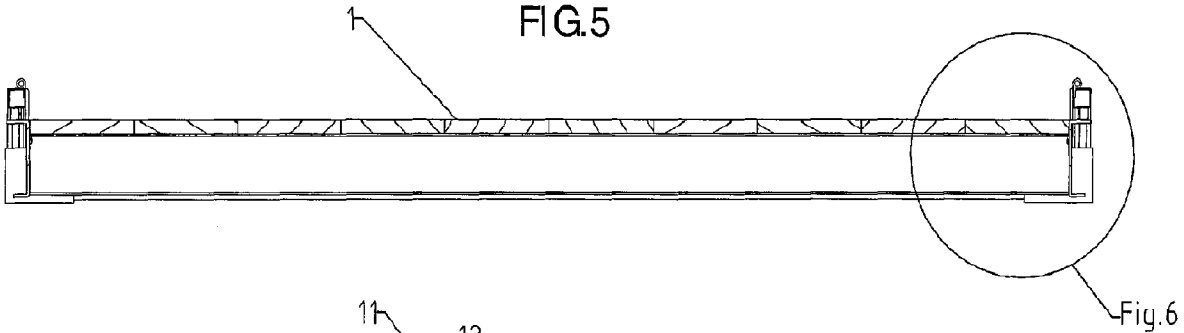
FIGS. 5 and 6—Show a side view of the floor element of the container and a section in detail (FIG. 6) of the support structure of the hinged joint of floor with the side walls of the collapsible container of the invention.
Figure 6:
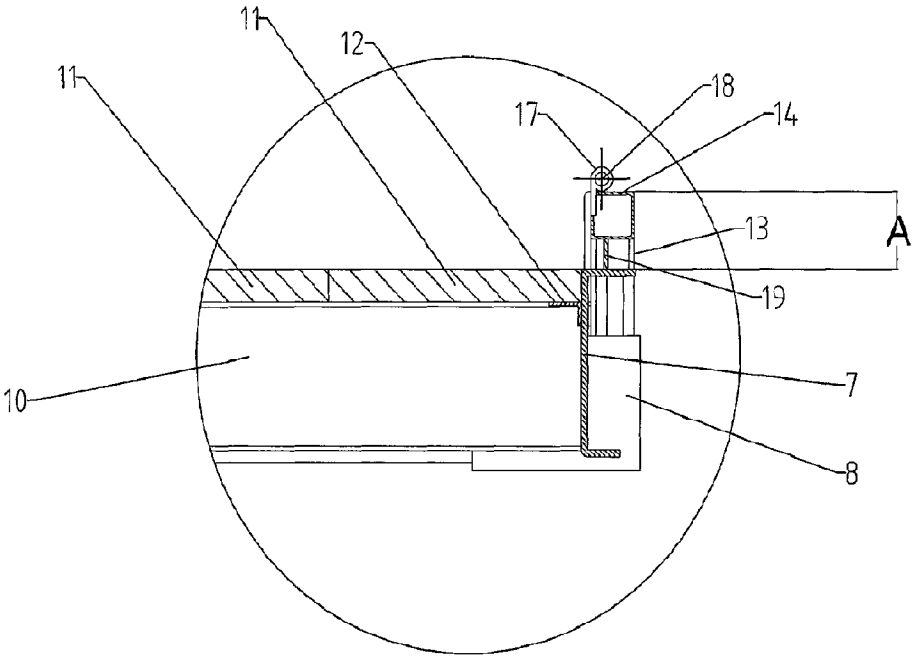

Continuing with FIG. 4 and referring also to FIGS. 5 and 6, in order to form the hinged joint or pivot connection of the side walls (5) (6) with the floor (1) of the collapsible container that will enable the fold said side walls (5) (6) onto the interior of the floor (1) of the collapsible container, a support structure is arranged over the longitudinal floor rails (7) (7') and over the bottom anchorage corner fitting (8), which comprises: a first structural element called floor corner pillar (13), formed by a semi-closed rectangular metal profile and disposed at each corner or outer vertex of the floor (1), over the top face of the bottom anchorage corner fittings (8); a second structural element called floor side crossbar (14), formed by a square metal profile joined at its ends to said floor corner pillar (13) element and longitudinally aligned with the longitudinal floor rails (7) (7), the element (14) extending flush with the limits set between the outer faces of the floor corner pillars (13) of both ends of the collapsible container; and, finally, a corrugated or wavy floor side sheet (19) disposed in the space between the longitudinal floor rails (7) (7') and the floor side crossbar (14), the direction of its pleats arranged perpendicular to the top face of the U-shaped profile of the longitudinal floor rail (7) (7') and the underside of the profile, wherein this element (19) is disposed to provide a tight enclosure for the container's contents and to prevent bending of the floor side crossbar (14) when its midpoint is subject to vertical compression loads.

Figure 21:
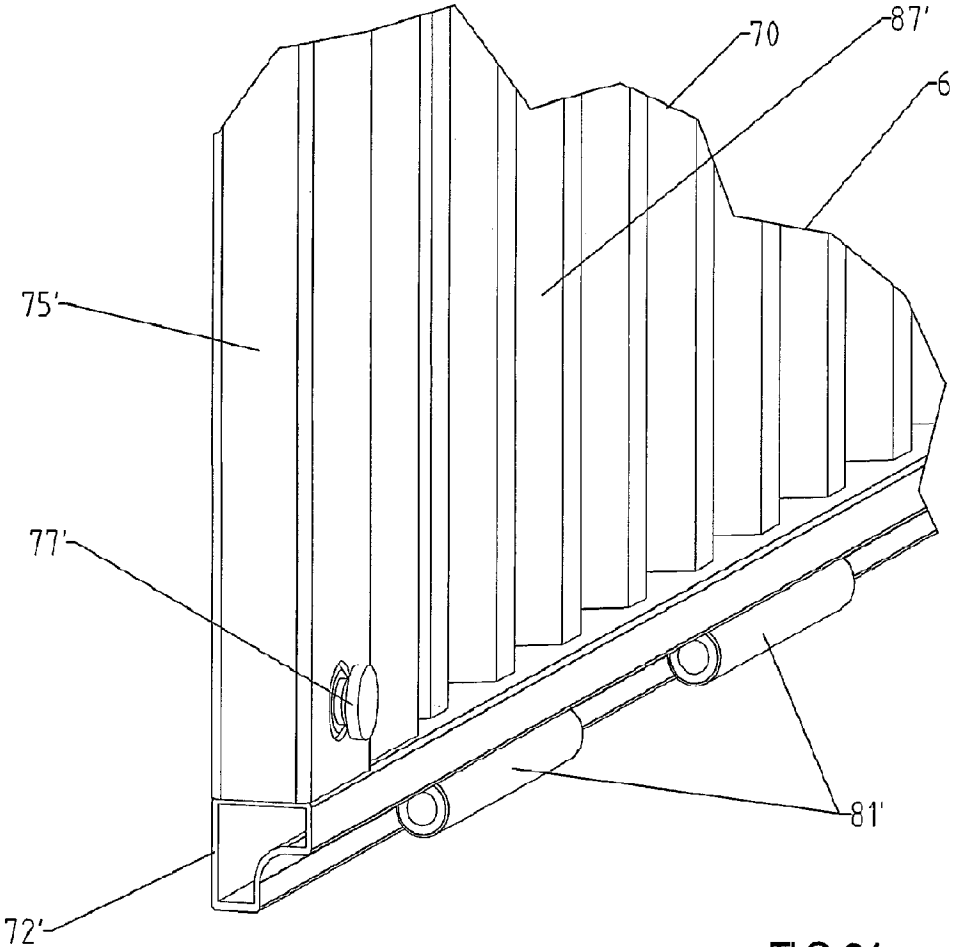
FIG. 21—Shows a perspective view with the details of one of the bottom corner fittings of the frame of a bottom foldable side panel showing a pair of pivot bushings that are part of the hinged joint of the side walls with the floor of the collapsible container of the invention.

As shown in detail in FIG. 4, a first part or half of the hinged joint of the floor with the side walls (5) and (6) comprises hollow cylindrical elements or lateral pivot bushings (17) with a projecting fixed flap for attachment to the support structure (13, 14). The lateral pivot bushings (17) are located longitudinally equidistantly spaced from each other, with an intermediate distance between them equal to their length thereof and occupying the entire length of the longitudinal floor rail (7) (7'). As seen in FIG. 21, in the assembled container these lateral pivot bushings (17) alternate with respective bottom metal pivot bushings (81') disposed in the side walls (5) (6) and are aligned in their central axis and at the same time threaded by means of a longitudinal pivot axle (18), thus forming a common type hinged joint or pivot connection which will allow the folding of the right and left side walls (5) (6) over the floor (1) of the collapsible container.

As shown in FIG. 6, the height (A) generated from the inside floor level of the container, formed and defined by the plane of the top face of the longitudinal floor boards (11), until the height of the top face of the support structure (13, 14, 19) of the hinged joint of the floor (1) and side walls (5) (6) or, what is the same, the starting height of said pivot or hinged joint of the floor with the side walls is equivalent, at least, to the height defined by the maximum level of the assembly comprising the rear panel (3) and front panel (2) with access doors and the respective hinged joints with the floor (1) when the panels are folded on the floor (1), as in this way the right and left side walls (5) (6) fold above the previous folding of the rear panel (3) and front panel (2) with doors, according to the technique described hereinbelow for collapsing of the container and which can be clearly viewed in FIGS. 58 to 61 of the fully collapsed container.

For the joining, pivoting, rotation and subsequent folding of the rear panel (3) and front panel (2) with doors with the floor (1) of the collapsible container, a hinged joint system of the common type already described is disposed that, in its part or half corresponding to the floor is composed of front pivot bushings (21), such as those illustrated in the detail provided by FIG. 4. The front pivot bushings (21) are attached to the top face of the outer transverse rectangular metal structural profiles (9) (9') by a 90 degrees angular metal structural profile (20) (20'), which in turn is attached to the inner face of the outer transverse rectangular structural profiles (9) (9'). It is desirable that said angular profile (20) (20') has the same length as the profiles (9) (9') and that their top face is on the same plane as the bottom, sides of the longitudinal floor boards (11) so that they also serve as a seat for these at their end cantilevered portion.

Figure 7:
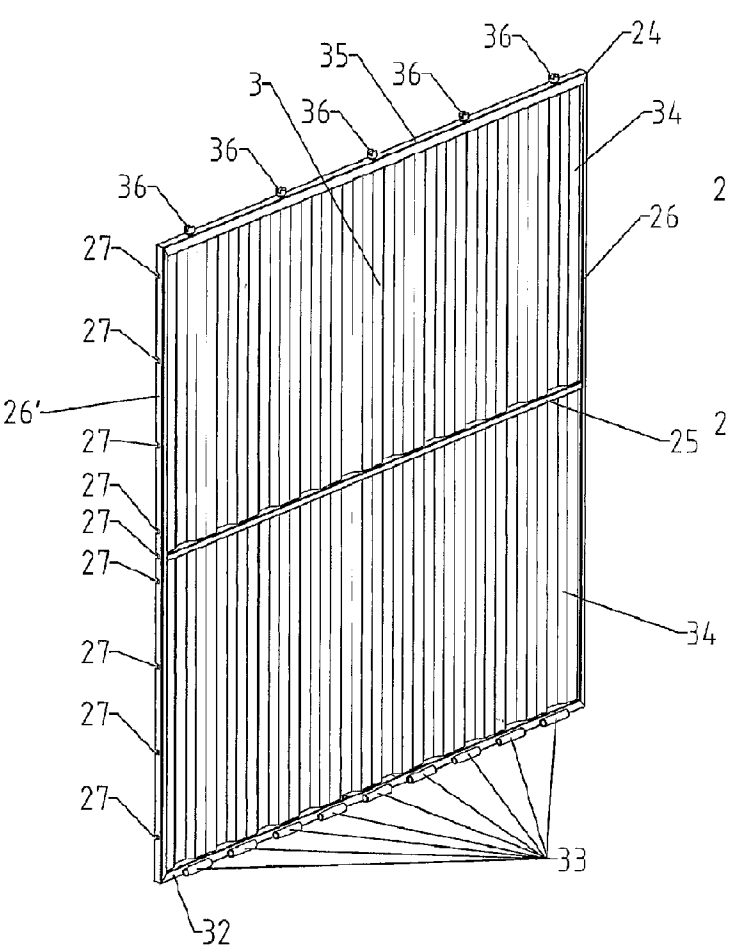
FIG. 7—Shows a perspective view from inside the structural assembly defined as the rear panel of the collapsible container of the invention.
Figure 11:
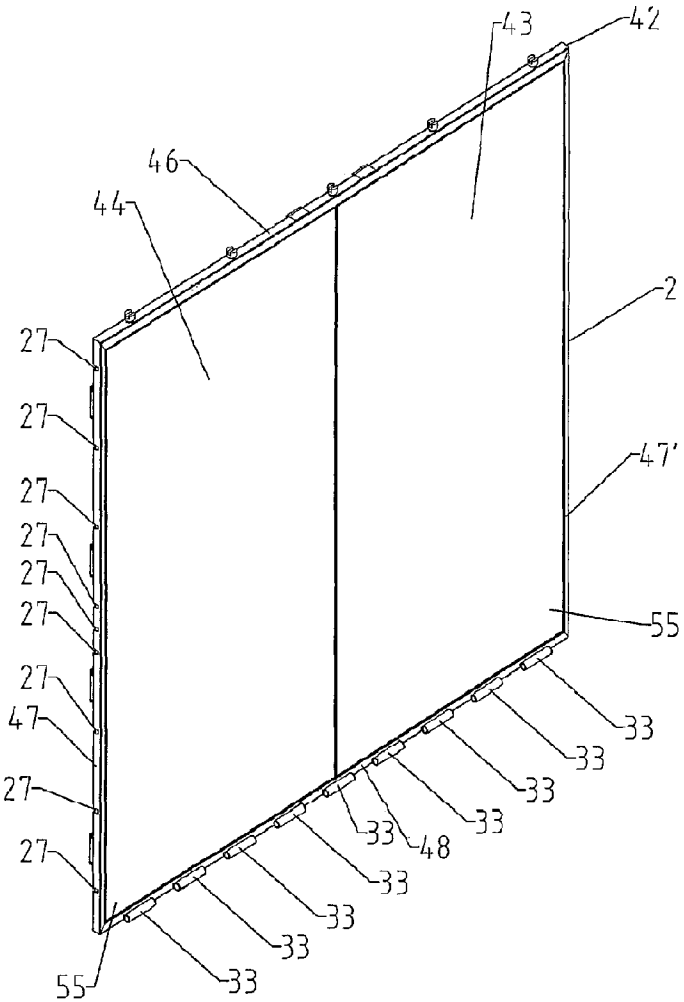
FIG. 11—Shows a perspective view from inside of the structural assembly defined as front panel with access doors of the collapsible container of the invention.

As in the lateral hinged joint, the front pivot bushings (21) are in the assembled container alternated with corresponding bottom pivot bushings (33) fixed to the rear panel (3) and front panel (2) with access doors, as shown in FIGS. 7 and 11, so that when threaded by the pivot axle (22) they form the hinged joint or union that will allow the folding of the rear panel (3) and front panel (2) with access doors onto the floor (1).

As illustrated in FIG. 4, to prevent entry of elements from the outside environment into the collapsing container through the bottom of said panels (2) (3), a rectangular strip of rubber (23) or similar element providing the function of a sealing gasket is arranged on the outer transverse rectangular structural profiles (9) (9'), in their top face, outwardly of the profile and along its entire length.

Rear Panel

Figure 8:
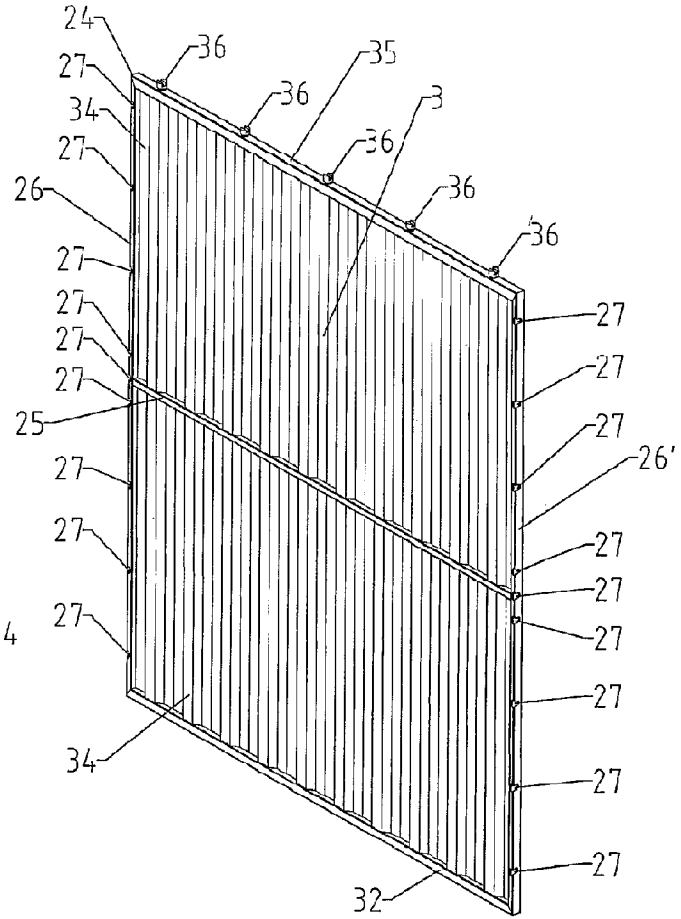
FIG. 8—Shows a perspective view from the outside of the structural assembly defined as the rear panel or collapsible container of the invention.

As seen in FIGS. 7 and 8, the rear panel (3) of the collapsible container is developed on the basis of an outer metal structural framework (24), preferably made by joining by welding of rectangular metal structural profiles commonly found in the market. The outside dimensions of the outer metal structural framework (24) are calculated to fit snugly in the inner space that, for the purpose of positioning the rear panel (3) in the assembled container, is generated by the elements floor (1), left and right side walls (5) (6) and roof (4) of the collapsible container.

A horizontal crosspiece (25), preferably also made of rectangular structural metal profile, is situated at the midpoint of the vertical member of the outer structural frame (24) of the rear panel (3), welded at right angles between the insides of the lateral profiles (26) (26') which, form part of the outer structural frame (24). Said horizontal beam (25) has the function of preventing the bending or inward flexing of the lateral profiles (26) (26') of the external metal structural frame (24) of the rear panel (3) when the collapsible container is subjected to vertical loads.

As can be observed in FIGS. 7 and 8, the spaces generated between the interiors of the profiles which form the outer metal structural frame (24) and the horizontal crosspiece (25), are covered with corrugated metal sheet (34) attached by welding to the inside faces and with direction of its fold creases perpendicular to the horizontal crosspiece so that it will provide the outer metal structural frame (24) with an additional resistance to vertical compression.

On the outer edges of the lateral profiles (26) (26') some cut-outs (27) have been made strategically located on the outer face of the rear panel (3), which have a shape adapted to receive a lateral anchor bolt (77) emerging from the side walls (5) (6) (see FIG. 20) at the moment when the rear panel (3) pivots around its pivotal connection with the floor to reach the vertical position or phase known as unfolded rear panel (3). These cut-outs (27) act then as a female elements and the bolts (77) as a male anchors, assuring with tight engagement with the lateral anchor bolt (77) in said cut-out (27) the lateral joining and consolidation of the rear panel (3) with the side walls (5) (6).

As is illustrated FIG. 7, the bottom pivot bushings (33) which together form the other half of the hinged joint of rear panel (3) with the floor (1) are aligned, strategically arranged, in the inside face of the bottom profile (32) of the rear panel (3). The combination of the bottom pivot bushings (33) of the rear panel (3) with the line of front pivot bushings (21) located on the floor (1) and the pivot axis (22) that the threads them make up the hinged joint which allows the rotation and consequent folding of the rear panel (3) over the floor (1) and, conversely, allows the rear panel (3) to pass from the horizontal or folded plane to the vertical or unfolded plane by turning 90 degrees around the defined hinge.

As illustrated by FIGS. 7 and 8, over the top profile (35) of the rear panel (3), emerging from its top outer face and strategically placed, an aligned series of cylindrical pins (36) which do the work of locking the rear panel (3) with the roof (4) once the rear panel reaches the vertical position in the phase of uncollapsing of the collapsible container and it is engaged with the roof. For this the cylindrical pins (36) have a configuration adapted to be received in recesses or cuts (139) made in the outer transverse beams (119) of the roof (4) and to act as female element of a latch and anti-fold lock mechanism (129, 134, 137, 140) of the roof (4) to the rear panel (3), as illustrated in FIGS. 38, 39, 40 and 41.

Figure 10:
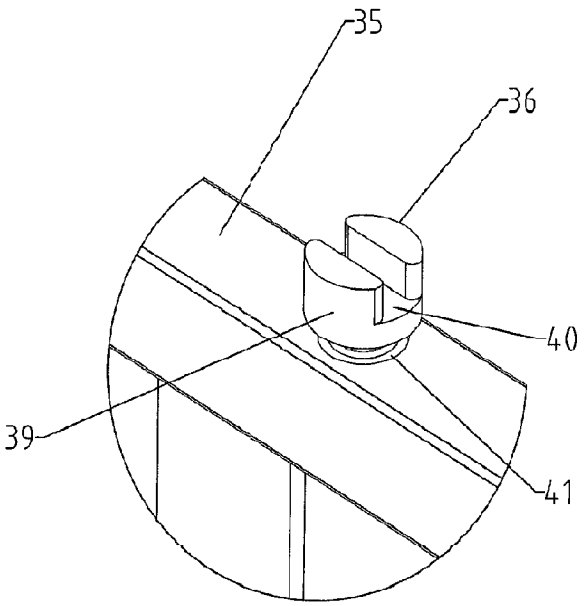
FIG. 10—Shows a perspective view detailing the top profile of the structural framework of the rear panel showing the position of a cylindrical bolt for vertically locking rear panel with the roof of the container of the invention when assembled.
Figure 9:
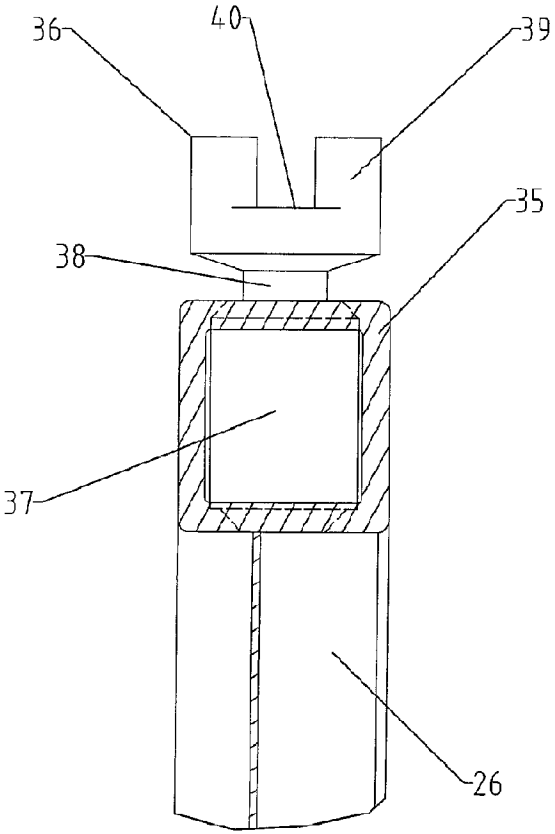
FIG. 9—Shows a cross-section view detailing the top profile of the structural framework of the rear panel showing the position of a vertical cylindrical bolt for vertically locking of the rear panel with the roof in the container of the invention when assembled.

Specifically, as is illustrated in FIGS. 9 and 10, the cylindrical pins (36) have a configuration consisting of a central body (37) of length equal to the thickness of the top profile (35) used in the making of the outer metal structural framework (24) of the rear panel (3) of the container, a neck (38) of diameter less than the body and a head (39) of diameter equal to or greater than the central body (37). The neck (38) and head (39) structure of the cylindrical pins (36) emerge from the outer face of the top profile (35) while the central body (37) is left imbedded and joined by welding in holes (41) made to this effect in the top profile (35). A slot (40) has been diametrically made in the head (39) of the cylindrical pin (36) with a sufficient width and depth that it may easily receive, in female element mode, the sliding plate (129) of the latch and anti-fold locking mechanism which, in male element mode, performs the function of locking and unlocking of the roof (4) and the rear panel (3).

As seen in FIGS. 7 and 10, the slots (40) made in the head (39) of the cylindrical pins (36) are arranged aligned with the longitudinal axis of the top profile (35).

For a better understanding, FIGS. 9 and 10 show a clear detail of the alignment and positioning of the cylindrical pins (36) in the top profile (35).

Front Panel

Figure 14:
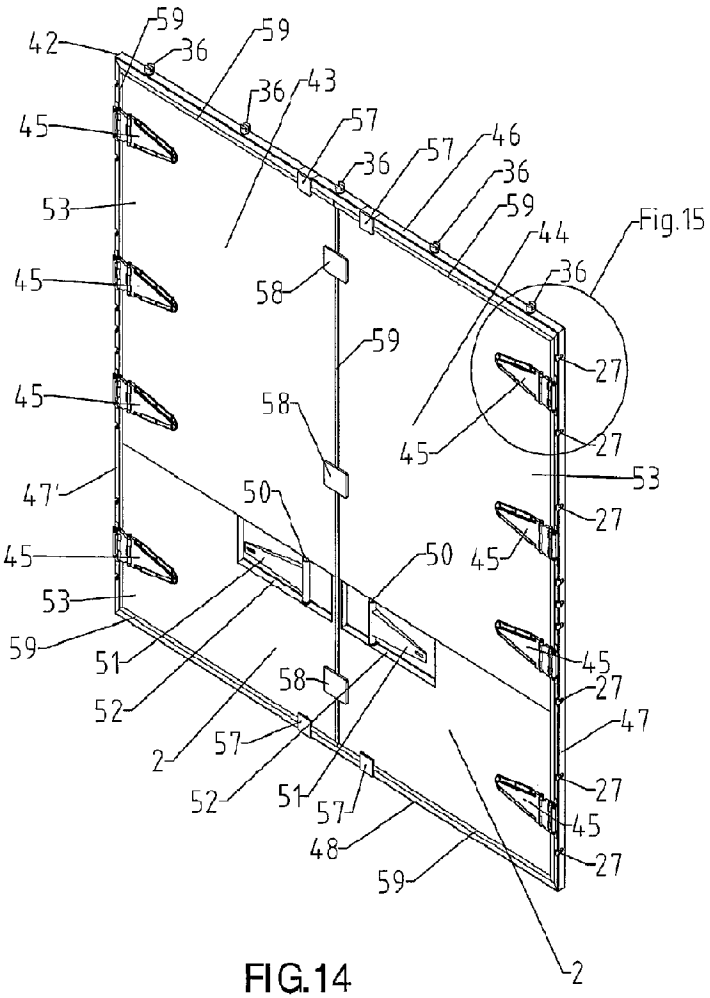
FIG. 14—Shows a perspective view from the outside of the structural assembly defined as the front panel with access doors of the collapsible container of the invention with all its panels installed.

In FIGS. 14 and 11, the preferred embodiment of the front panel (2) with doors can be appreciated. Said panel (2) as well as the rear panel (3) is developed on the basis of an outer metal structural subframe (42) made by the weld joining rectangular metal structural profiles (46) (47) (47') (48) of those which are commonly found on the market. The external dimensions of the outer metal structural subframe (42) are calculated to fit perfectly into the interior space that for the purpose of situating the front panel (2) with doors in the assembled container generate the floor (1), right and left side walls (5) (6) and roof (4) elements of the collapsible container.

On said outer metal structural subframe (42) are mounted and assembled the doors (43) (44) of the container. The doors (43) (44) are joined to the outer metal structural subframe (42) by a set of cap hinges (45) of triple action or three phases (see detail in FIG. 15) installed on the outside of the sides of the outer metal structural subframe (42) and developed for the purpose of achieving the full opening with a turn of 270 degree of the doors (43) (44) of the collapsible container. As shown in FIG. 14, the cap hinges (45) of three phases are situated at variable and required amount to ensure the proper opening and rigidity of the doors (43) (44).

Like the outer metal structural framework (24) of the rear panel (3), the outer metal structural subframe (42) of the front panel (2) has a top profile (46), two lateral profiles (47) (47') and a bottom profile (48) containing the different elements and machining that allow the movement and action of the doors (43) (44) with the outer metal structural subframe (42) and of the latter with the rest of the array of elements of the collapsible container.

Figure 13:
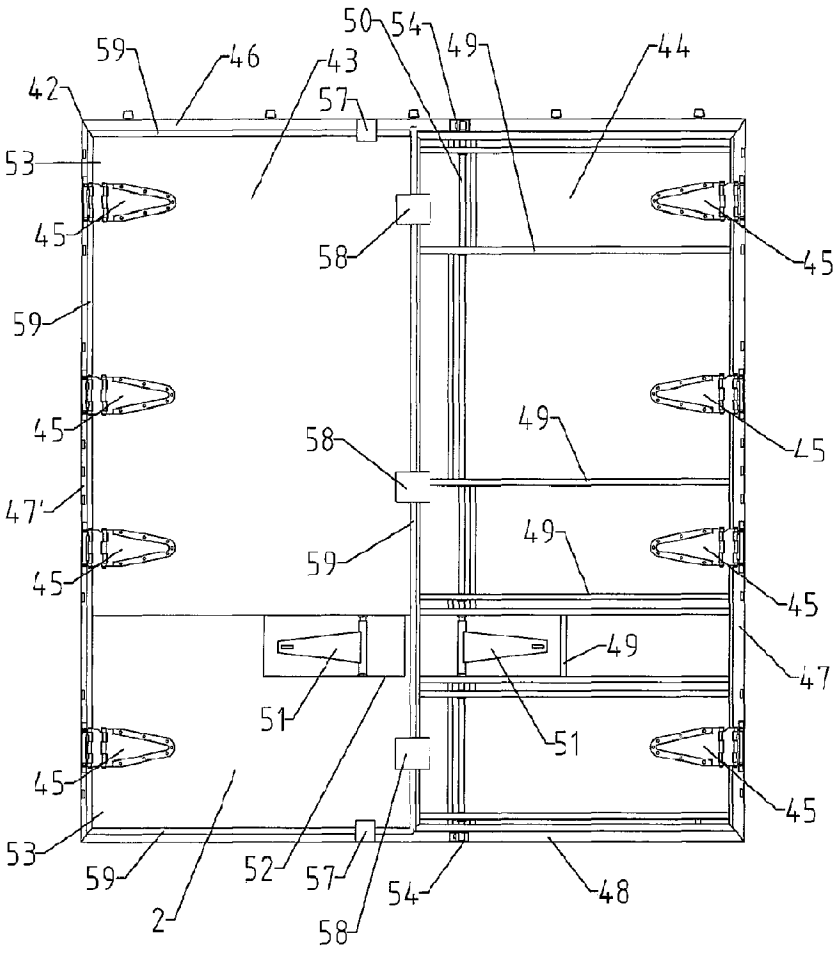
FIG. 13—Shows a front elevation view of the structural assembly defined as front panel with access doors of the collapsible container of the invention where the closure panels have been removed from one door to display the frame and inside composition of the door.

The doors (43) (44) of the collapsible container herein described fit perfectly into the inner space generated by the outer metal structural subframe (42) of the front panel (2) and are made on the basis of a metal structural frame (49) and external (53) and internal (55) panels riveted or bolted to the metal frame, occupying the entire space interior to the subframe, as shown in FIG. 13 where the front panels of the right door (44) have been removed to have an inner view of the same.

The locking system of the doors is made up of a vertical locking axle bar (50) with locking pawls (not shown) at their ends, wherein the bar internally traverses holes which are aligned to the metal structural frame (49) which forms the inside of the doors (43) (44), the system integrated into the interior of the doors so that said locking elements are all placed to the inside of the outer plane or face of the door (43) (44), without protruding outwardly from the same. The vertical locking axle bar (50) integrates in its single point of access to the outside an opening and closing handle (51) fixed to the vertical locking axle bar (50), the handle being arranged in an inner rectangular cavity (52) of the doors (43) (44). This opening and closing handle (51) can act as a lever, rotating the vertical locking axle bar (50) around its axis and consequently the locking pawls into lock bushings (54) embedded in the top (46) and bottom (48) profiles of the subframe (42), each bushing with a pawl locking axle, thus allowing to perform the closing and opening of the doors. When the opening and closing handle (51) is in the closed position of the doors (43) (44), it is received in the inner rectangular cavity (52) of the doors (43) (44).

Figure 12:
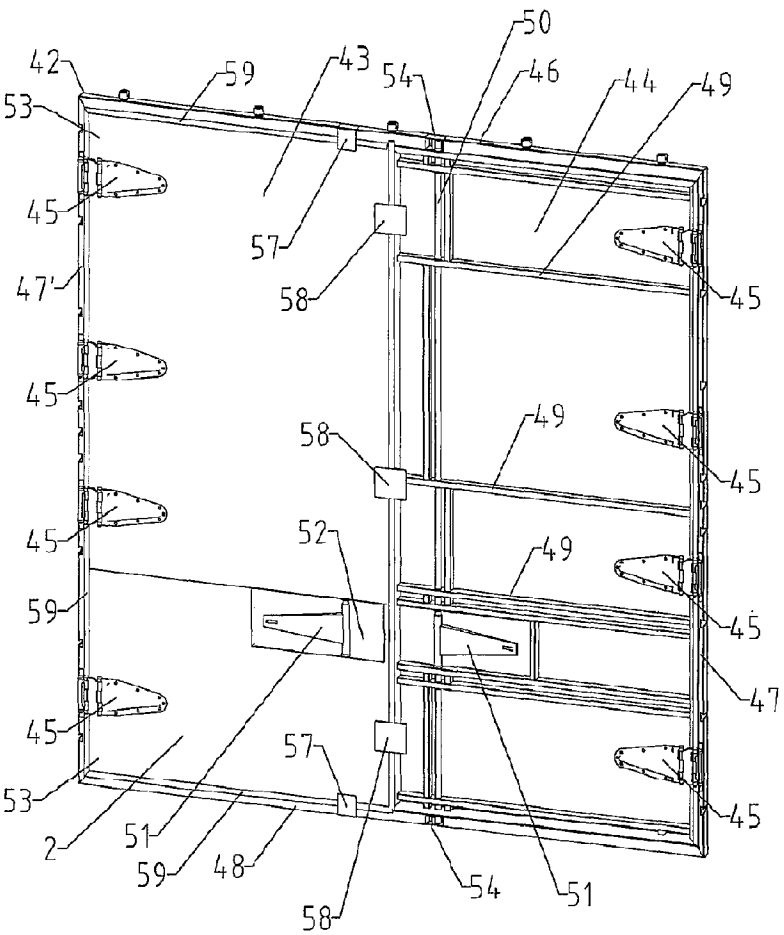
FIG. 12—Shows a perspective view from the outside of the structural assembly defined as front panel with access doors of the collapsible container of the invention where the closure panels have been withdrawn from one door to display the frame and inside composition of the door.

As shown in FIGS. 14 and 12, both doors (43) (44) have externally, integral and attached by welding rectangular flat plates (57) which act as protective cover for the lock bushings (54) when the doors (43) (44) are in their closed position so that the internal mechanism of the lock bushings (54) is sealed, preventing the entry of foreign elements in its interior. Furthermore, the right door (44) of the collapsible container has central retaining flaps (58) welded to the left lateral rail of the metal structural frame (49), so that when performing the final phase of closure of both doors (43) (44), left door (43) of the container is necessarily closed before the right door (44).

The outer contour of the doors (43) (44) of the collapsible container has throughout its perimeter half-pipe shaped rubber joints (59) as the ones usually used in conventional doors of the containers that exist in the market. As shown in FIG. 14, said perimeter seal (59) is in contact with the entire inner perimeter of the outer metal structural subframe (42) of the doors, thus performing the function of hermetical closure when the doors are in their closed position.

Figure 15:
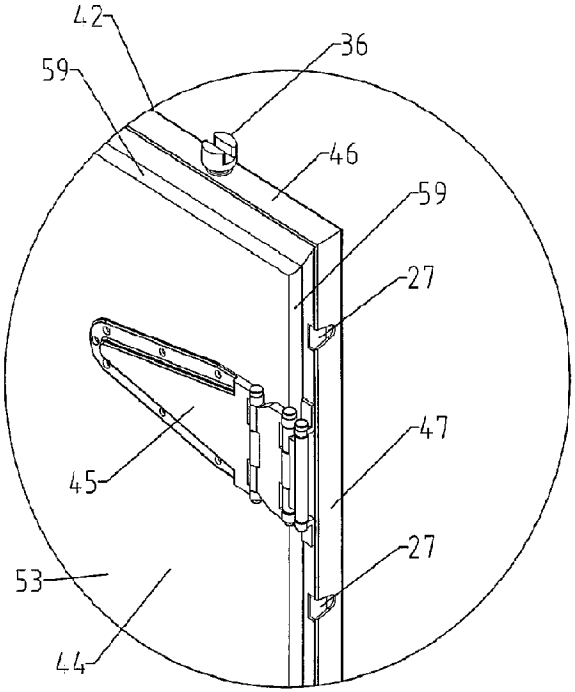
FIG. 15—Shows a perspective view from the outside with the detail of one of the top corner fittings of the front panel with access doors of the collapsible container of the invention, showing one of the hinges for opening the doors.

Functionally it should be noted, as specifically shown in FIGS. 14, 15 and 11, that the front panel (2) with access doors has, as in the rear panel (3) explained above, the same joining, locking and pivoting technical means mounted on the inside of the bottom profile (48), over the top profile (46) and on the lateral profiles (47) (47') of the outer metal structural subframe (42) of the doors (43) (44), so the details are herein omitted because these means (27, 33, 36, 60) are identical in shape, arrangement and number to those used in the outer structural frame (24) of the rear panel (3).

Side Walls

With respect of the side walls (5) (6) of the collapsible container of the invention, it should be noted that they are built symmetrically one of the other about the longitudinal central axis of the container, so that then a preferred embodiment of only one of these side walls (5) (6) is explained in detail hereinafter.

The side walls (5) (6) of the collapsible container are composite elements, defined by three different parts which are each in turn structurally consolidated and composed of multiple elements joined together by different methods and techniques which finally make up a single assemblable unit. These three parts that form the side walls (5) (6) assembly are joined together by hinges, giving the final assembly of the unfolded side walls (5) (6) the ability to fold up on itself in a controlled way and direction.

Figure 16:
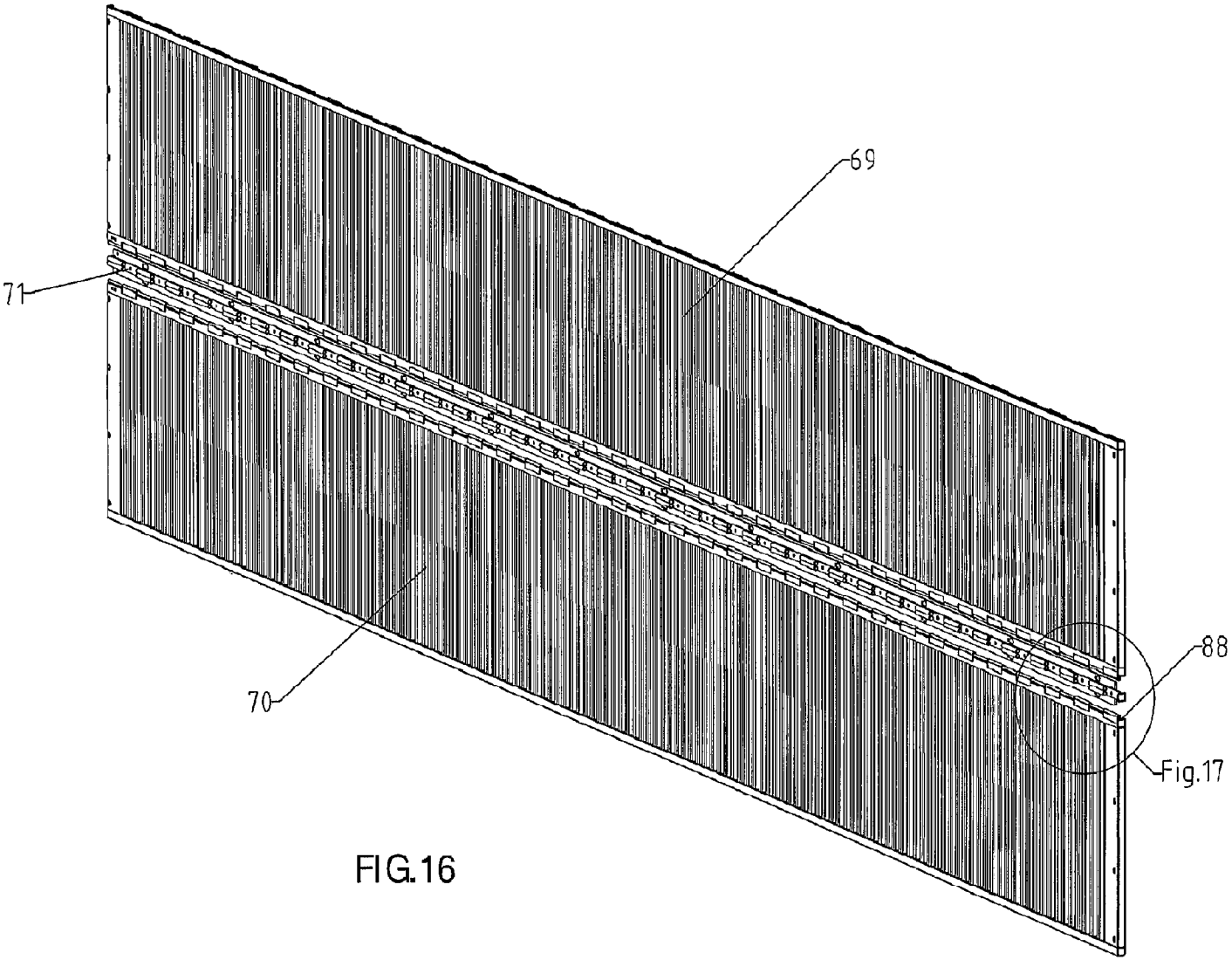
FIG. 16—Shows a perspective view from the outside of the breakdown of the main structural elements that make up the side walls of the collapsible container of the invention facing each other in position but without the assembly having been performed yet.
Figure 17:
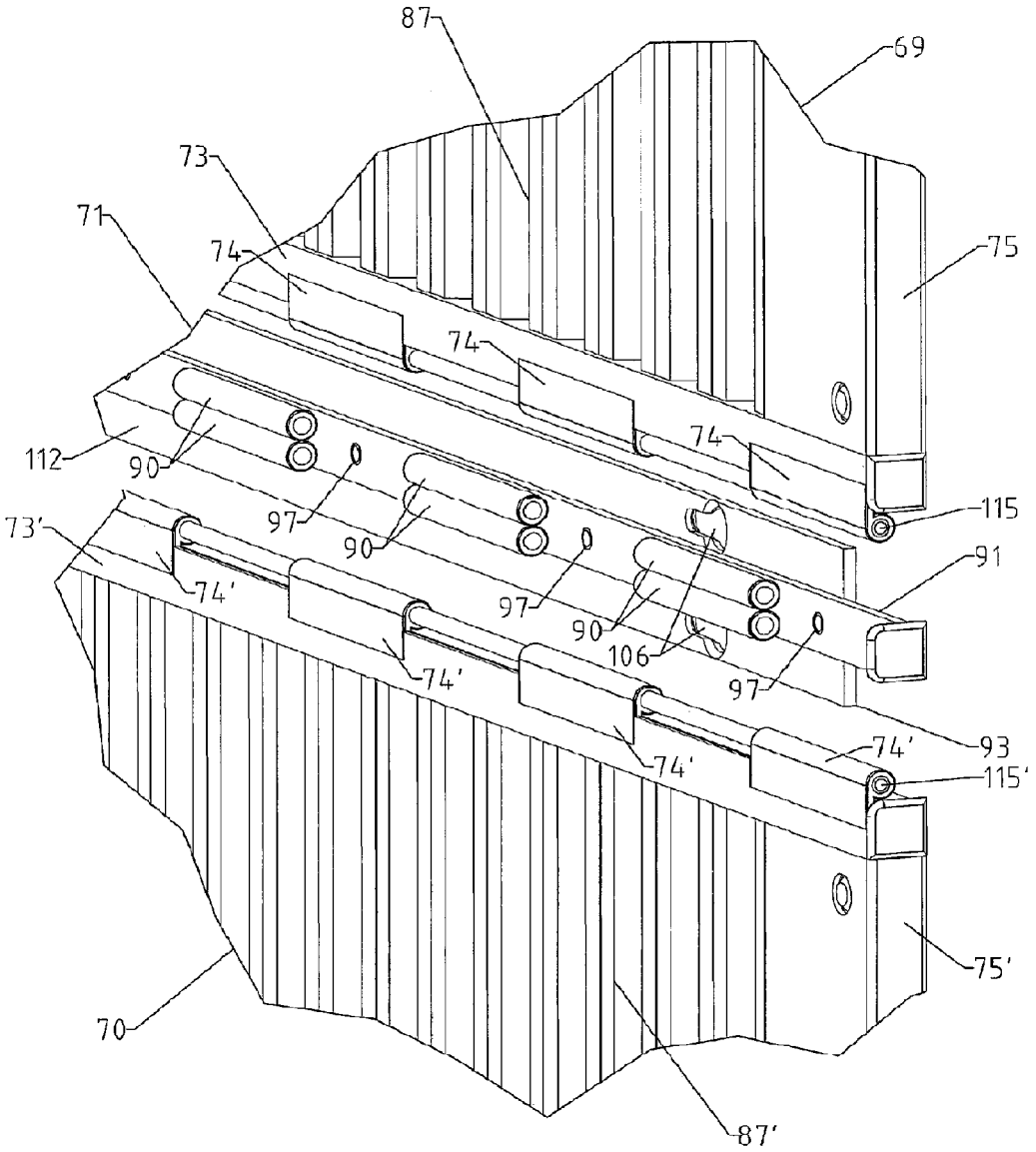
FIG. 17—Shows a perspective view from the outside with a detailed of the breakdown of the main structural elements that make up the side walls of the collapsible container of the invention facing each other in position but without the assembly having been performed yet.
Figure 18:
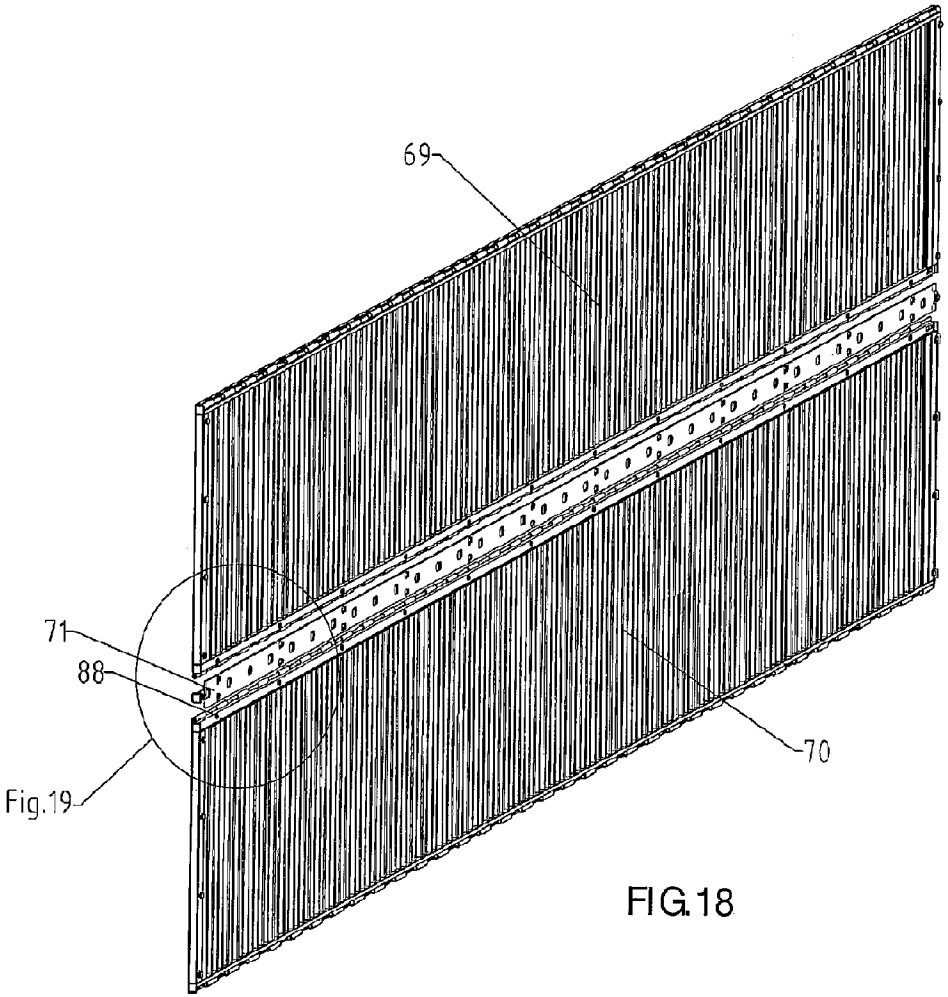
FIG. 18—Shows a perspective view from inside of the breakdown of the main structural elements that make up the side walls of the collapsible container of the invention facing each other in position but without the assembly having been performed.

FIGS. 16 and 18 and the partial detail views of FIGS. 17 and 19 respectively show from the outside and the inside of the container the three separate parts forming the side wall (6) and which are defined as a top foldable side panel (69), a bottom foldable side panel (70) and a central joining, anti-fold locking and pivoting element (71) of the side panels, which are described in detail below:

i) Top Foldable Side Panel

Figure 20:
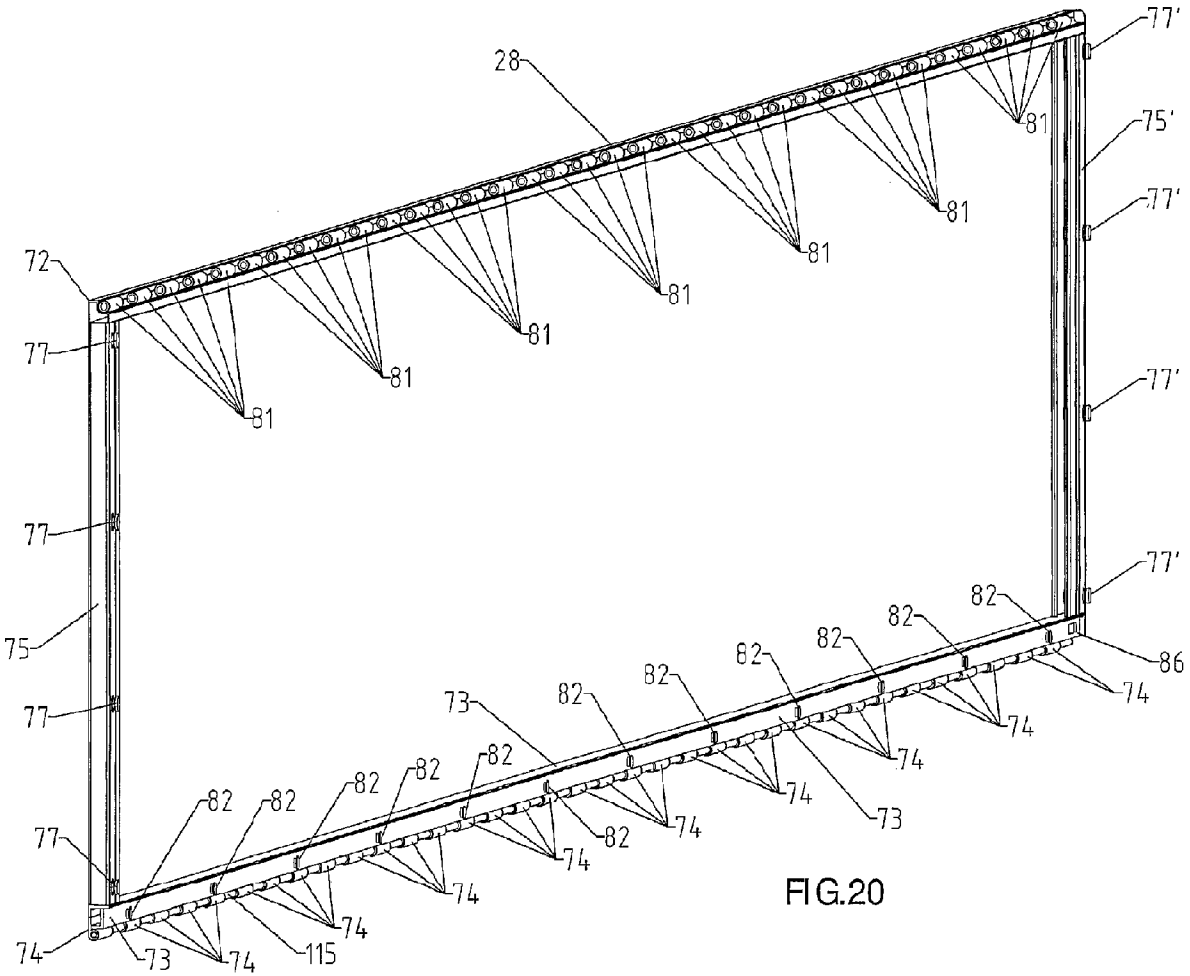
FIG. 20—Shows a perspective view from the inside of the structural elements that make up the frames of the foldable side panels, wherein the corrugated sheet that fills their inside has been removed for better clarity.

The preferred embodiment of the top foldable side panel (69), as shown from the inside in FIG. 20, has a substantially rectangular structure consisting of an outer structural frame (28) consisting of an extreme rail (72), a central rail (73) and a pair of outer vertical pillars (75) (75') on each side.

The extreme rail (72) is basically a metal structural profile, essentially square but with a deformation in its inner side such that it defines a seat for the metal pivot bushings (81) which constitute a portion or half of the hinged joint of the extreme rail (72) with the roof (4). Said metal pivot bushings (81) are emplaced longitudinally aligned and equally spaced with an intermediate distance between them equal to their length thereof, occupying the entire length of the extreme rail (72).

The central rail (73) is constituted by 90 degree angular metal profiles welded forming an element of substantially square section in which are installed a part or half of the hinged or pivoting connection of the top foldable side panel (69) with the central pivoting, anti-fold locking and connecting element (71) of the folding panels consisting of pivot bushings (74) welded and aligned equidistantly along the entire length of the central rail (73).

Figure 19:
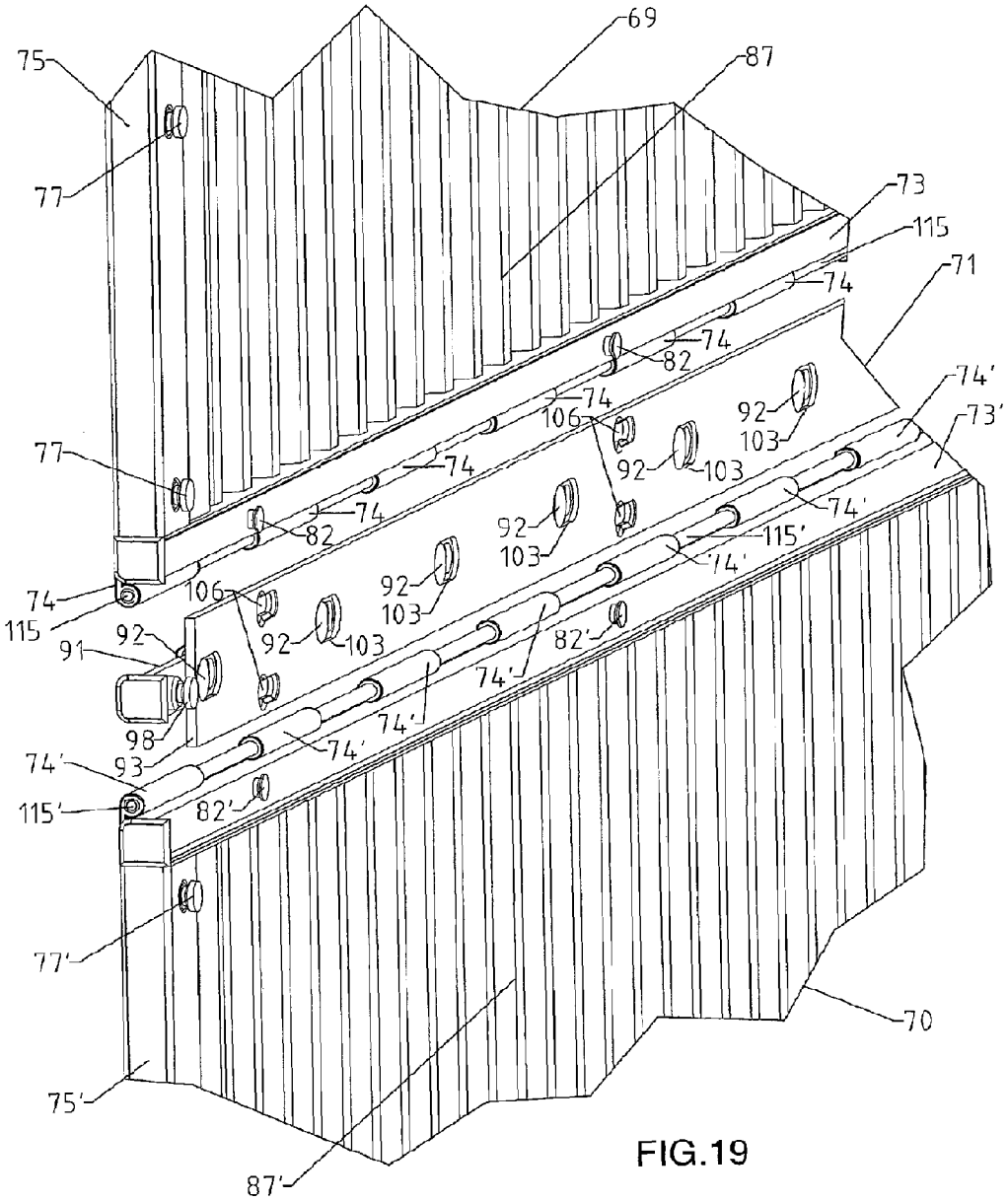
FIG. 19—Shows a perspective view from the inside of a detailed of the main structural elements that make up the side walls of the collapsible container of the invention facing each other in position but without the assembly having been performed.
Figure 22:
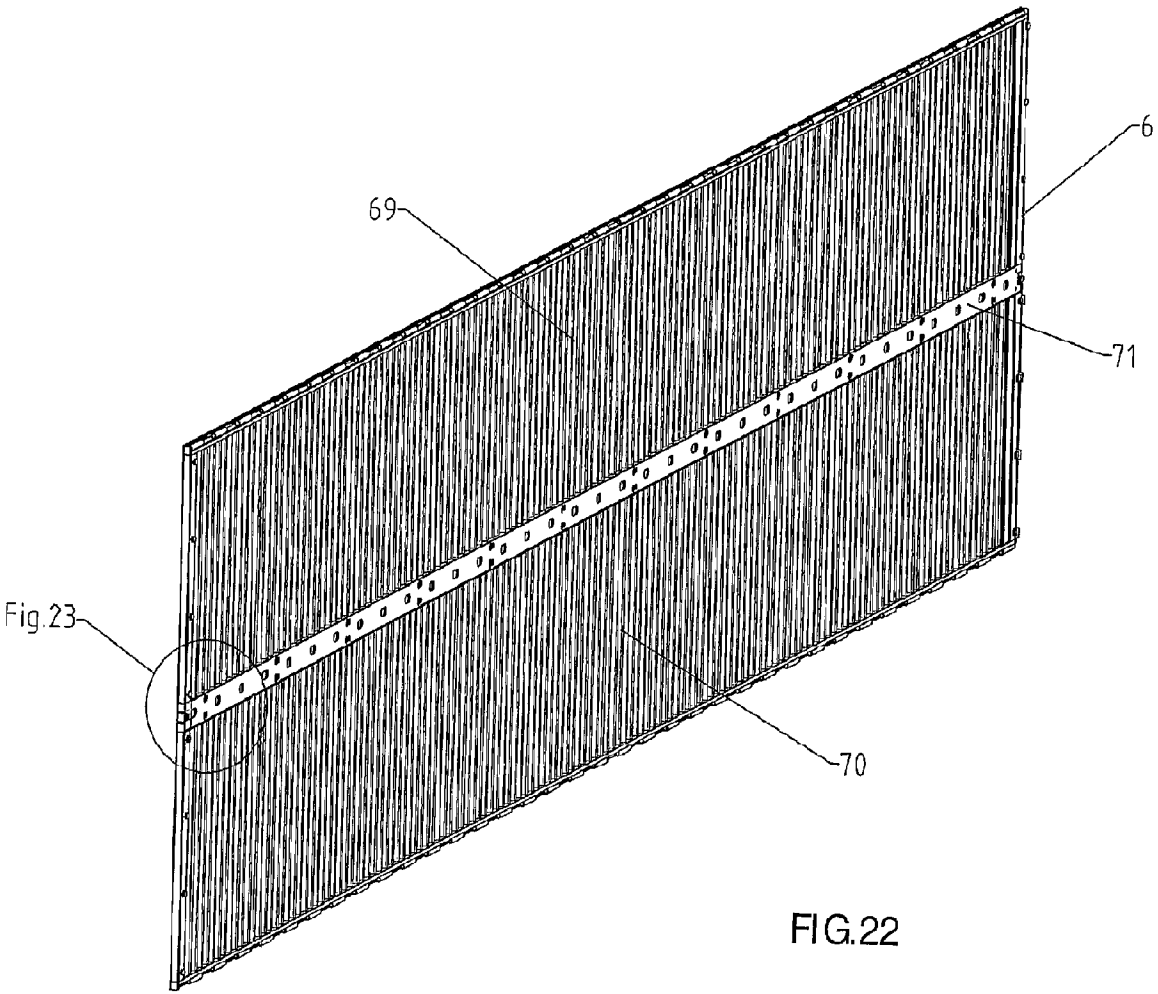
FIG. 22—Shows a perspective view from the inside of a sidewall of the assembled container when the sliding latch lock mechanism is in the unlocked position.
Figure 23:
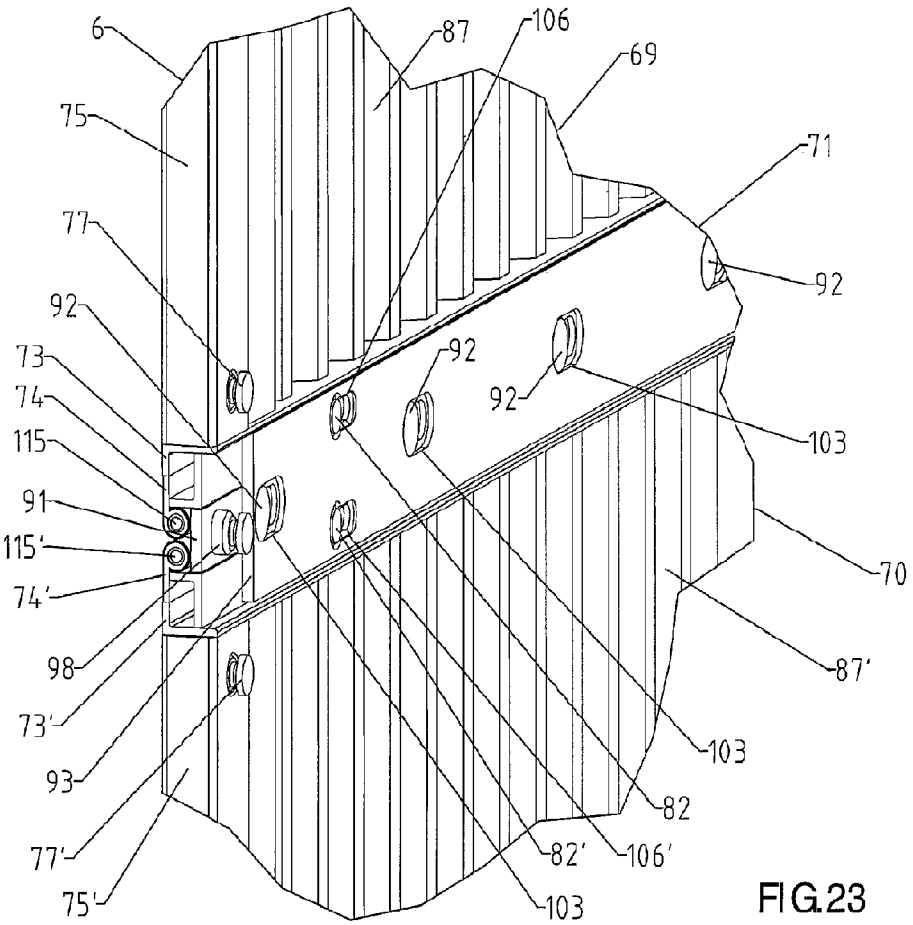
FIG. 23—Shows a detailed perspective view of FIG. 22 showing the various elements that make up the assembly of the foldable side panels and the pivoting, anti-fold locking and connecting element of the side panels when the sliding latch lock mechanism is in the unlocked position.
Figure 24:
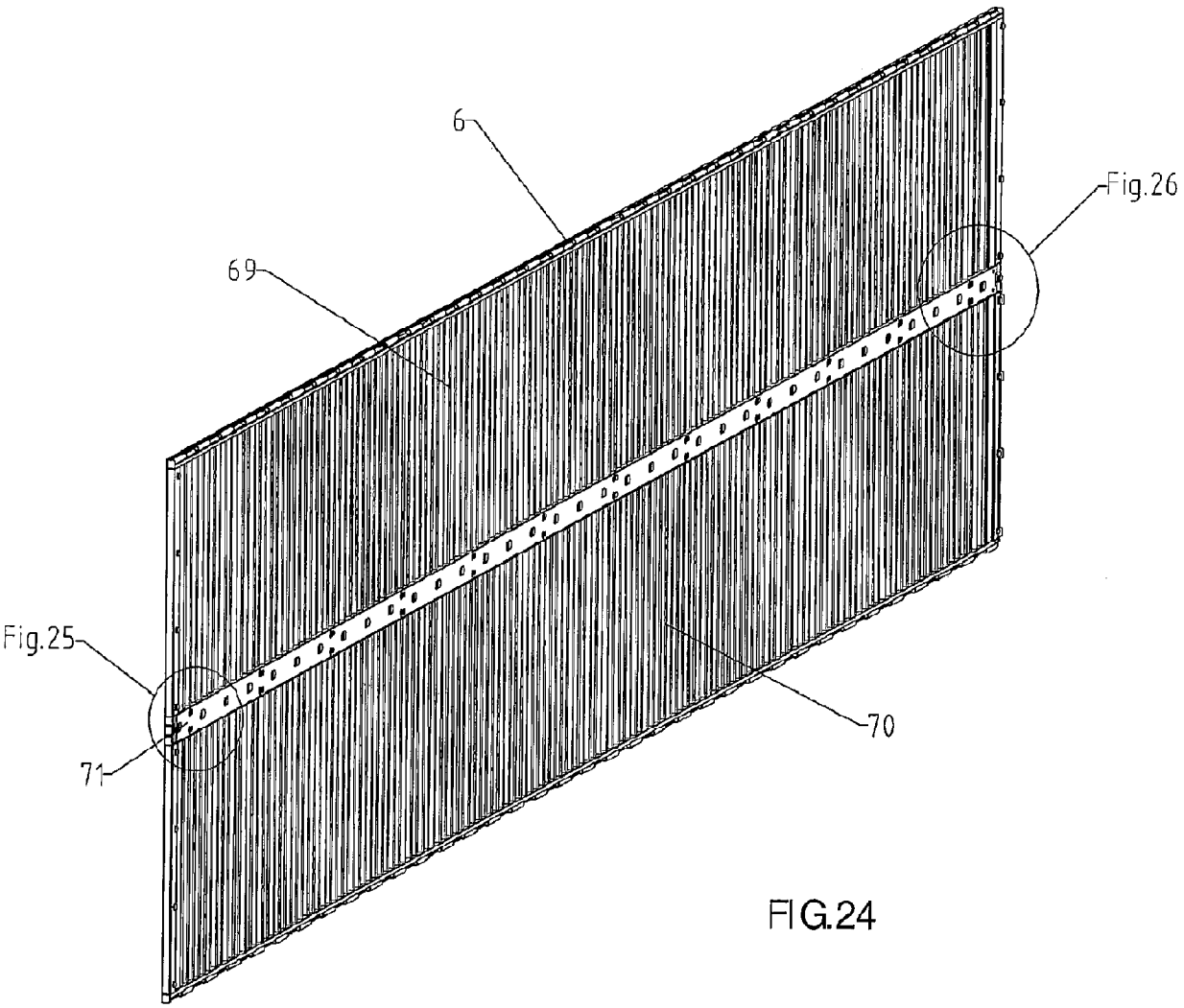
FIG. 24—Shows a perspective view from the inside of a side wall of the container assembled when the sliding latch lock mechanism is in the locked position.

As can be seen in FIGS. 17, 19 and 20, on the inside of the central rail (73), over its entire length and strategically located, there are arranged, fixed by welding, anti-fold lateral bolts (82) similar to the cylindrical pins (36) emerging from the top profiles of the rear panel (3) and the front panel (2) with doors, except that they have a lower profile head and no slot. These anti-fold lateral bolts (82) constitute the components of the foldable side panels (69) (70) intended to prevent or allow folding of the side walls (5) (6) when they are respectively inserted or released from the retention slots (106) (106') made in the sliding latch lock mechanism (93) located in the central pivoting, anti-fold lock and connecting element of the side panels (71), as illustrated in FIGS. 22 and 24 of the side wall (6) in its assembled state, seen from inside of the container, and the details of FIGS. 23, 25 and 26, where said sliding latch lock (93) is respectively shown in a released and locking position of the foldable side panels (69) (70).

Figures 25, 26:
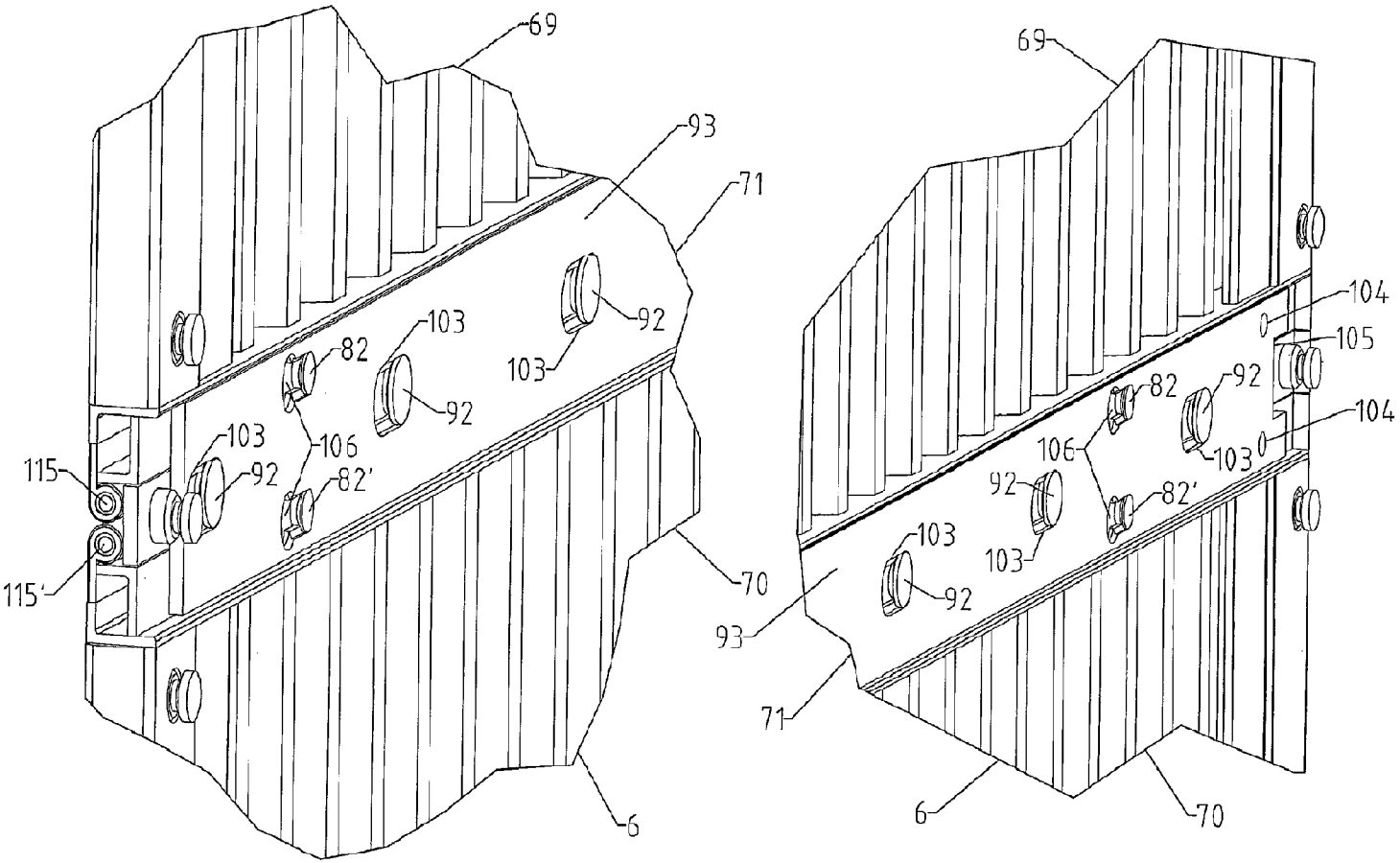
FIGS. 25 and 26—Show a detailed perspective view of FIG. 24 showing the various elements that make up the assembly of the foldable side panels and the central pivoting, anti-fold locking and connecting element of the side panels when the sliding latch lock is in the locked position.
Figure 28:
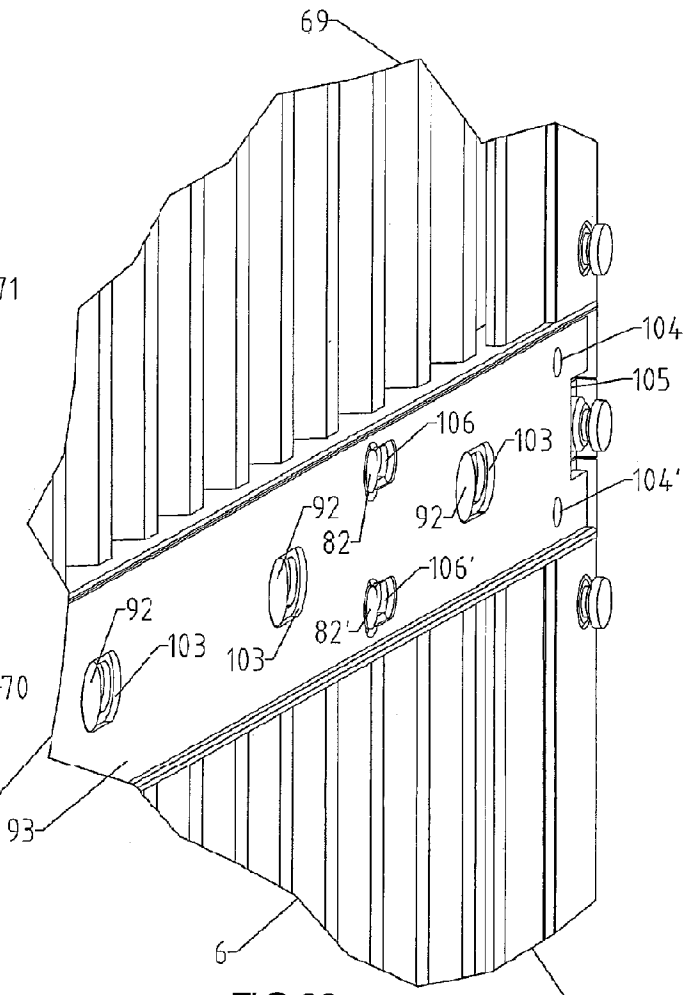
FIGS. 27 and 28—Show a detailed perspective view of FIG. 23 showing the various elements that make up the assembly of the foldable side panels and the central pivoting, anti-fold locking and connecting element of the side panels when the sliding latch lock is in the unlocked position.
Figure 29:
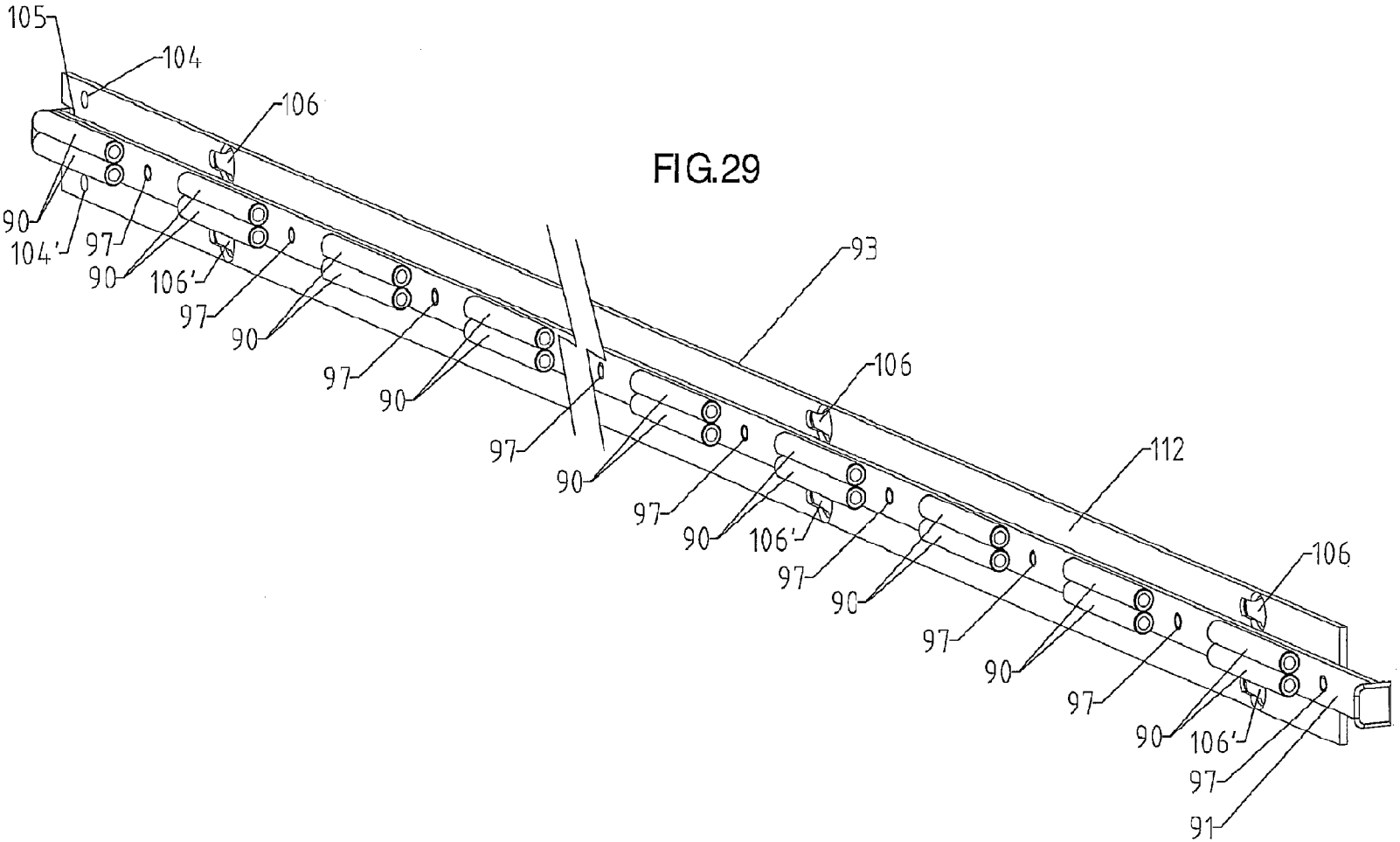
FIG. 29—Shows a perspective view from the outside with the structural details that make up the central pivoting, anti-fold locking and connecting element of the side panels.
Figures 30, 31:
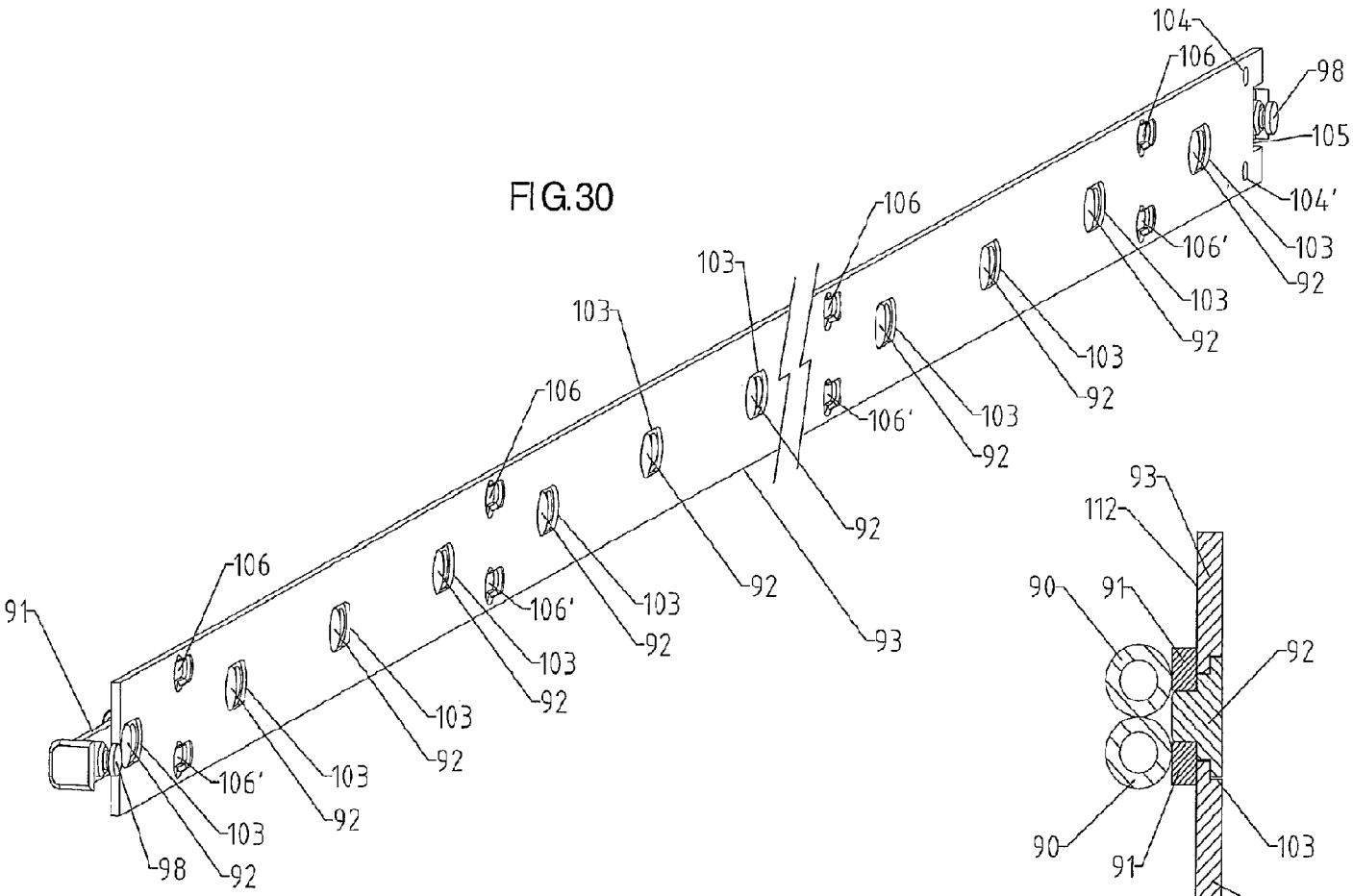
FIG. 30—Shows a perspective view from the inside with the structural details that make up the central pivoting, anti-fold locking and connecting element of the side panels.
FIG. 31—Shows a detailed cross-section view of the central pivoting, anti-fold locking and connecting element of the side panels giving details of how the sliding latch lock mechanism accommodates to the assembly of the central support plate, guided by the sliding guidance bolts.

As can be seen in FIG. 20, on the central rail (73) and near the end of said central rail (73) closest to the rear panel (2) there is a rectangular through-cut or window (86) strategically arranged to coincide, when mounting the side walls (5) (6) and folded side panels (69) (70), with a circular bore (104) (104') made in the sliding latch lock mechanism (93), as illustrated in FIGS. 26, 29 and 30. Said circular bores (104) (104') are accessible from the outside of the side walls (5)(6) through the window generated by the rectangular through-cut (86) made on the central rail (73) with the main purpose of manipulating the slide latch lock mechanism (93) from outside the container during the maneuvers for locking or unlocking the folding of the side walls (5) (6) of the container without having to first access the inside, as said bores (104) (104') function as a handle for moving the sliding latch lock mechanism (93). Additionally, by means of the rectangular through cut (86) is provided a simple and concrete access to an external automatic robotized mechanism, free of human manipulation, for performing the phases of collapsing or uncollapsing the container by an external automatism, that connects to said bore (104) (104').

The outer vertical pillars of the container (75)(75'), as shown for better understanding from various details of the perspective in FIG. 20, are constituted by semi-closed metal structural members with a perimeter shape designed for the purpose of conferring thereof a high resistance to vertical compression which occurs when the uncollapsed and set up container is to be manipulated with cargo inside or receives above it the stacking of one or more similar containers.

Lateral anchor bolts (77) emerge from the inside face of the outer vertical pillars (75) (75'), strategically placed maintaining between each other the distances resulting from multiple cuts (27) made in the side profiles (26) (26') (47) (47') of the rear panel (3) and front panel (2) with access doors. The lateral anchor bolts (77) are basically metallic of cylindrical shape similar to those existing in the central rail (73). The purpose of these lateral anchor bolts (77) is to secure the rear panel (3) and the front panel (2) with doors to the side walls (5) (6) when these are elevated to their vertical position (operation which is also denominated uncollapsing or assembly of the container), the head (80) of said lateral anchor bolts (77) penetrating through the multiple cuts (27) provided in the lateral profiles (26) (26') (47) (47') of the rear panel (3) and front panel (2) with access doors.

Finally, as shown in FIGS. 16 and 18, the inner space generated by the structural framework (28) of the top foldable side panel (69), is filled with corrugated metal sheet (87) joined by welding all around and placed with the direction of its pleats vertically or parallel to the outer vertical pillars (75) (75'), giving the top foldable side panel (69) an hermetical characteristic and further providing extra strength to the assembly against vertical compression and tensile loads.

ii) Bottom Foldable Side Panel

Collapsing the bottom side panel (70) is, as shown in FIGS. 16 and 18, a symmetrical development of the top foldable side panel (69) considering as the plane of symmetry a parallel plane to the bottom face (88) of the central rail (73) of the top foldable side panel (69). Therefore, all that has been described above for the top foldable side panel (69) also defines the bottom foldable side panel (70).

iii) Central Pivoting, Anti-Fold Blocking and Connecting Element of the Side Panels.

The central pivoting, anti-fold and connecting element of the side panels (71) is intended to pivotally join, by means of two hinges (74) (74') (90) (115) (115'), the top foldable side panel (69) and the bottom foldable side panel (70).

As illustrated in FIGS. 17 and 19, the central pivoting, anti-fold lock and connecting element (71) of the side panels comprises a central support plate (91), preferably made of steel, of rectangular geometry and of a length equal to the length of the end (72) and central (73) rails which for part of the foldable side panels (69) (70).

Figure 32:
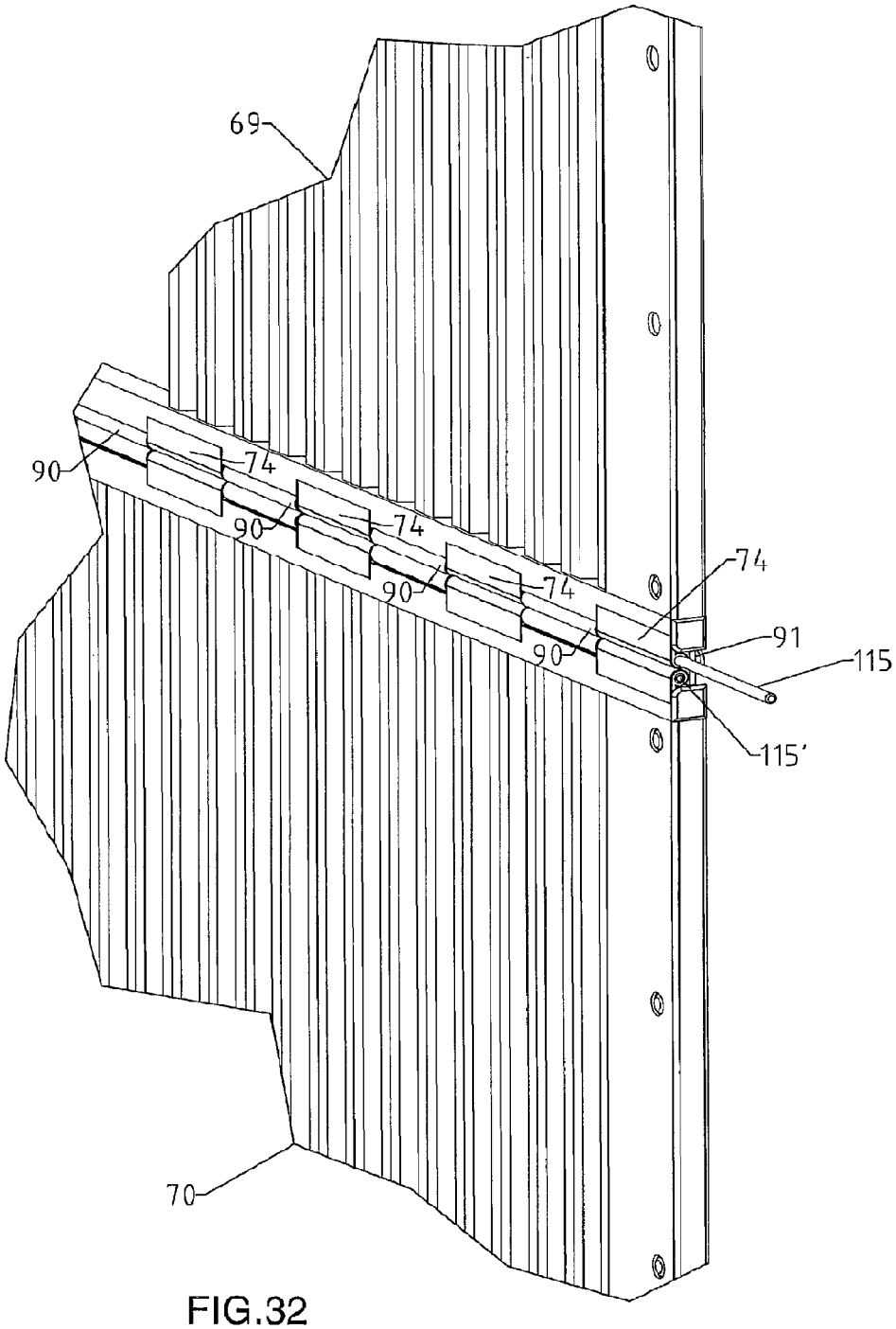
FIG. 32—Shows a detailed perspective view from the outside, illustrating the joint by insertion of the pivoting axis in the hinge of the top foldable side panel with the central pivoting, anti-fold locking and connecting element of the side panels while the hinged joint of the bottom foldable side panel with the central pivoting, anti-fold locking and connecting element of the side panels is already formed.

As illustrated in detail in FIGS. 17, 19 and 32, the hinges are formed by pivot bushings (90) arranged longitudinally adjoined one above the other forming pairs on one of the faces or sides of the plate (91) and, with respect to each foldable side panel (69) (70), by respective pivot bushings (74) (74') arranged in alternated fashion with the respective top and bottom bushings of each pair of pivot bushings (90) of the plate (91), the arrangement being threaded by horizontal pivot axles (115) (115'). The pivot bushings (90) in the central support plate (91) are placed equidistantly and with length equal to the distance of separation between them, sufficient in number to cover the entire length of the central support plate (91) number.

Additionally, the central pivoting, anti-fold and connecting element (71) of the side panels has therein a sliding latch lock type mechanical mechanism (93) which allows or denies the folding of the top and bottom side panels (69) (70).

As illustrated by FIGS. 29 and 30, the sliding latch lock mechanism (93) contained in the central pivoting, anti-fold and connecting element (71) of the foldable panels is fixed by contact to the central support plate (91) and with a longitudinal movement of the movable parts it acts in a perpendicular direction to said movement to lock or release the pivoting of the top and bottom foldable side panels (69) (70).

On the same side of the central support plate (91) where the pairs of pivot bushings (90) are placed and in the midpoint distant from each of the pairs of aligned bushings are positioned point, there are corresponding through holes (97) that, serving as centering elements, house on the opposite side respective sliding guidance bolts (92). These sliding guidance bolts (92) have the purpose of securing by contact the sliding latch mechanism (93) to the central support plate (91) while allowing longitudinal sliding of the sliding latch lock mechanism (93), with a limited stroke, on the central support plate (91). To this effect the sliding guidance bolts (92) are inserted into through-slots made along the central axis (E1) of the sliding latch lock mechanism (93), hereinafter named bolt guides (103) so, as can be seen in FIGS. 29 and 30, and more clearly in the cross-section view of FIG. 31 depicting a metal profile segment of the central pivoting, anti-fold lock and connecting element (71) of the folding panels, the sliding latch lock (93) is arranged with its inner face (112) in contact with the inner side of the central support plate (91), allowing the longitudinal sliding with limited stroke of the sliding latch mechanism (93) through the bolt guides (103).

To achieve this effect, the sliding guidance bolts (92) and the bolt guides (103) are shaped to complement each other, which according to the preferred embodiment of the invention herein detailed respectively are of semicircular cylindrical shape and elongated semicircular shape in the ends. Moreover, the bolt guides (103) have a distance between their primary centers equal to the distance set between the through-holes (97) performed on the central support plate (91) from which emerge the sliding guidance bolts (92).

As shown in FIG. 30, close to the ends of the central support plate (91) and on the same side where the sliding guidance bolts (92) emerge, cylindrical lateral anchor bolts (98) also emerge from the support plate (91) which are strategically located in vertically aligned manner with lateral anchor bolts (77) contained in the top and bottom foldable side panels (69) (70) in the assembled container. The function of these cylindrical lateral anchor bolts (98) is identical to that of the previously explained lateral anchor bolts (77) of the folding panels, complementing the affixing of the rear panel (3) and the front panel (2) with doors of the container to the side walls (5) (6) when these are raised to their vertical position.

As shown in FIGS. 26, 29 and 30, the two circular through-bores (104) (104') are disposed at one end of the sliding latch lock mechanism (93), these bores, as previously described, are used as an access point from the outside the container through the rectangular through-cut (86) made in the top and bottom foldable side panels (69) (70) of the side walls (5) (6) for the maneuver of sliding the sliding latch lock mechanism (93).

Figure 27:
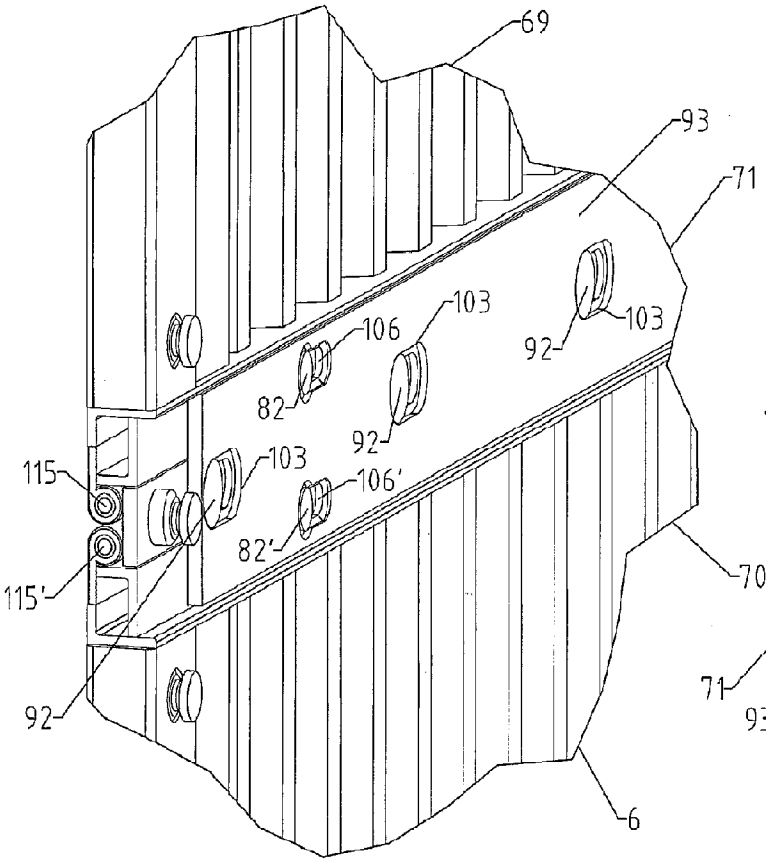

Continuing with the description of the central pivoting, anti-fold lock and connecting element (71) and in order to perform the maneuver of longitudinal displacement of the sliding latch lock mechanism (93), causing the respective release or locking of the heads of the lateral anti-fold bolts (82) located on the inner sides of the central rail (73) (73') of the top and bottom foldable side panels (69) (70), retaining grooves (106) are provided in pairs and longitudinally in the sliding latch lock mechanism (93), the anti-fold lateral bolts (82) being retained or released by the particular geometry obtained when machining of the retaining grooves (106). Such retention slots (106) have at one end of their travel stroke a space of a diameter which is smaller and adjusted to the diameter of the head of the anti-fold lateral bolts (82), allowing to block the extraction of these and therefore the folding of the foldable side panels (69) (70) and, at the opposite end their travel stroke, the retention slots (106) have an area with a diameter greater than the diameter of the head of the anti-fold lateral bolts (82), creating a zone of release thereof, which allows their extraction and subsequent folding of foldable side panels (69) (70). The retention slots (106) are strategically located so as to be coincident with the position of the anti-fold lateral bolts (82) located along the inner sides of the central rail (73) (73') of the respective top and bottom foldable side panel (69) (70) of the side walls (5) (6). The function of the locking and release of the assembly formed by the anti-fold lateral bolts (82) and the machining of the retention slot (106) can clearly be seen in FIGS. 25 and 27.

Continuing with FIG. 30, a rectangular cut (105) is made at the same end of the sliding latch loch mechanism (93) where the circular bores (104) (104') have been made, to solve a contact problem of the sliding latch mechanism (93) with the lateral cylindrical anchor bolt (98).

Roof

The element called roof (4) of the container is formed by a set of metal parts joined together by welding, bolts or movable elements secured to one another, which in the end provide it with a unique and consolidated structure.

Like the floor (1), the roof (4) consists mainly of a rectangular structural frame or perimeter (16) of width and length limits equal to the limits defined by floor (1) of the container, with these measures adapted to the ISO standards for shipping containers, some internal transverse members (121) to give greater rigidity to the structural frame (16) and, finally, panels (122) in the form of metal sheet which, as shown in FIG. 1, cover the entire inner surface of the rectangle that forms the structural framework.

Figures 33, 34, 35:
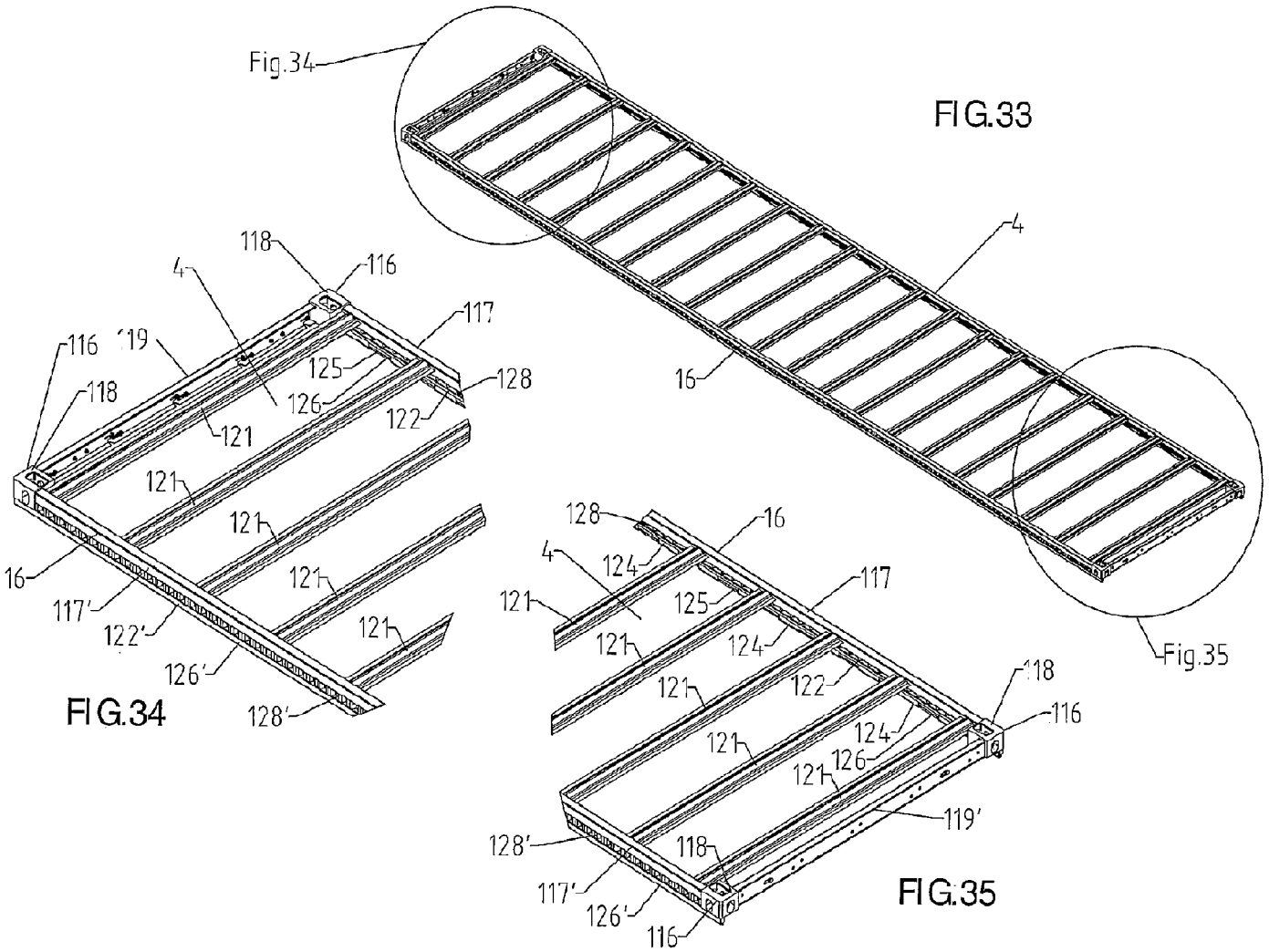
FIG. 33—Shows a perspective view of the structural element defined as the roof of the container, in which the top closure panels have been withdrawn to contemplate its structure clearly.
FIGS. 34 and 35—Show a perspective view of details of the structural elements of FIG. 33.

In FIG. 33 and its various views in detail (FIGS. 34 and 35) a preferred embodiment of the roof (4) of the container is shown without cover panels or sheets (122) for a better visualization of its structure and internal elements. The rectangular structural frame or perimeter of the roof (16) is, on its vertices, defined by the top corner anchorage fittings (116), of a size and shape similar to those commonly used in ISO containers for maritime use (ISO 1161 and ISO 668-1995); on the long sides of the rectangle, defined by square metal profiles denominated roof outer longitudinal profiles (117) (117'), which are aligned, slightly below the plane or level that forms the top face (118) of the top corner anchorage fittings (116); and on the short sides of the rectangle defined by respective beams preferably made with C-shaped metal profile, denominated outer front (119) and rear (119') transverse beams with the interior of the C shape facing the inside of the perimeter which forms the rectangular shape of the roof (4).

As already mentioned, transverse structural roof stringers (121) are provided equally spaced, in sufficient quantity and transversely to the inner faces of the outer longitudinal profiles (117) (117') of the roof to give greater structural rigidity to the perimeter assembly (16), the cover panels or sheet (122) being supported and attached by bolts on them and located above said transverse structural roof stringers (121) (121).

Figure 36:
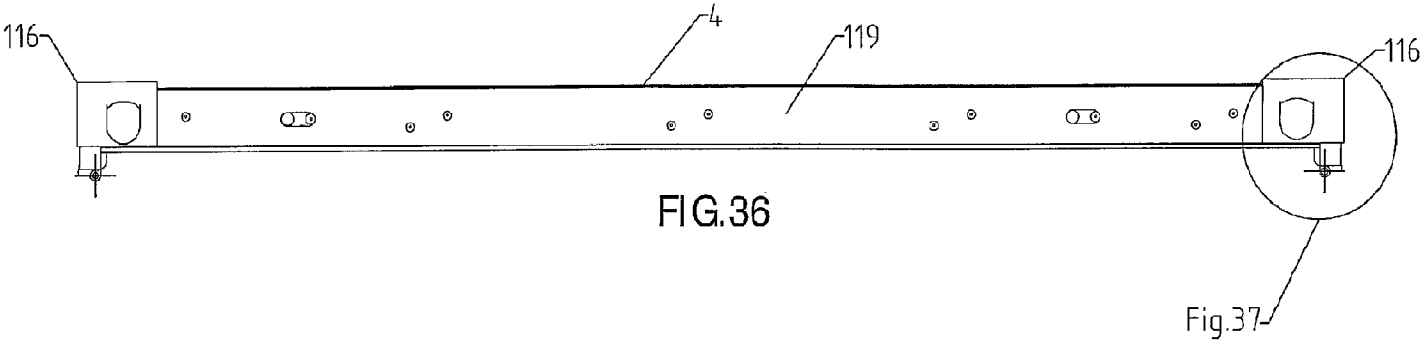
FIGS. 36 and 37—Show an elevation view of the roof of the container and details of a corner showing the position of the pivot bushings of part of the hinged joint with the side walls and is adjacent support elements.
Figure 37:
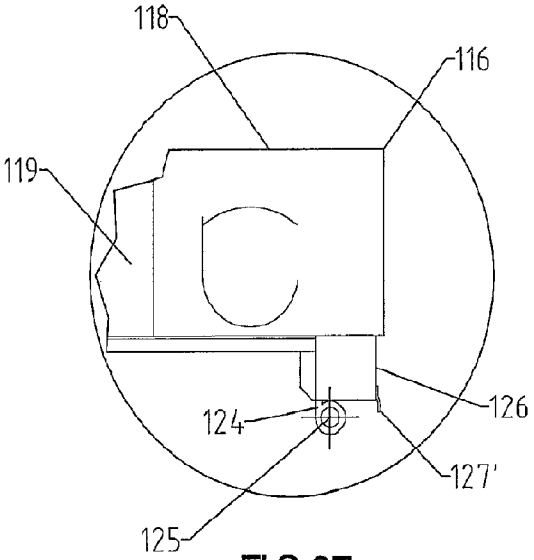

Additionally, as shown in FIGS. 36 and 37, some square metal structural profiles (126) (126') are welded to the underside of the top corner anchorage fittings (116) and are externally and longitudinally aligned below the outer longitudinal profiles of the roof (117) (117') which form the basic roof rectangle (4). These square metal structural profiles (126) (126') have machining (not shown) on its surface to provide support for the hinged joint of the roof (4) with the side panels (5, 6) so as to fit and join by welding the bodies of the pivot bushings (124) of the other part or half of the pivoting or hinged jointing of the side walls (5) (6) to the roof (4). These elements (124) are identical to those previously used (74) (74') to make the bushings of the hinges of the top and bottom foldable side panels (69) (70) with the central pivoting, anti-fold locking and connecting element (71) of the foldable panels. The pivot bushings (124) are alternately disposed in line with corresponding metal pivot bushings (81) of the top foldable side panel (69) of each side of the container and aligned and threaded through an axle (125) (125') of equal diameter to the internal diameter of said pivot bushings.

As shown in FIG. 37, on the outer face of the square metal structural profiles (126) (126'), in its entire length and as a cantilever beam element protruding toward the bottom face or plane of the roof (4), there is provided joined by welding a thin metal sheet (127) (127'), preferably made with a slight fold outwards with an S shape and similar to a slight inflection carried along the same, that functions as a closure gasket or seal to the outside. This roof side closure sheet (127) (127') performs its function when, once assembled the entire container and unfolded the side walls (5) (6), contact is established throughout the length of the inner protruding face of this element (127) (127') with the outer face of the extreme rail (72) of the top foldable side panels (69), thus closing the space generated by the tolerances of the hinged joint or distance between the position of said extreme rail (72) and the square metal structural profile (126) (126').

Finally, as shown in FIGS. 34 and 35 with reference to the structural elements of the roof, the space between the outer longitudinal profiles of the roof (117) (117') and the square metal structural profile (126) (126') is filled throughout its length with corrugated metal sheet (128) (128') welded at its peripheral contour, so that the direction of the corrugated pleats of the metal sheet are perpendicular to the faces of the profiles (117) (126) (117') (126') to which it joins, giving both groups of profiles (117) (126) (117') (126') an extra deformation or bending resistance of the same. Additionally, the corrugated sheet (128) (128') closes access from the outside to the contents of the container through said space it seals.

As illustrated in FIGS. 38, 39, 40 and 41, inside the outer transverse beams (119) (119'), the latch and anti-fold lock mechanism of the roof (4) with the front panel (2) with door and rear (3) panel.

Figure 38:
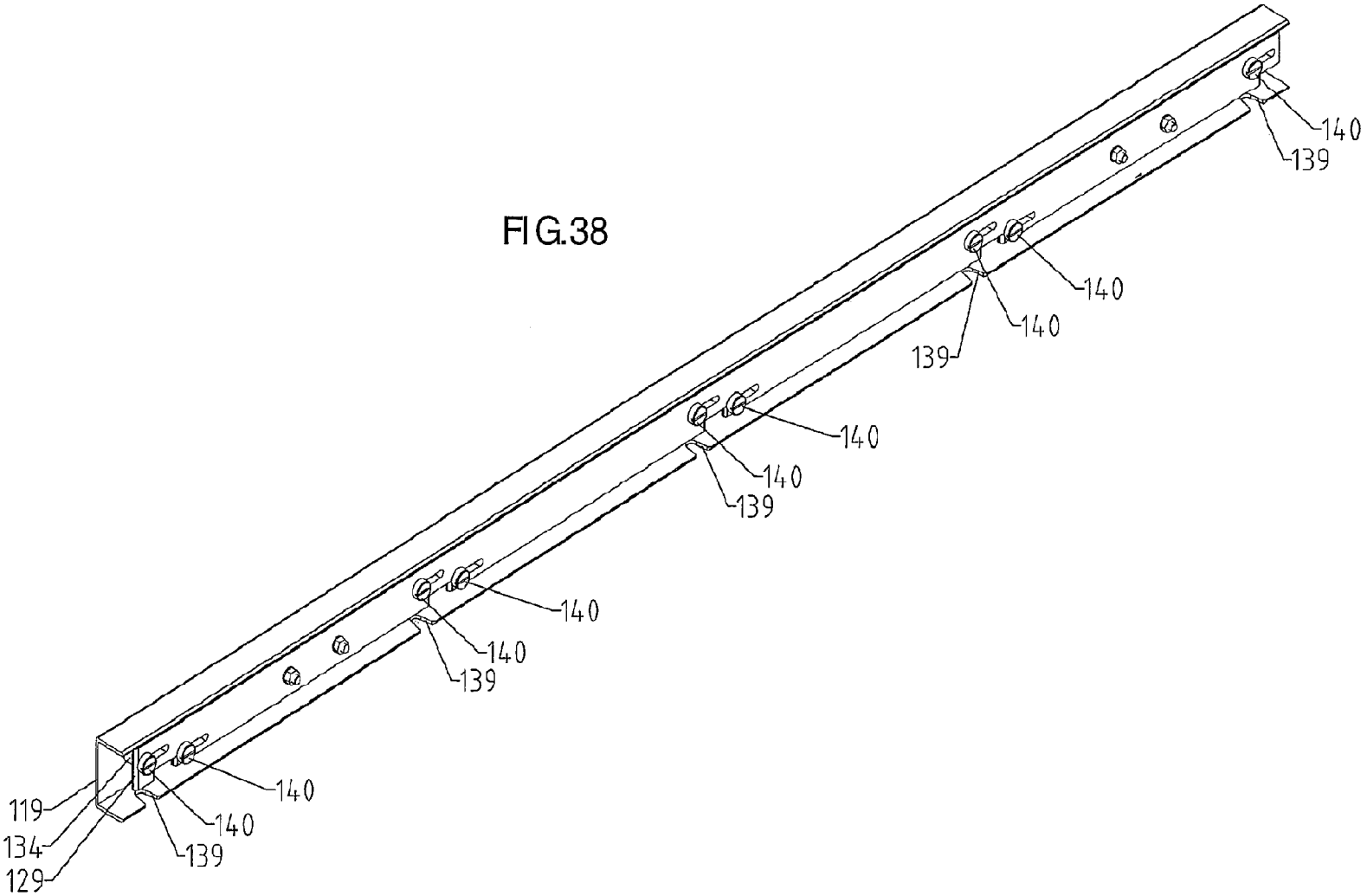
FIG. 38—Shows a perspective view and details of the inside of the latch and anti-fold locking mechanism of that is installed inside the outer transverse beams of the roof.

As illustrated in FIG. 38, the latch and anti-fold lock mechanism of the roof (4) is characterized by having a sliding plate (129) which has some machining or strategically placed cuts at its bottom edge, so that it allows the passage therethrough of the heads (39) of the cylindrical pins (36) installed on top structural members (46) (35) of the front panels (2) with doors and rear panel (3). As shown in FIG. 38, the sliding plate (129) is fixed to the inside of the outer transverse beam (119) (119') by tightening bolts (140) and spaced from said outer cross beam (119) (119') by means of cylindrical spacers (134) in which the tightening bolts (140) are housed with a maximum thread depth sufficient to support the sliding plate (129) but without retain it or locking it. The through joint of the tightening bolts (140) with the sliding plate (129) has a rectangular shaped machined slots longitudinally aligned with the sliding plate (129) in order to allow movement of the sliding plate (129) while limiting it at the distance allowed by the length of said slots.

Figure 41:
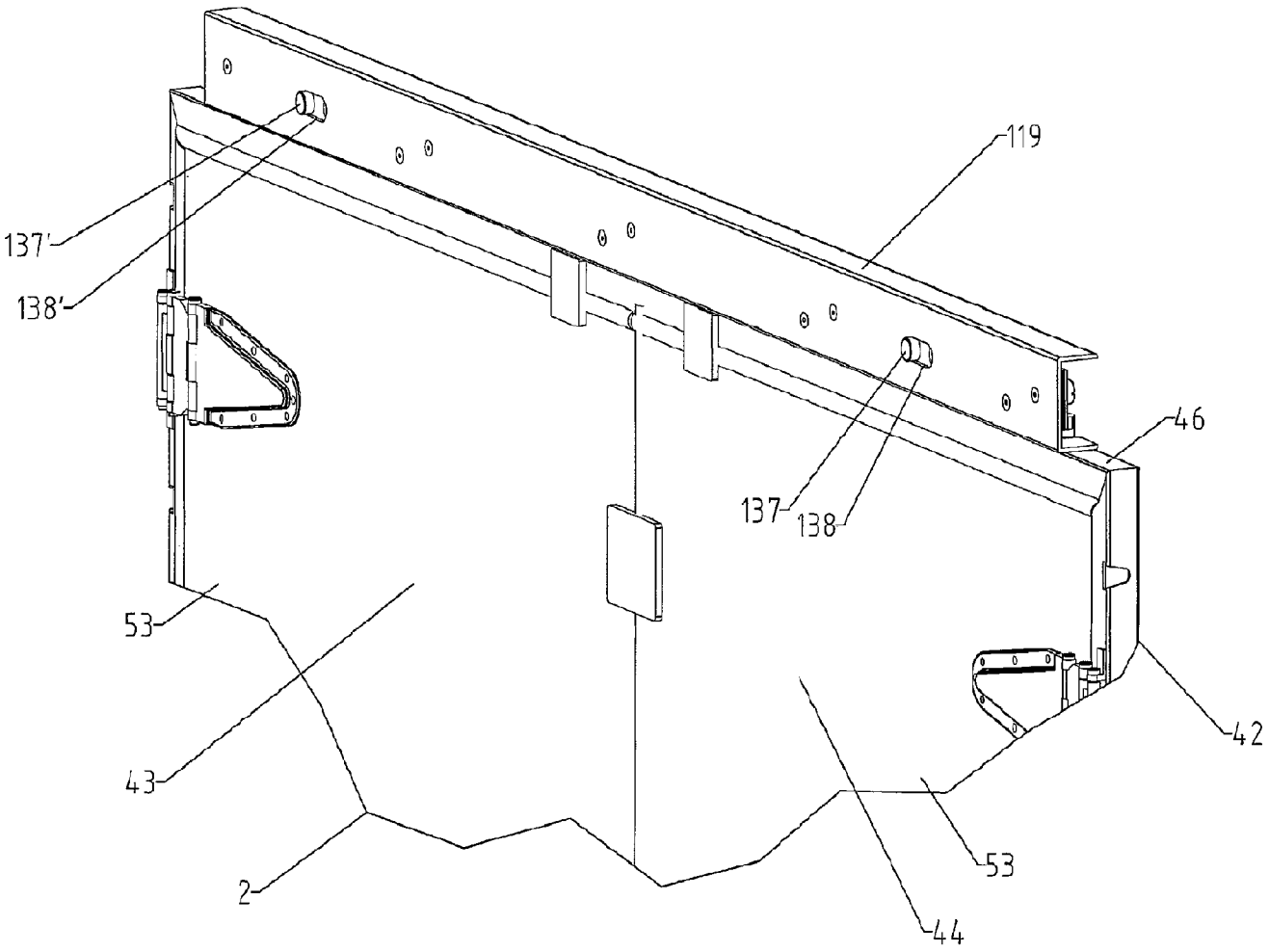

As shown in FIG. 41, to perform the sliding function of the sliding plate (129) from outside of the collapsible container and through the outer transverse beams (119) (119') in both directions, rectangular longitudinal cuts (138) 138) are provided on the outer face thereof, through which the handling pins (137) (137') emerge, these pins being cylindrical parts that project from the plane of the outer transverse beams (119) (119') and are integral with the sliding plate (129).

Figure 40:
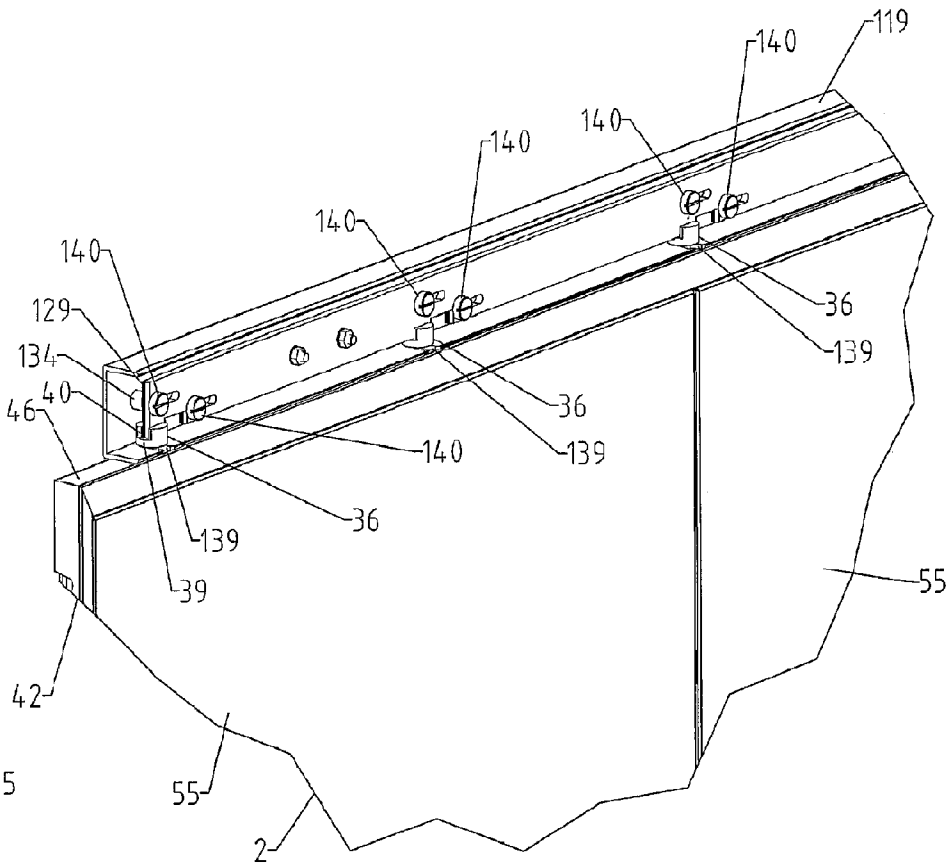
FIGS. 40 and 41—Show views oriented to showing from the inside the mechanical detail of the coupling of the front panel with doors when fully vertical and flush with the outer transverse roof beam which contains the latch and anti-fold locking mechanism and the latter is in the locking position.
Figure 39:
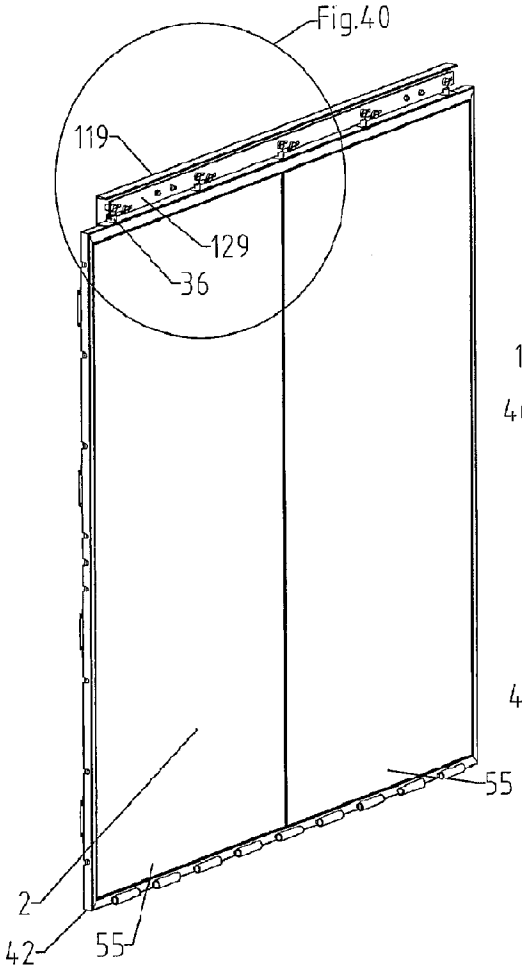
FIG. 39—Shows a view oriented to showing from the outside the mechanical detail of the coupling of the front panel with doors when fully vertical and flush with the outer transverse roof beam which contains the latch and anti-fold locking mechanism.

As seen in FIGS. 40 and 41, the sliding towards the locked position of the sliding plate (129), causes the insertion, as male element, of the same in the grooves (40) made on the cylindrical pins (36) of the front (2) and rear (3) panels, blocking their heads (39) and preventing the removal, pivoting and folding of the front panels (2) with doors and the rear panel (3).

As shown in FIG. 40, the perfect alignment of the sliding plate (129) with slots (40) of the cylindrical pins (36) is achieved thanks to the combination of the height of the spacers (134) with the receiving slots (139) made in the outer transverse beams (119) (119') for the necks (41) of the cylindrical pins (36), further being the thickness of the sliding plate (129) the same as the hollow made in the machining of the slots (40) of the cylindrical pins (36) for receiving with sufficient clearance the sliding plate (129) therethrough.

Operating on the handling pins (137) (137') in the opposite direction, the release of the heads (39) of the cylindrical pins (36) occurs, leaving the heads (39) facing the machining or cuts made in the bottom edge of the sliding plate (129), thus allowing removal, pivoting and folding of the panels (2) (3).

Method of Collapsing

Figure 42:
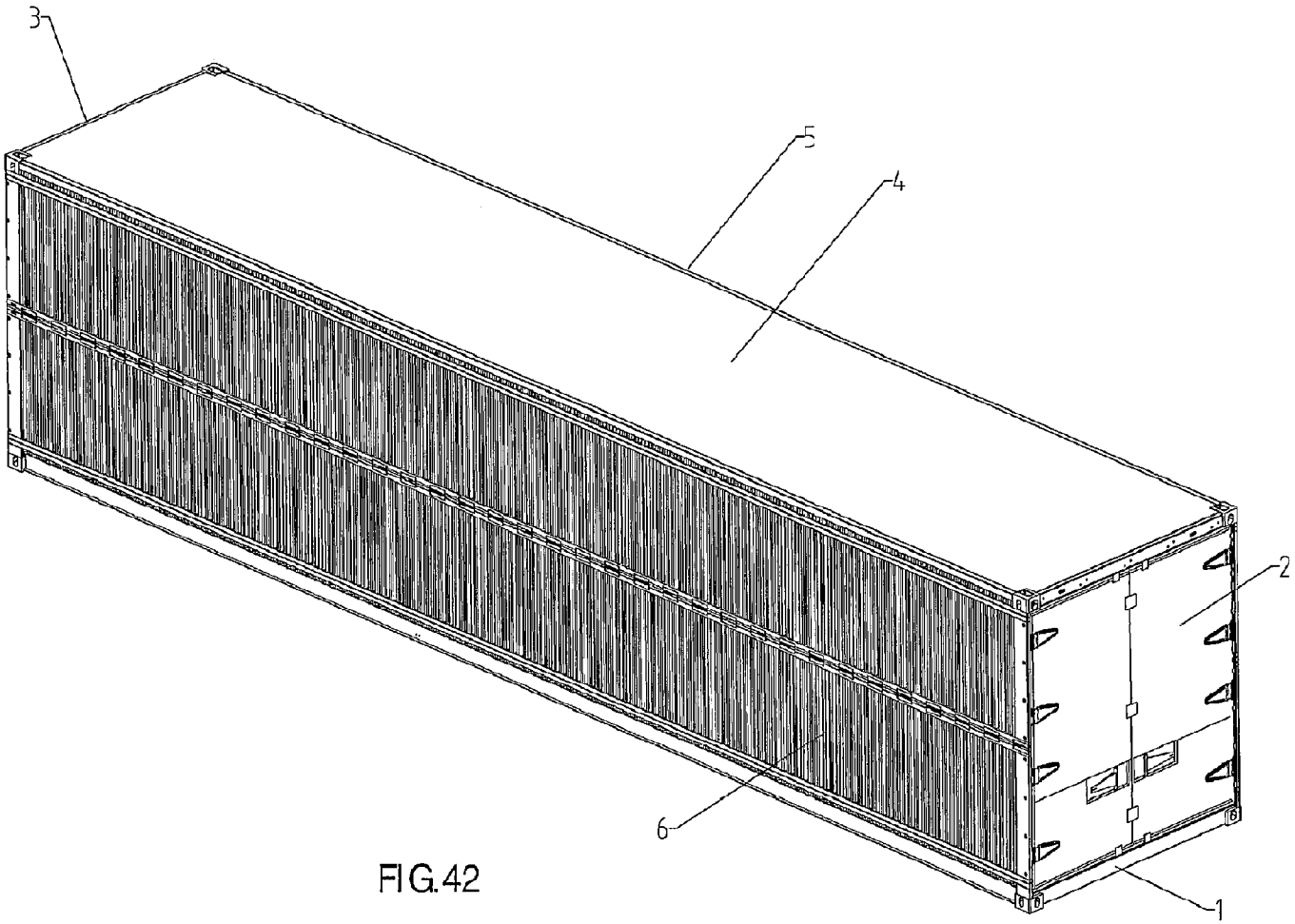
FIG. 42—Shows a perspective view of a collapsible container according to the invention when fully uncollapsed or assembled with its doors closed.
Figure 43:
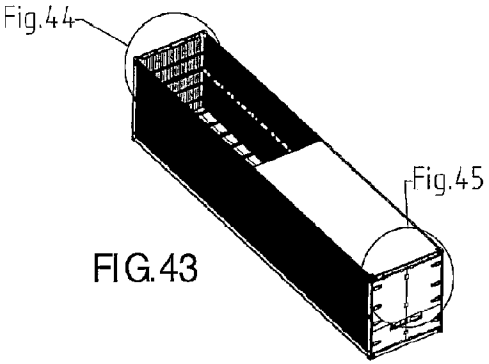
FIGS. 43, 44 and 45—Show a group of perspective views and details of a fully finished and uncollapsed or assembled collapsible container with its doors closed, in which some top roof panels have been removed to have access to an inner view and in which all the anti-fold latch locks are in their closed, or locked position.
Figure 44:
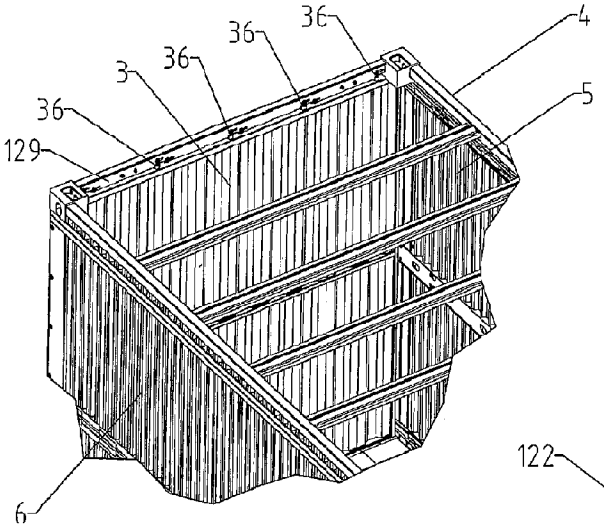
Figure 45:
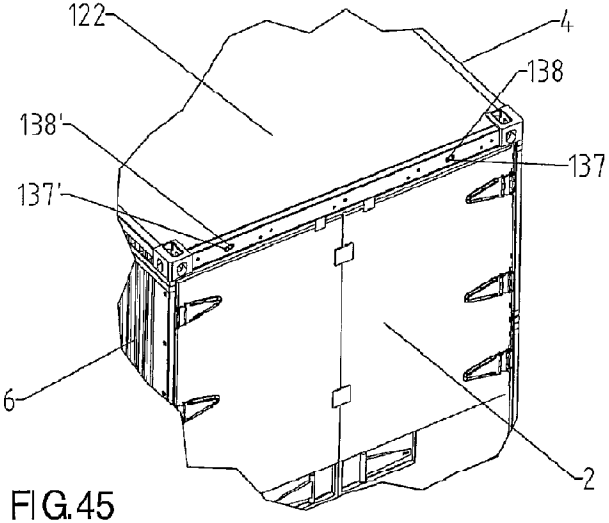

In FIG. 42, a fully assembled collapsible container is shown in its uncollapsed position, with the doors of the front panel (2) closed and with both the latch and anti-fold locking mechanism of the roof (4) with the rear (3) and front (2) panels and the slide lock mechanism (93) of the central pivoting, anti-fold locking and connecting element (71) of the side walls (5) (6) in the locked position, as is clearly shown in FIGS. 43, 44 and 45, where a cover panel or sheet (122) has been omitted from the roof (4) in order to clearly observe the rear panel (3) and the maneuvers performed on it.

In this condition it can be observed in FIG. 45 how the handling pins (137) (137') of the latch and anti-fold blocking mechanism that is installed inside of the front outer transverse beam (119) of the roof (4) emerge through the slots (138) (138') made for that purpose in said beam (119), said handling pins (137) (137') being integral with the sliding plate (129) of said mechanism.

As can be seen in the detail of FIGS. 40 and 41 and the detail of FIG. 44, said latch and anti-fold locking mechanism located within the beams (119) of the roof, keeps the sliding plate (129) laterally displaced in its locking position which as a male element is inserted into the slots (40) made as a female element in the heads (39) of the cylindrical pins (36) of the top profiles of the rear panel (3) and front panel (2) with doors. Further, the cuts or recesses (139) made on the outer front transverse beam (119) are facing the position of the cylindrical pins (36), such that through them, the necks (38) of the cylindrical pins (36) are locked in the outer transverse beam (119).

Following the procedure of this preferred embodiment of the invention for collapsing the container, first the latch and anti-fold locking mechanism of the roof with the front panel (2) and rear panel (3) is unlocked, by displacing to the opposite side (of its blocking position), the handling pins (137) (137') of the latch lock located on the outside of the outer transverse beams (119) (119'), both of the front panel (2) as the rear panel (3).

With this movement performed on the handling pins (137) (137'), the internal mechanism of the outer transverse beams (119) (119') located on the roof (4) and over the rear panel (3) and front panel (2) displaces the slide plate (129) from its inserted position in the heads (39) of the cylindrical pins (36) and thus releases the rear (3) and front (2) panels from their anchorage in the outer transverse beams (119) (119') of the roof (4), allowing their pivoting and subsequent folding.

Figure 46:
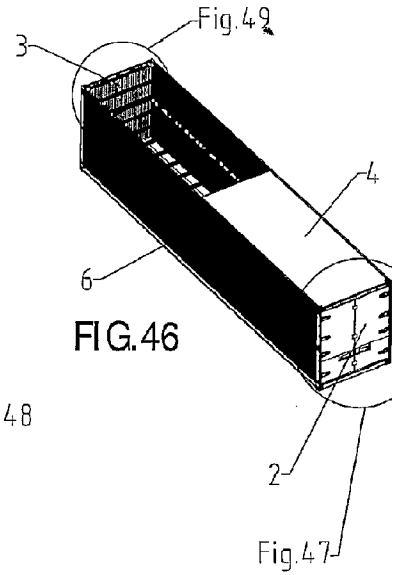
FIGS. 46, 47, 48 and 49—Show a group of perspective views and details of a fully finished collapsible container with its doors closed, in which some top roof panels have been removed to have access to an inner view and in which its rear and front panels (as indicated by the arrow) have begun to fold in, enabling to appreciate the details of the unlocked position of the latch and anti-fold locking mechanism of the front panel with the roof and the release of lateral anchors of the front panel with the side walls.
Figure 47:
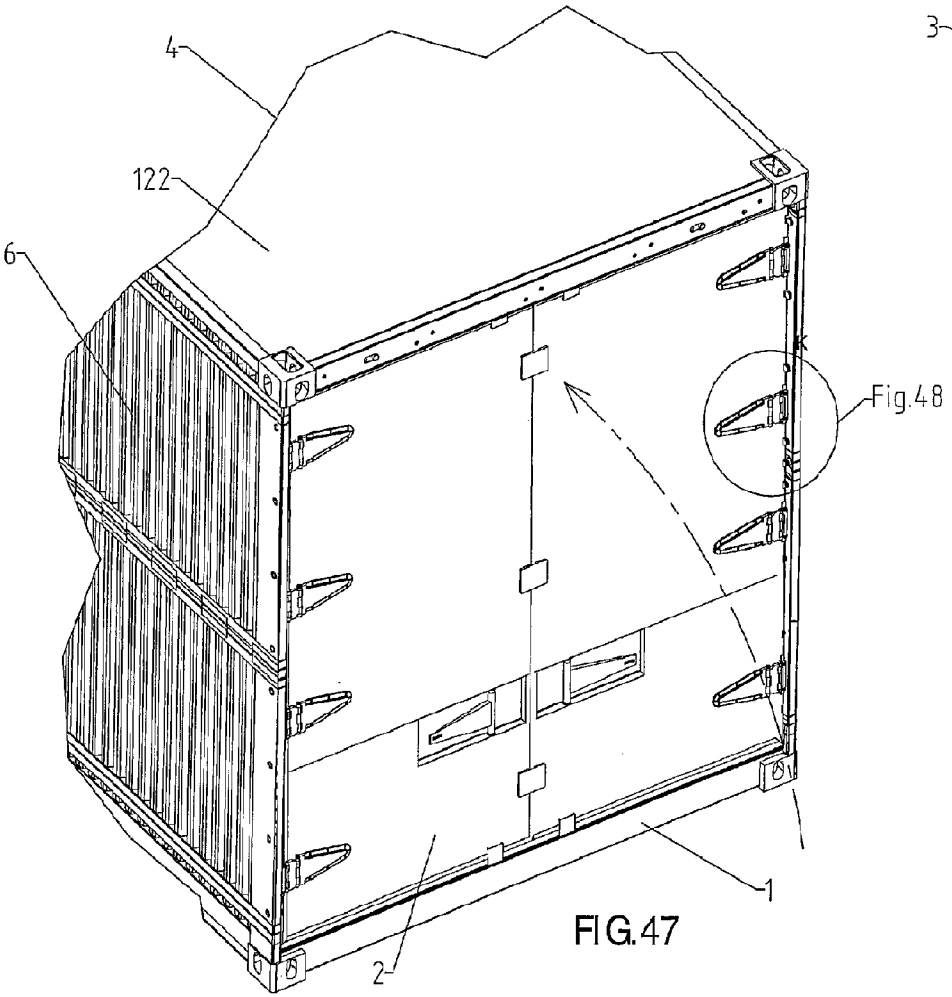
Figure 49:
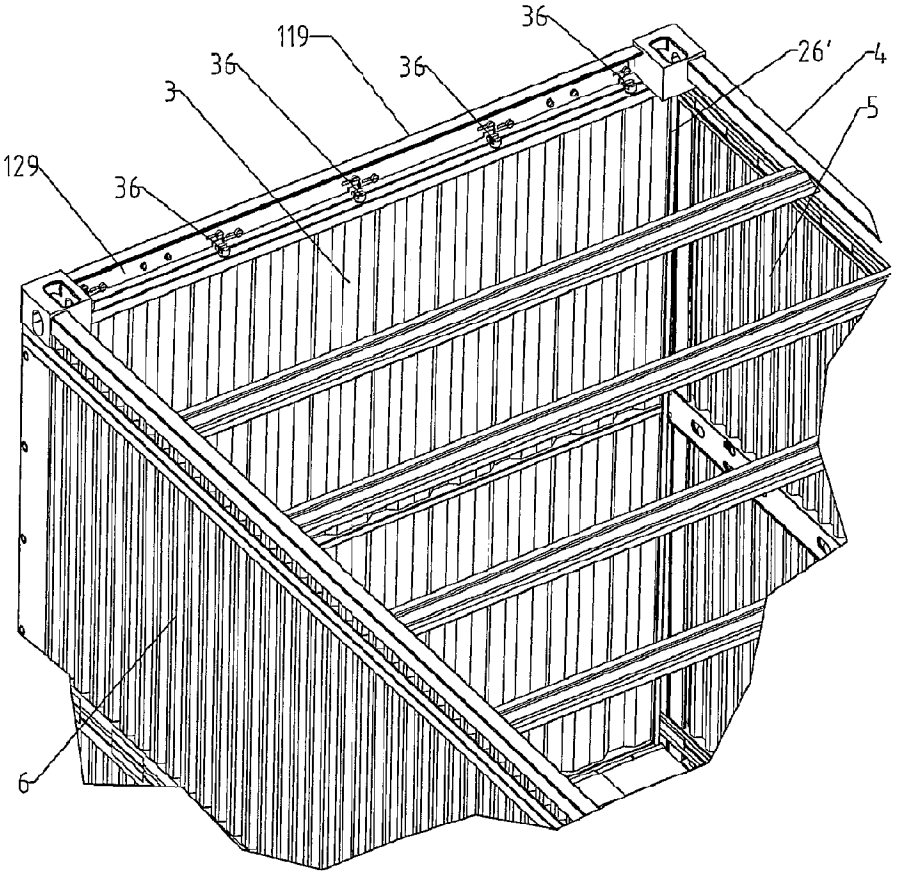
Figure 48:
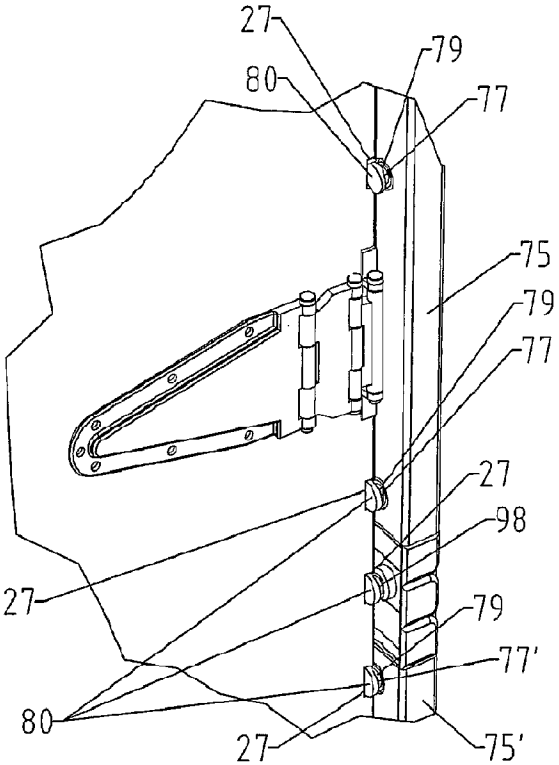

In a next step of this procedure for collapsing the container, as is shown in FIGS. 46, 47 and 49, and in the detail of FIG. 48, normally some type of external element not described in this presentation is used to push from the outside and perpendicularly the rear (3) and front (2) panels towards the inside of the container, preferably holding them with some kind of external tension member, clip or flange, so that their fall or folding to the inside takes place by gravity but in a controlled manner. Said external element is associated with the need for automatic robotic collapsing of the container. In these FIGS. 46, 47 and 49, the position of these panels (3) (2) can be seen in the beginning of their rotating path in the folding process.

In the uncollapsed or assembled state of the container, the lateral anchor bolts (77) (77') (98) are located vertically aligned on the inner face of the outer vertical pillars (75) (75') of the side walls (5) (6) and with their heads (80) fitted and locked in the interior of the lateral profiles (26) (26') (47) (47') of the respective frame and subframe of the rear (3) and front (2) panels, through the cuts (27) such that, as male and female elements, they block and secure the joining of the rear (3) and front (2) panels with the side walls (5) (6). However, as seen in FIG. 48, in the collapsing of the container, when the front (2) and rear (3) panels begin to rotate and fold, said lateral anchor bolts (77) (77') (98) start to get out of the cuts (27) as said cuts (27) are exactly oriented with their outside towards the opposite side of the movement performed by the panels (2) (3) in their movement around the bottom hinge. Furthermore, the dimension of the slots that said cuts (27) form in the front outer face of the profiles match the diameter size and height of the heads (80) of the lateral anchor bolts (77) (77') (98) and the cut by external side of the profiles have a shape adapted to match the diameter and wall size of the neck (79) of said bolts.

Figure 50:
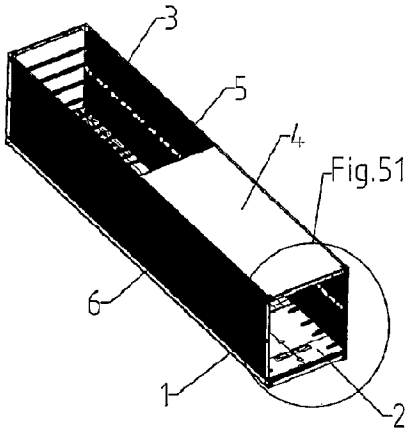
FIGS. 50 and 51—Show perspective views and details of the collapsible container of the invention with its doors closed, in which some top roof panels have been removed to have access to an inner view and in which its rear and front panels are fully folded over the floor.
Figure 51:
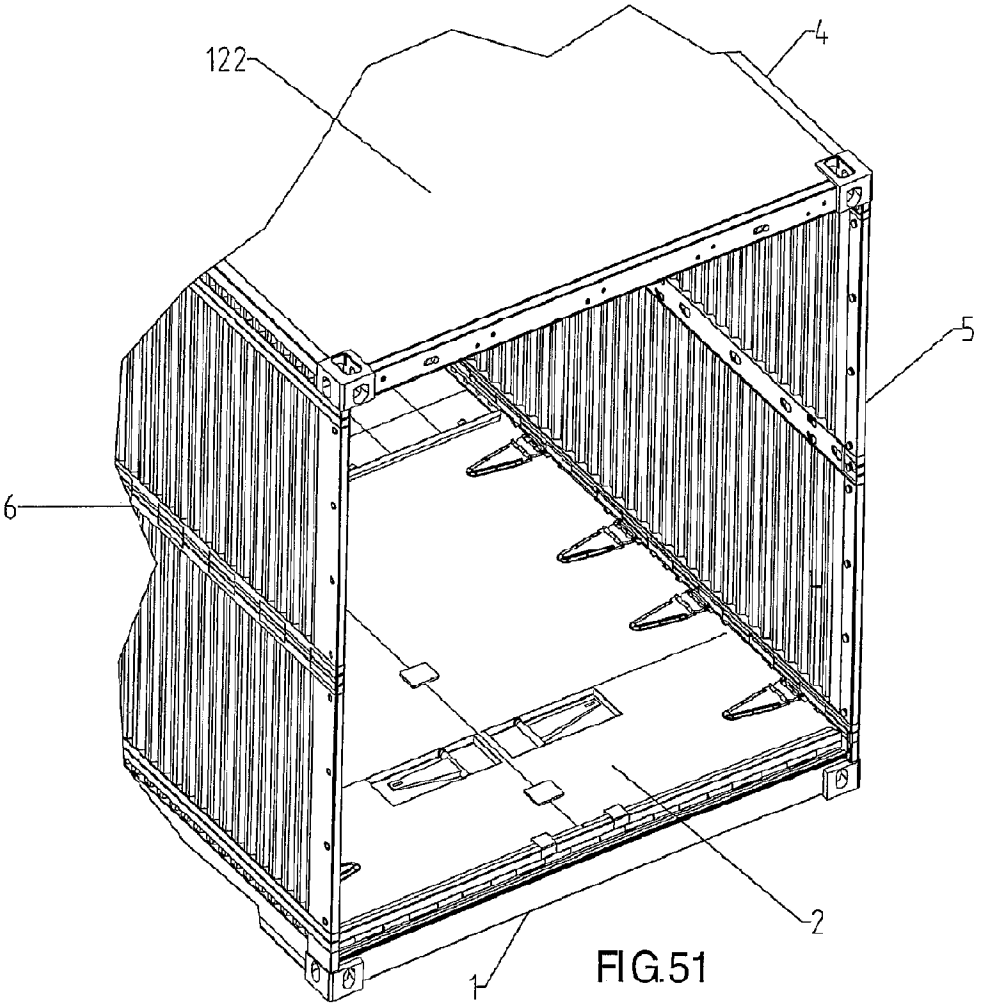

Because the pivoting movement of the panels (2) (3) is a turn or rotation around the pivot axle (22) of the hinged joint connecting these panels to the floor (1), as the rotation movement of the folding advances the lateral anchor bolts (77) (77') (98), which are vertically aligned, will emerge and gradually release from their receiving cuts (27), all of them being released when the panels (2) (3) have completed their path and are in the horizontal position resting on the longitudinal floor boards (11), as shown in the views provided by FIGS. 50 and 51. In this position the outer faces of the rear (3) and front (2) panels are left oriented and facing parallel with the inside of the roof (4) of the collapsible container disclosed in this invention.

In the next stage of the process used for collapsing the container, the sliding latch mechanism located on the side walls (5) (6) is released in order to allow the folding of these walls (5) (6). For this, actuation takes place from the outside by accessing the circular bores (104) (104') arranged for this maneuver and located on the sliding latch mechanism (93), accessible from the outside through the rectangular through-cuts (86) (86') made on the exterior of the side walls (5) (6). By doing this said circular bores (104) (104') travel longitudinally along their rectangular accessibility through-cut (86) (86') and therefore the sliding latch lock mechanism (93) moves integrally therewith. The multiple lateral anti-fold bolts (82) (82') are then simultaneously released from their multiple retaining machining (106) (106'), thereby allowing rotation of the two hinges contained in the central pivoting, anti-fold blocking and connecting element (71) of the folding panels. The functionality of this mechanism can be observed in detail in FIGS. 25, 26, 27 and 28, both for the locking and unlocking phases of the sliding latch.

Figure 52:
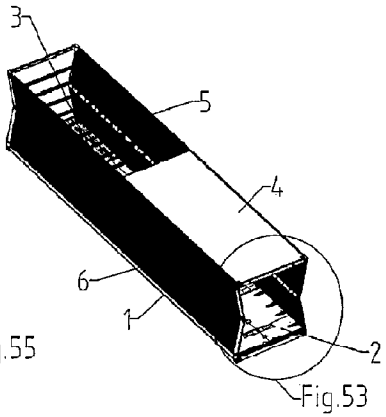
FIGS. 52, 53, 54, 55 and 56—Show a group of descriptive views when the folding process of the side walls of the collapsible container of the invention begins, with general details of the rotation of hinged joints and front elevation view with acquired, position.
Figure 53:
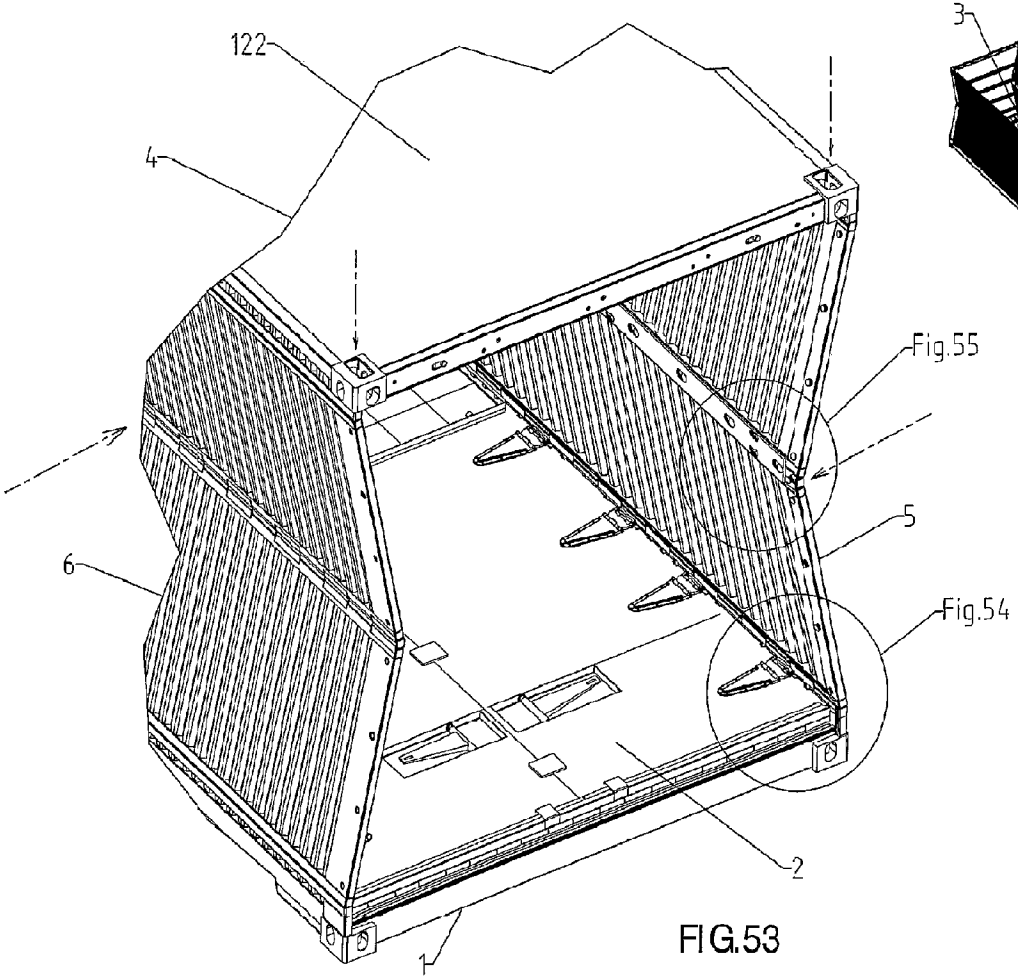
Figure 54:
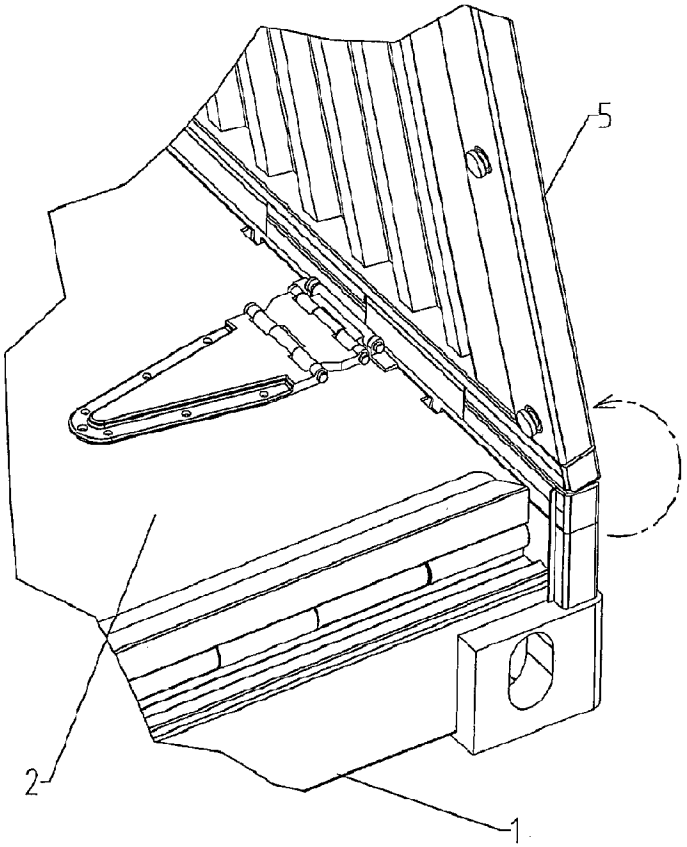
Figure 55:
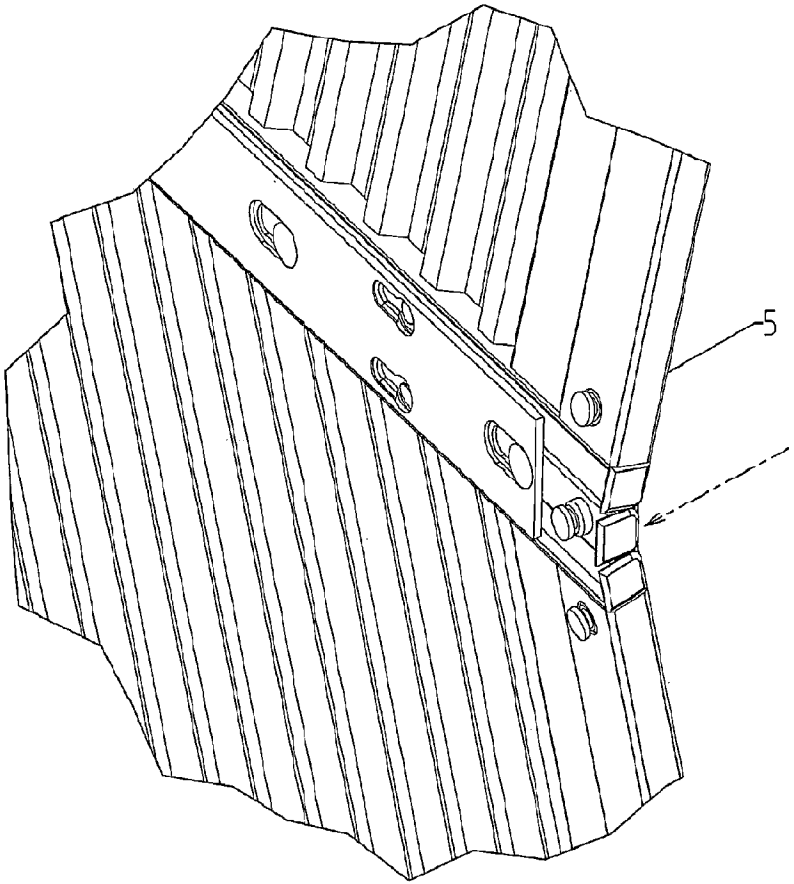
Figure 56:
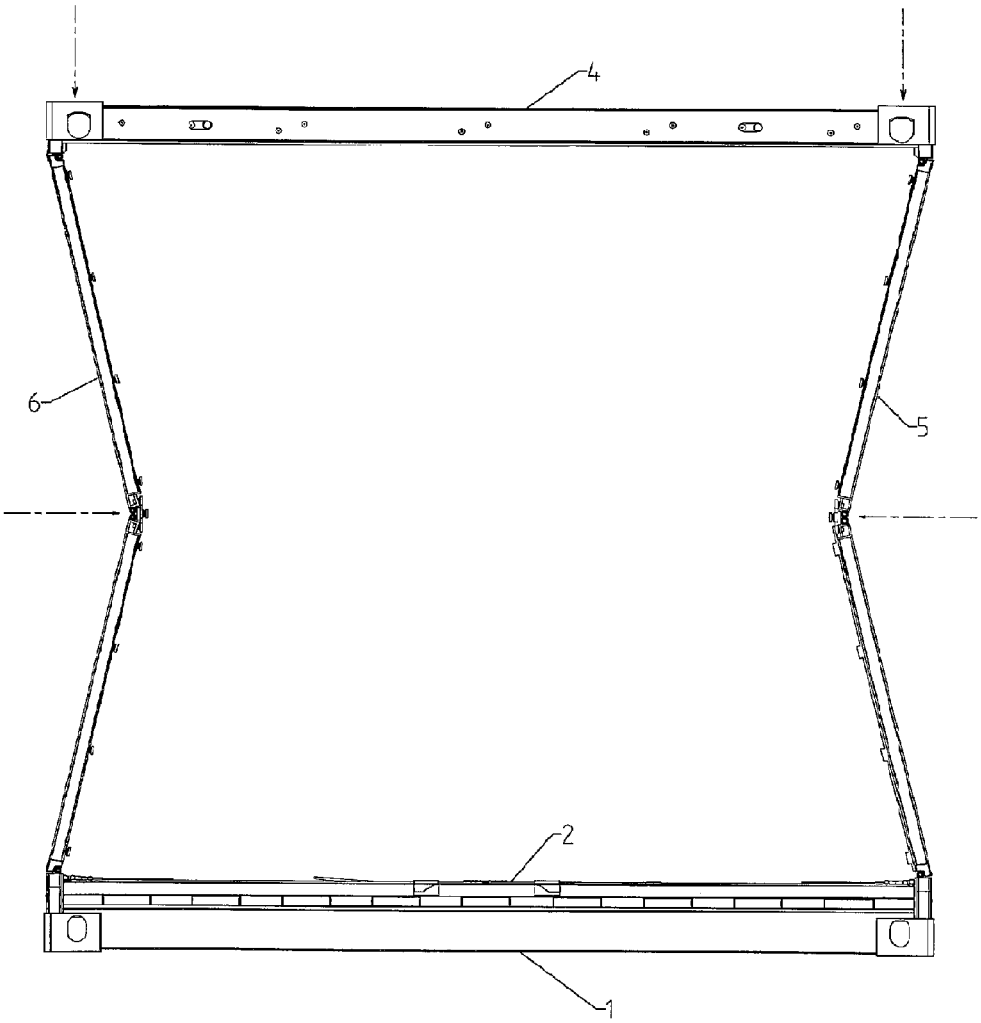
Figure 57:
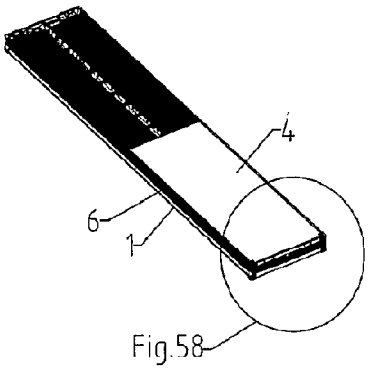
FIGS. 57, 58, 59, 60 and 61—Show a group of illustrative views of a completely collapsed container, in which some roof panels have been removed to have access to an inner view, with general details of the hinged joints fully rotated and of the corner fittings of the collapsed container, and a front elevation view with the acquired position.
Figure 58:
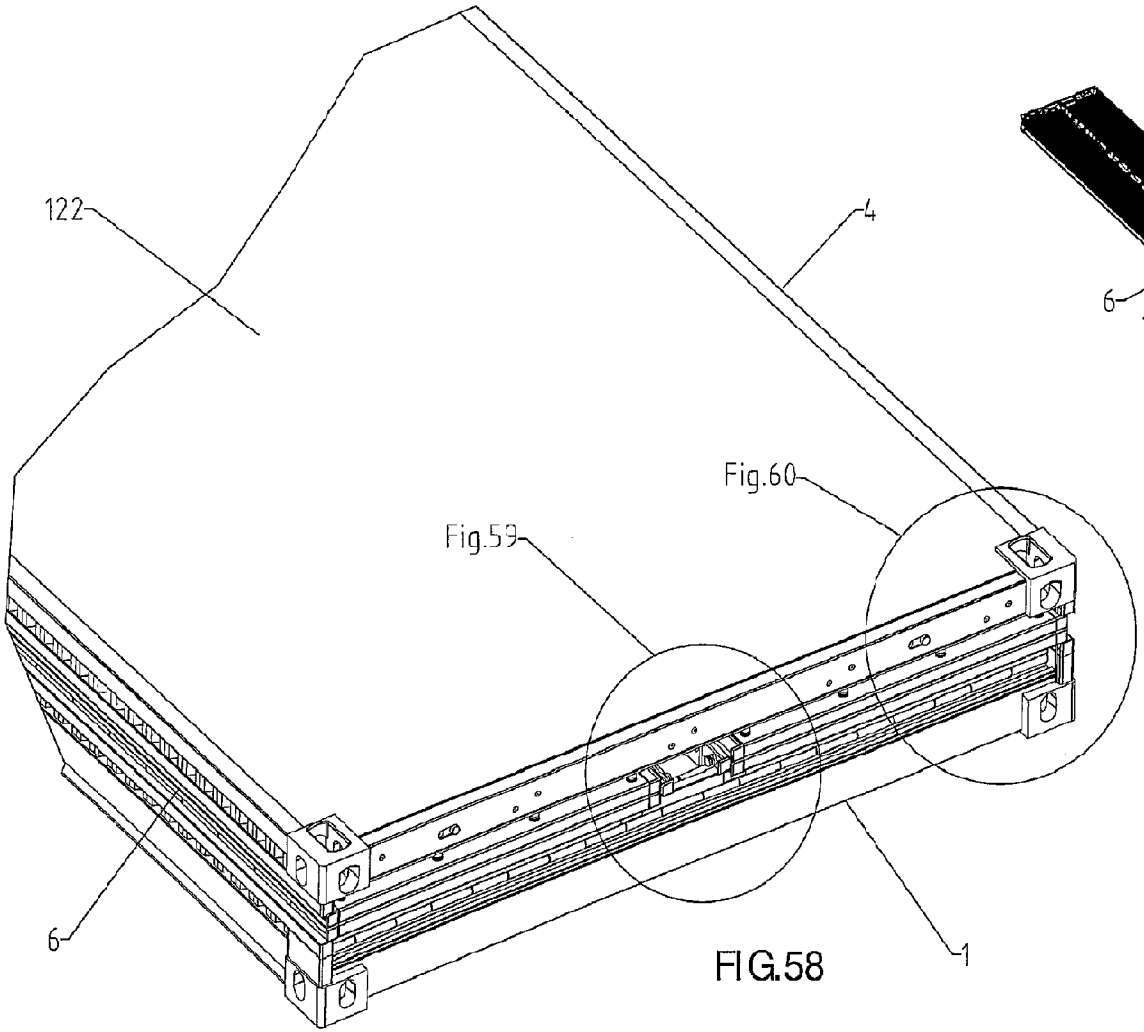
Figure 60:
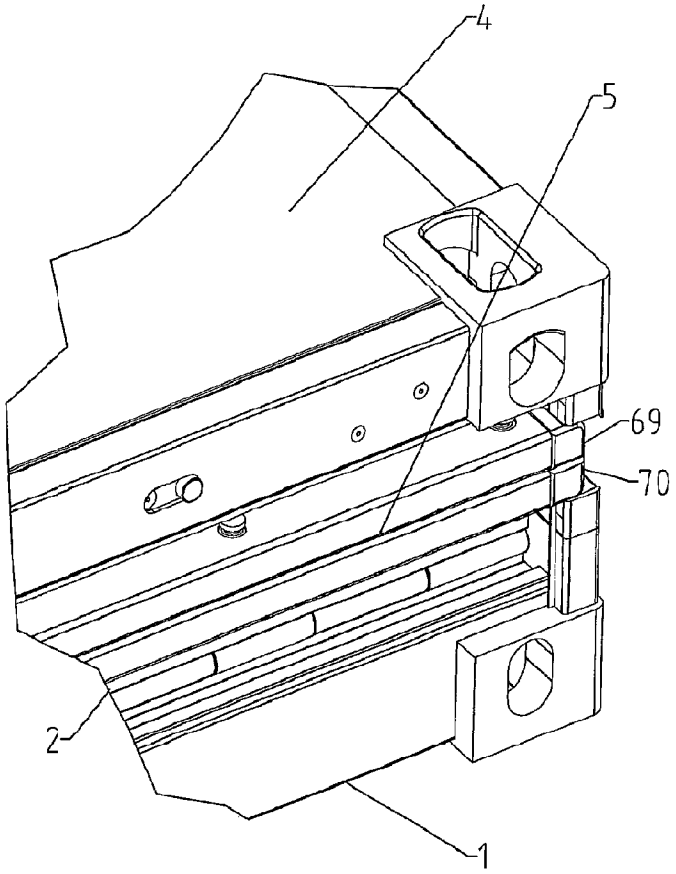
Figure 59:
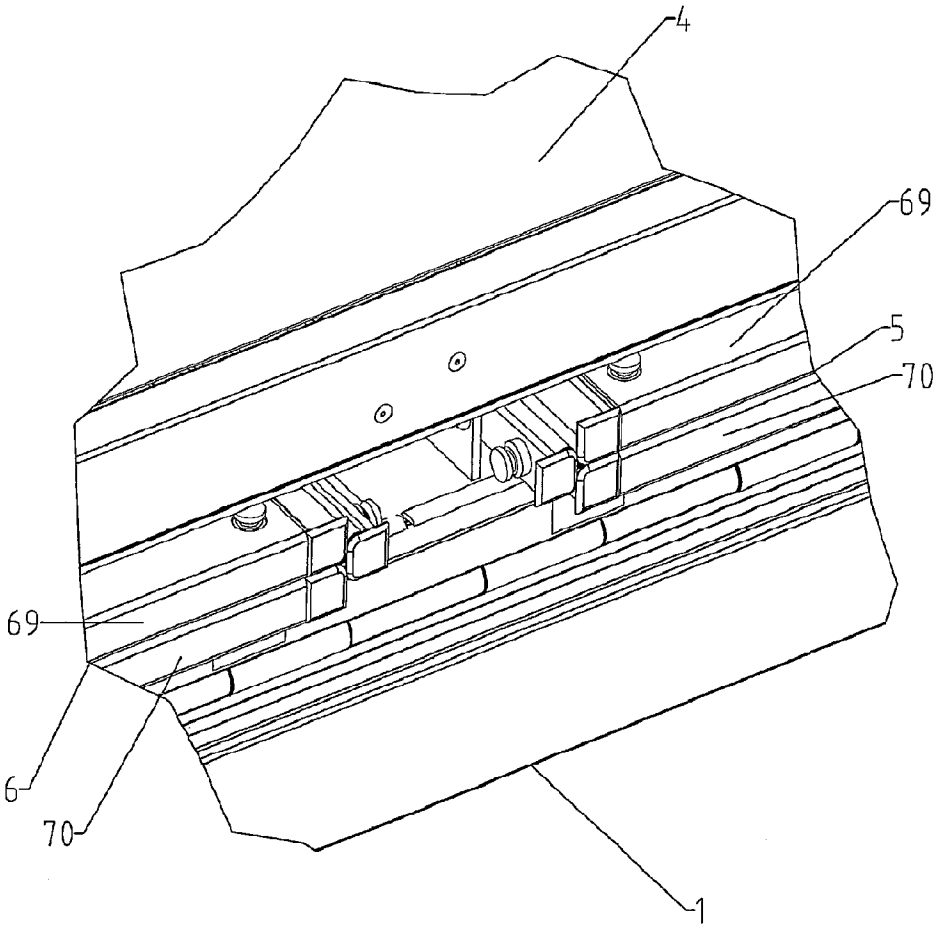
Figure 61:
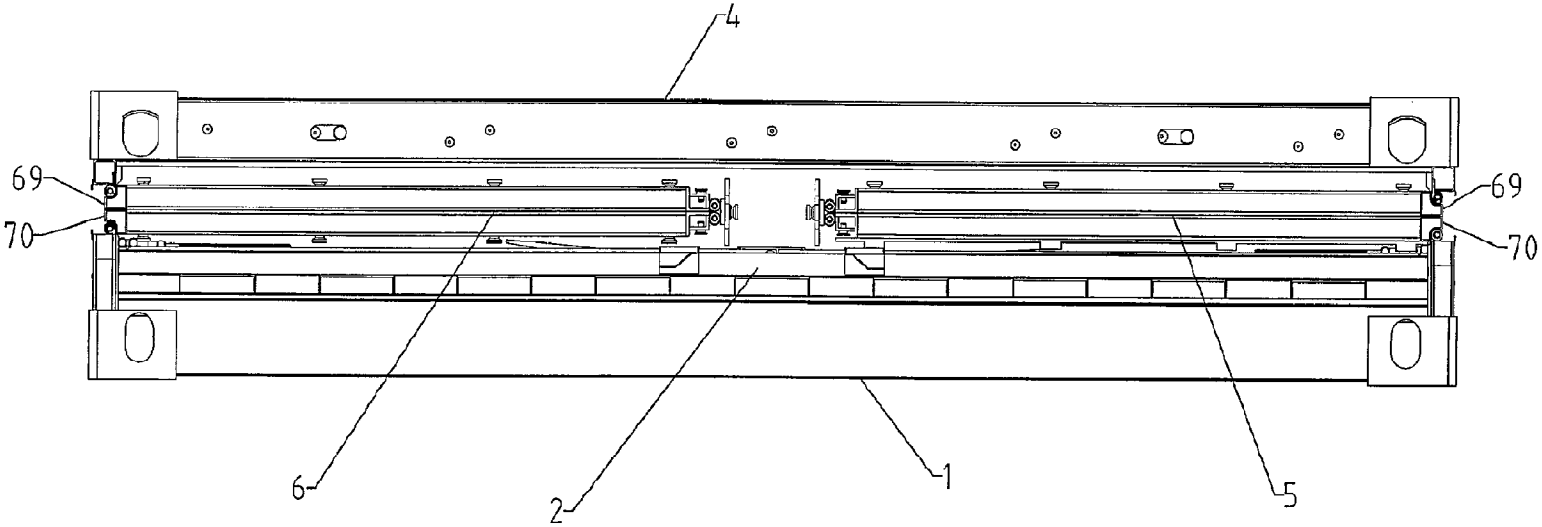

Once released the sliding latch, mechanism (93) of the side walls (5) (6) of the collapsible container and as the next step in the process of collapsing of the container of the invention, external elements that are not part of this invention are used which, according to a preferred embodiment, would be elements of automated machinery to do the work of collapsing and uncollapsing the container herein described through supporting the roof (4) of the container, from above it and simultaneously from all four top corner anchorage fittings (116) such that said crane-like element controls the descent of the roof (4) in its folding. For this and once released the slide-in latch (93) of the side walls (5) (6) and through a soft pressure from the outside of said walls (5) (6) inwards, begin rotation as is displayed on the details provided by the multiple views of FIGS. 52 and 56, the hinges of the side walls (5) (6) with the central connecting element, anti-collapsing pivot locking and collapsing plates (71) and top hinged joints that join these bottom walls (5) (6) to the roof (4) and with the (1) floor, respectively.

By the effect of gravity and of the mass of the roof (4), the side walls (5) (6) lose their verticality, as they have the natural tendency to fold towards the inside of the container and to come together by rotating around the pivoting axis of the hinged joints of said side walls (5) (6) with the floor (1)

and roof (4), like bellows that compress. For this reason it is essential an element as a crane that may perform a steady but controlled descent of the roof (4) maintaining its parallelism with the floor (1) while the hinges close in controllably without receiving impacts that may harm its structure and good functioning.

As seen in the views of FIGS. 57 to 61, the collapsing process ends naturally when by contact, the rotation of the hinges contained in the side walls (5) (6) reaches its end of travel. This occurs when the outer faces of the top and bottom foldable side panels (69) (70) of the side walls (5) (6) come into contact in all the plane that defines them, the inside of said top foldable side panel (69) remaining facing parallel the inner face to the roof (4) and the inside face of the bottom foldable side panel (70) facing parallel the inner face to the floor (1). It can be seen how the strategic position of the hinges of the hinged joint that connects the side walls (5) (6) to the floor (1) make the horizontal plane of the inner face of the bottom, foldable side panel (70) remain above plane of the rear (3) and front (2) panels that are already folded and occupying the space set by the distance between said inner face of the bottom foldable side panel (70) with the floor (1).

The collapsible container, as can be seen, has reduced its volume to approximately one-sixth of its original volume when assembled or uncollapsed, while maintaining a consolidated structure, wherein no parts or elements have been removed to achieve the effect of collapsing and its compact structure has been secured always from the outside and with simple manipulations, easily automated.

Stacking, Handling and Transport of the Collapsible Container

Notably, as shown in FIG. 57 to 61, the peripheral structure of the top and bottom faces of the container once collapsed, respectively formed by the roof (4) and the floor (1), have the same elements and structural plane as the uncollapsed or assembled container, so that their vertical stacking in a collapsed condition, and stacking alignment of the same, is performed identically to that of a uncollapsed or assembled container or a conventional ISO container for marine use common in the marketplace.

Figure 62:
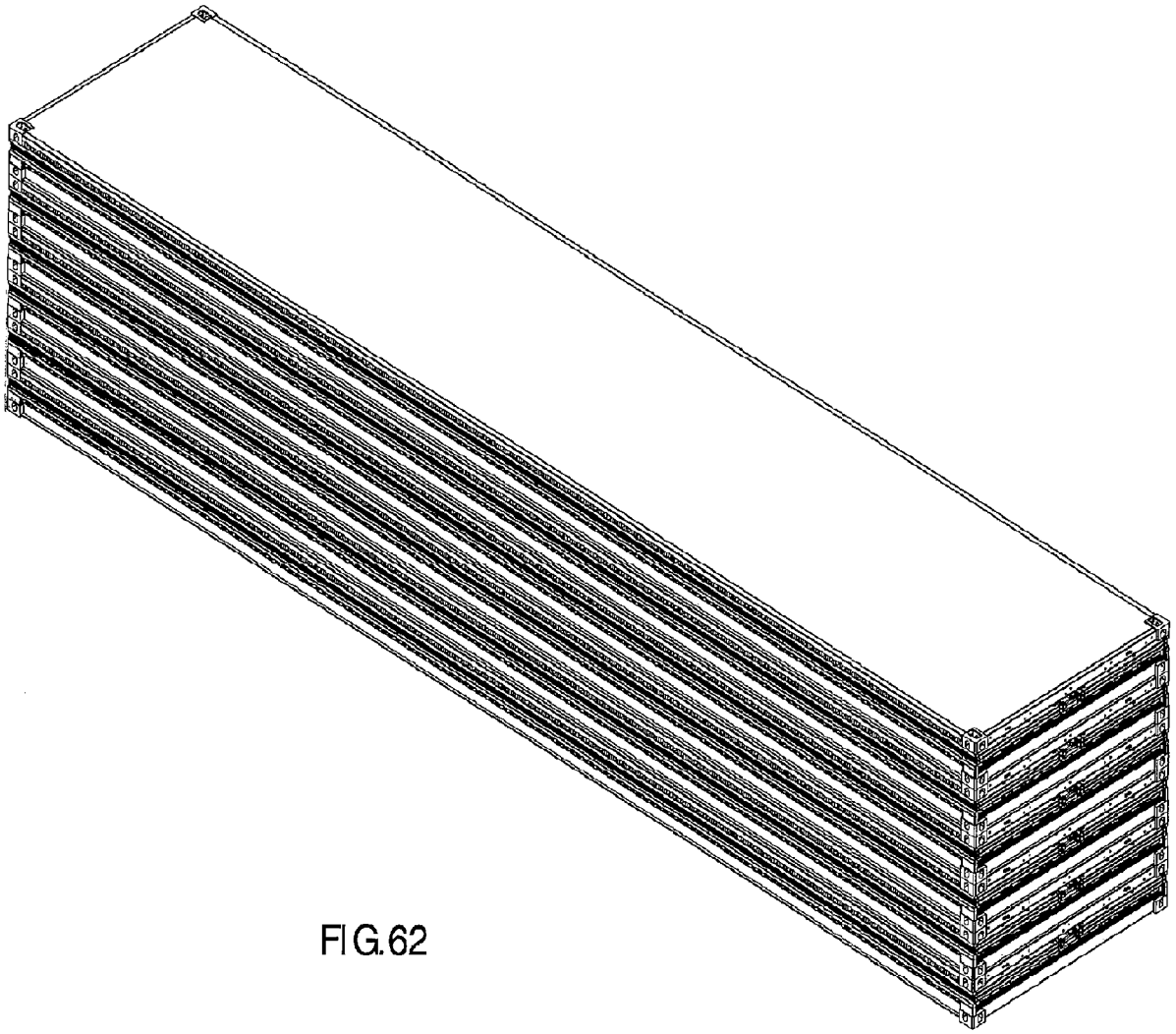
FIGS. 62 and 63—Show perspective and side views where it is possible to appreciate the result of vertically stacking a set of already collapsed containers, noting the reduction of total volume proposed by the present invention.
Figure 63:
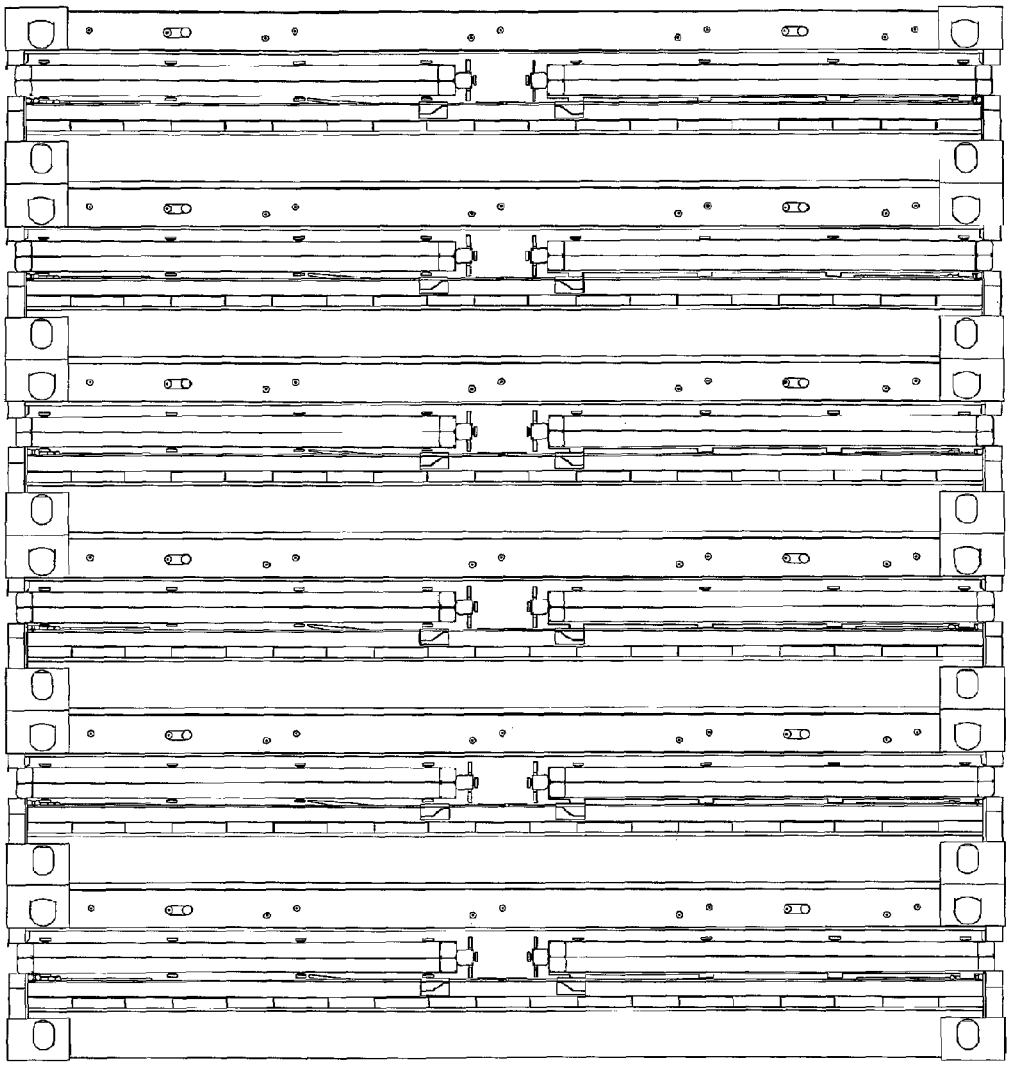

The above can be seen in FIGS. 62 and 63, on which six collapsed containers of the invention are vertically stacked one on top of the other, with the obvious saving in volume in the storage and/or transport thereof.

The collapsible containers of the invention can also be stacked and when they are in uncollapsed or assembled state, in identical manner as that of the conventional ISO containers of the market and the containers are disposed vertically one on top of the other supported on said corner anchorage fittings.

Figure 64:
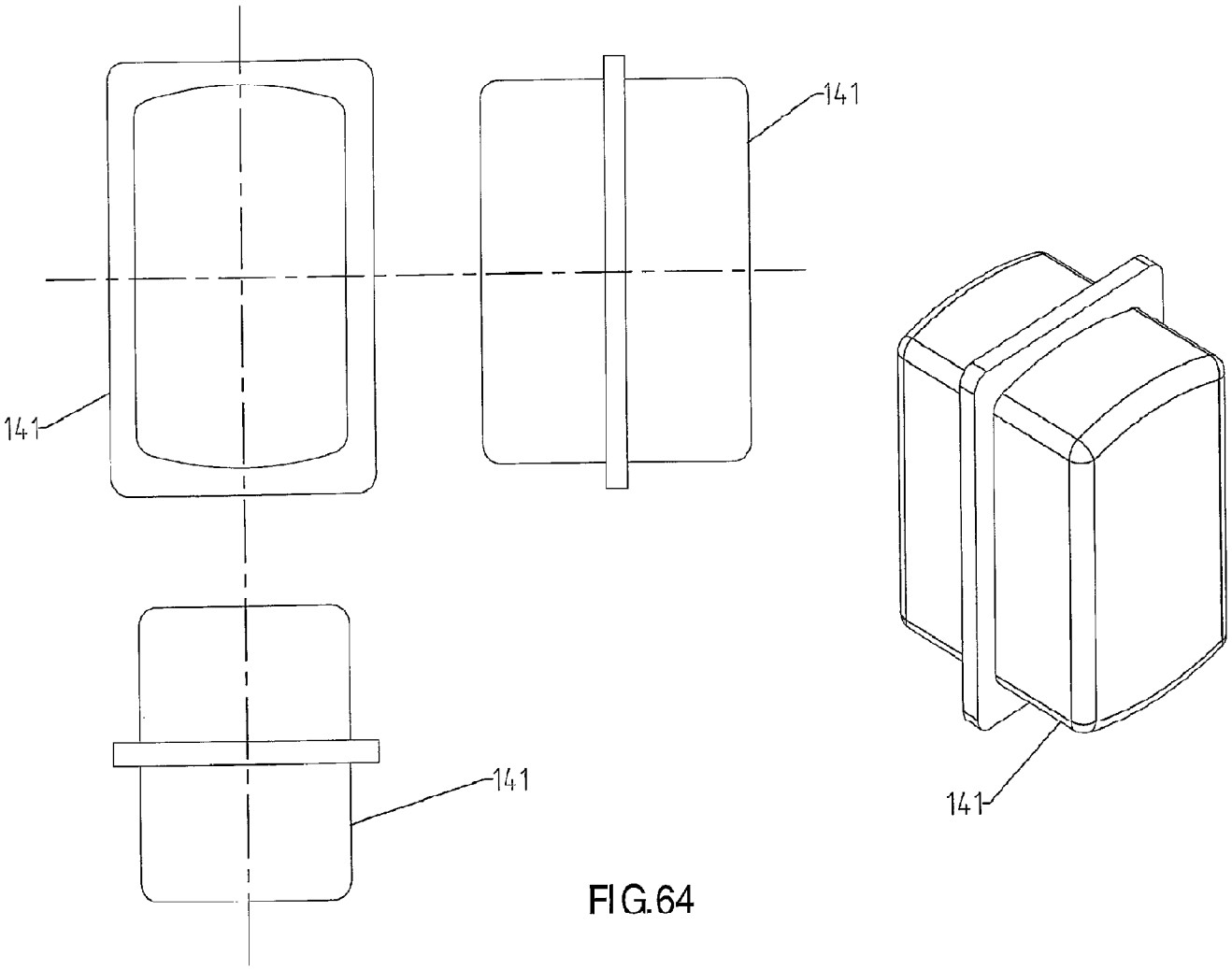
FIG. 64—Shows a set of views of the vertical consolidation tower element used for securing and blocking the horizontal displacements of the collapsed and vertically stacked containers.
Figure 65:
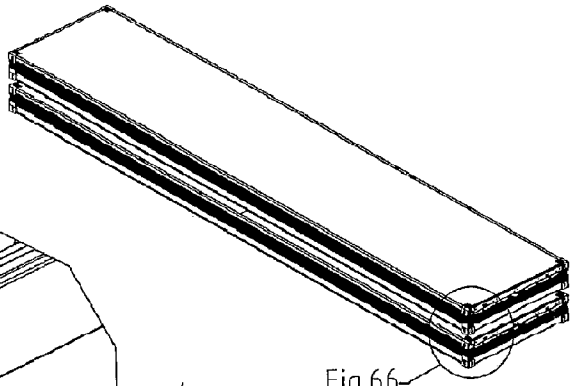
FIGS. 65 and 66—Show perspective views and details of the stacking work of collapsed containers when vertical consolidation towers are used between them.
Figure 66:
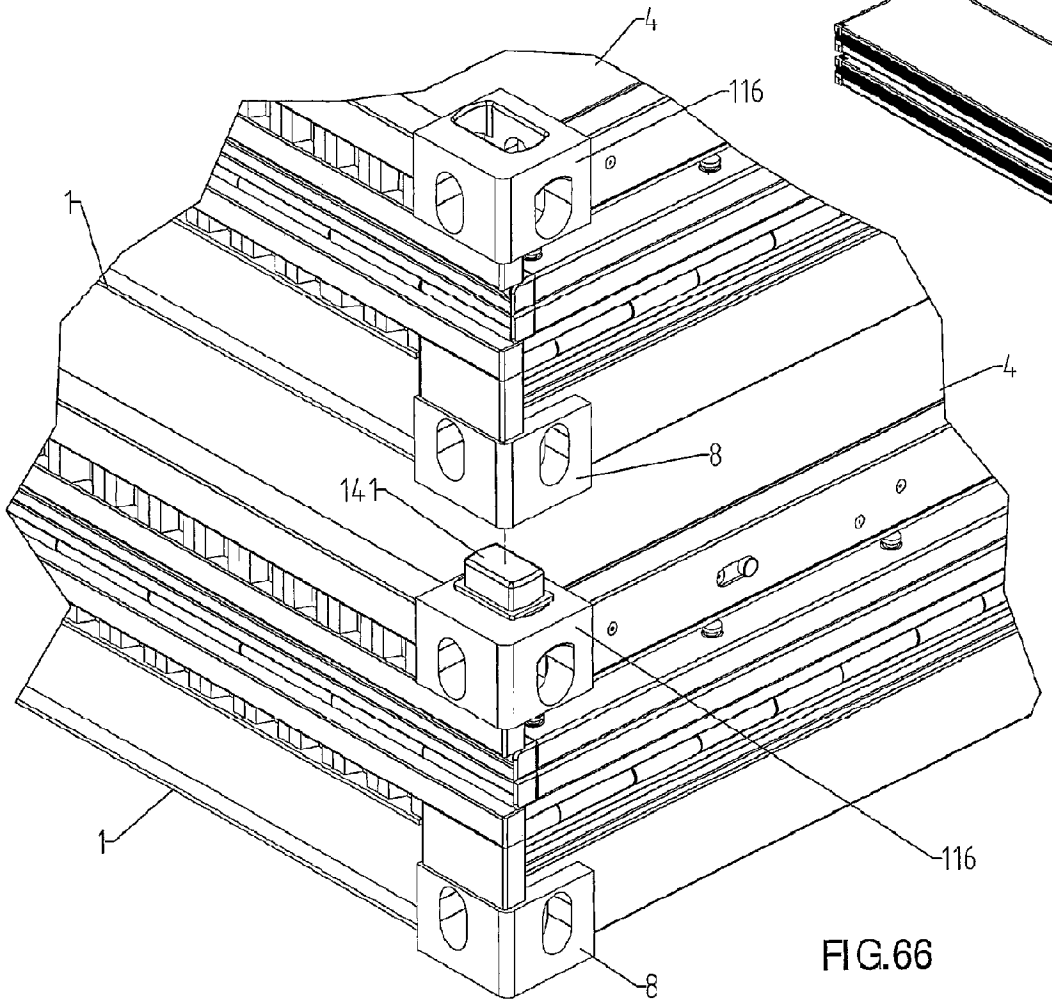

Additionally, as shown in FIG. 64, the invention provides elements called consolidation towers (141) adapted to be inserted into each opening or natural orifice of the top outer face of each top corner fitting (116) of a collapsible container, as shown in FIGS. 65 and 66. The consolidation towers (141) perform work like pins of vertical binding of collapsed containers so that once inserted in the top corner anchorage fittings (116) they emerge vertically from the top corner anchorage fittings (116), above the plane of the top face thereof, for anchoring a container which is vertically stacked immediately above. In this way, as the bottom anchorage fittings (8) of said collapsed container stacked above rest, the outward projections of the towers (141) fit into the holes provided on the underside of the bottom corner anchorage fittings (8) of said collapsed container stacked above.

Figure 67:
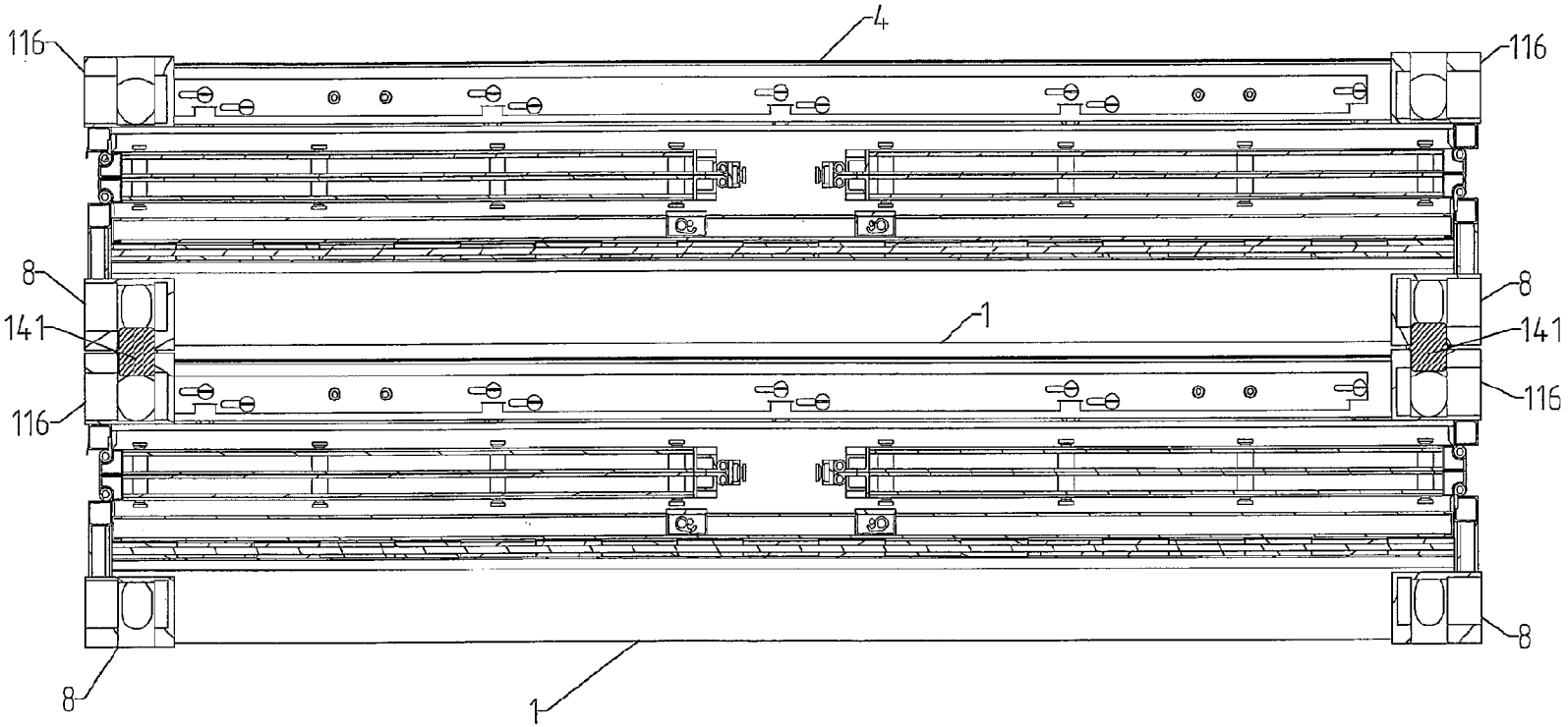
FIG. 67—Shows a front elevation view of two containers vertically stacked and bound together by vertical consolidation towers.

As shown in the cross-section displayed in FIG. 67, once seated one container over the other, the work of these consolidation towers (141) as vertical pins between two containers is to avoid horizontal slippage in any direction and orientation of one collapsed container stacked on another, so as to form a consolidated assembly ready to be used in joint transport operations, either by sea or land. When this operation is performed stacking and using said towers (141) in multiple vertically stacked containers one on top of the other, as shown in FIG. 62, a readily manageable consolidated assembly is obtained, which remains locked from its horizontal slippage in any direction and orientation and can be transported by truck, train or boat, as if it were a single compact structure. The total volume of the assembly, as seen in the figure, is similar to a single uncollapsed or assembled container, or to a conventional ISO container, thereby reducing the amount of transportation operations, improving the carbon footprint and optimizing storage space to a sixth of what is today normally practicable.

Figure 68:
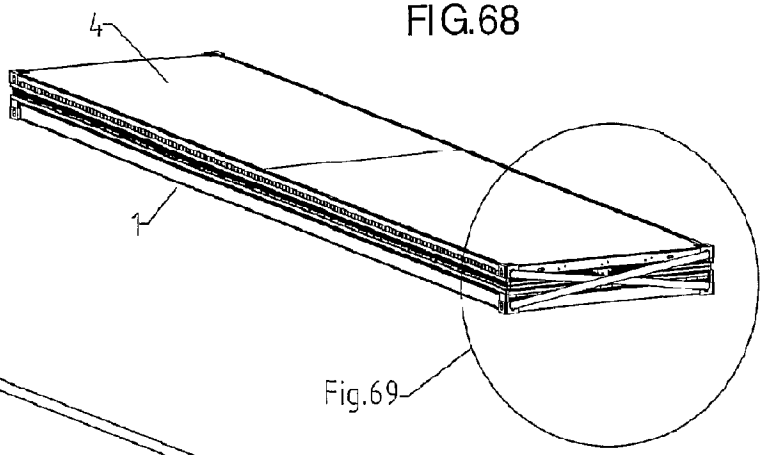
FIGS. 68 and 69—Show perspective views and details of the vertical consolidation achieved by applying two rectangular vertical securing mono-container plates placed diagonally and in the shape of a blade for a single collapsed container.
Figure 69:
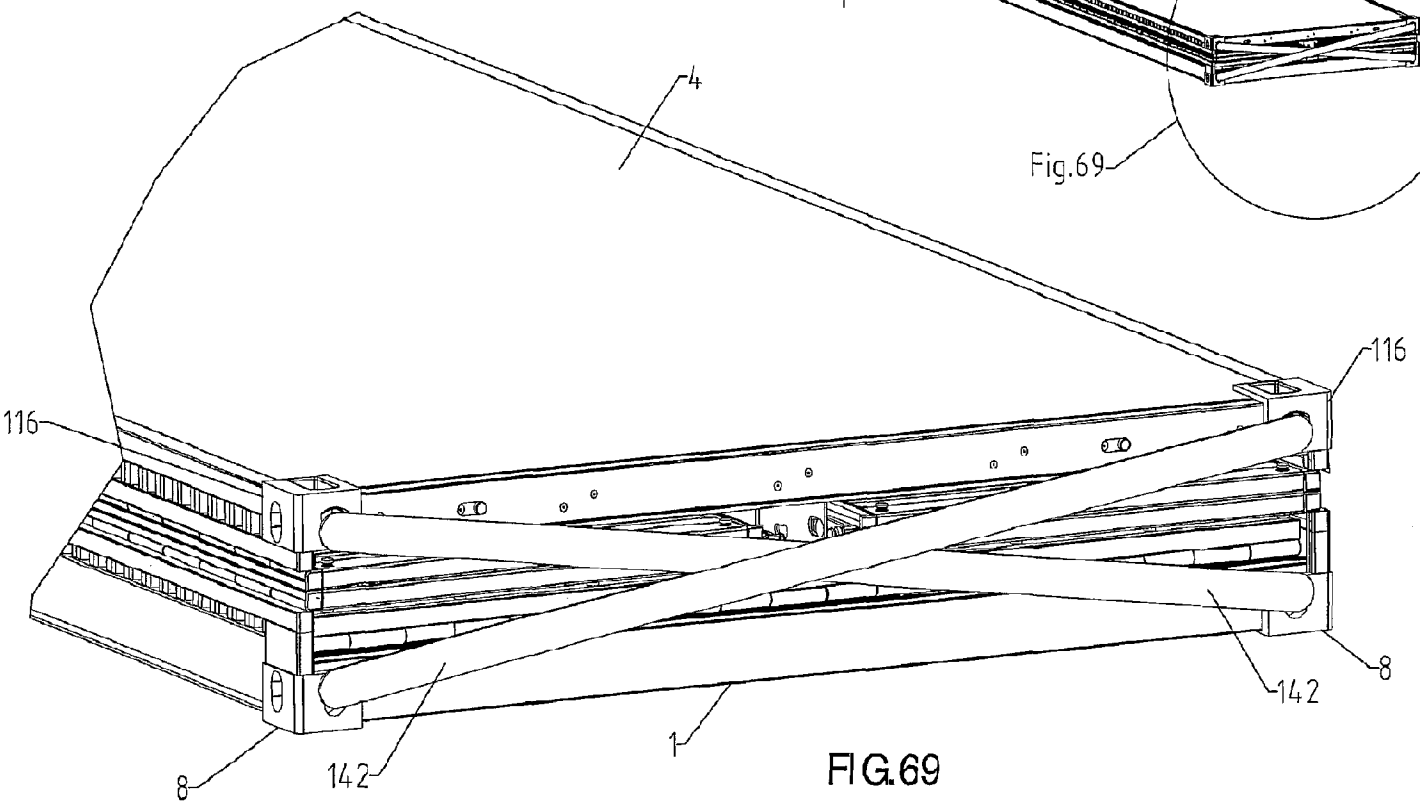

Additionally and as shown in FIGS. 68 and 69, some consolidation and security elements additional to vertical stacking of containers are arranged. Specifically, these are mono-container vertical securing plates (142) to which ends and on one side facing barbs or hooks are attached which serve, as can be appreciated, to be inserted into the openings which externally have the bottom (8) and top corner anchorage fittings (116) on their lateral faces. The hooks are engaged in said openings so that the length of said plate and the position of the barbs coincide with the distance of the diagonal between the centers of the external openings of the opposite bottom (8) and top (116) corner anchorage fittings ends when a container is fully collapsed.

By hooking two mono-container vertical securing plates (142) into each of the two smaller external faces, between the opposite corner fittings and diagonally, and eventually forming blade shape, the vertically collapsed container is consolidated, being possible to handle and lifting it from its roof (4) with a crane, without having the natural tendency to uncollapse as contrary operation to the collapsing.

As seen in FIGS. 68 and 69, using these mono-container vertical securing plates (142) as X-shaped cross and securing them to both outer smaller faces of the collapsed container, transport operations with a high risk of vertical vibrations can be performed, whereas a collapsed container without these structures could be subjected to vertical movements and accelerations which would tend to cause a small vibration effect and consequent bouncing or opening of the folding hinges, causing possible rupture or deformation.

Figure 70:
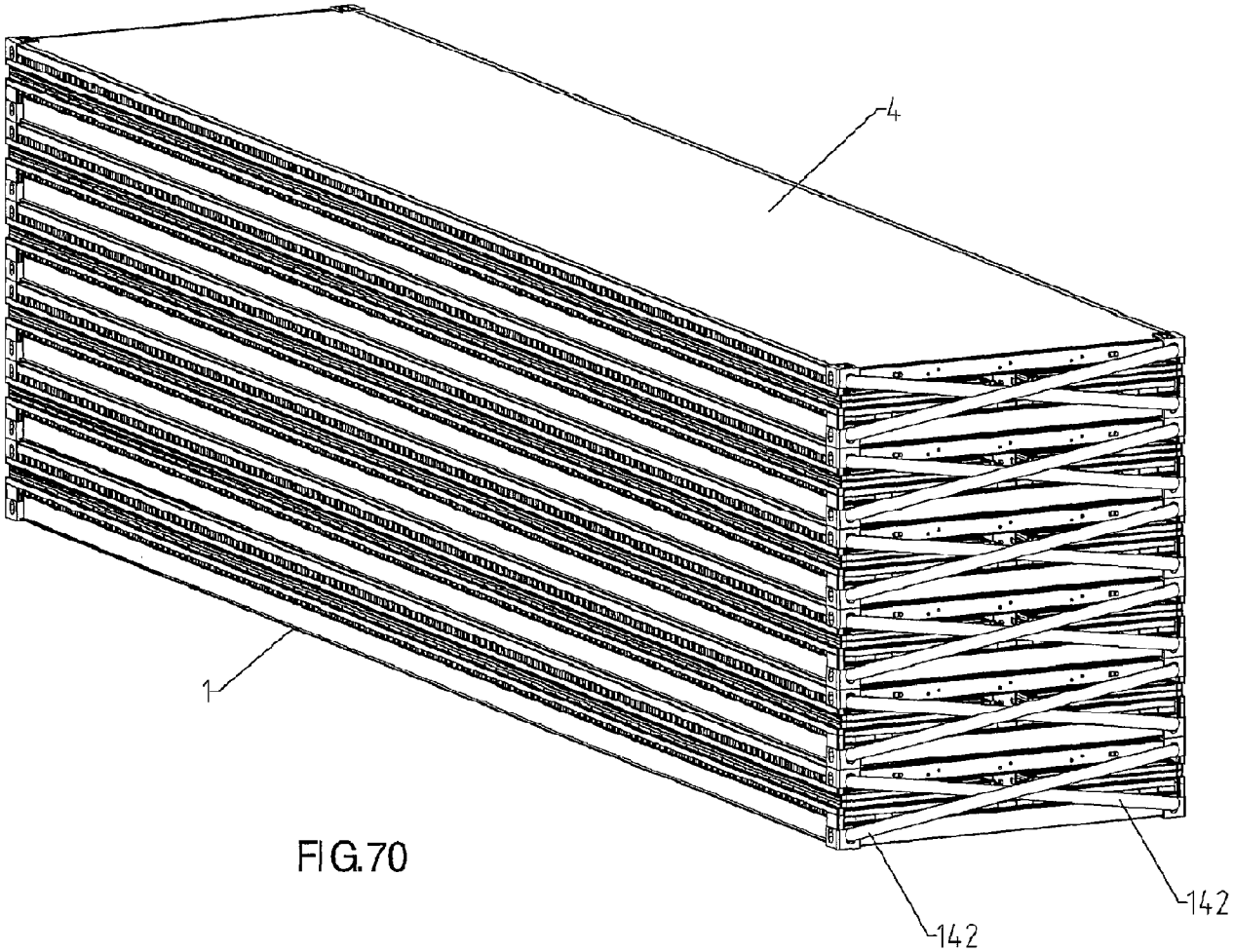
FIG. 70—Shows a perspective view and details of a stacked and consolidated set of collapsed containers which have been consolidated each one of them vertically through rectangular vertical securing mono-container plates arranged like blades.

Additionally, as shown in FIG. 70, other devices (141) in the manner of horizontal fixation pins, or consolidation towers (141), can be used together with said mono-container vertical securing plates (142) for more safety in the transport of collapsed containers, to prevent horizontal slippage of collapsed containers stacked one on top of the other, while the mono-container vertical securing plates (142), which exert diagonal tensioning and are placed in the form of blades, provide vertical reinforcement to each collapsed container structure independently. This allows to remove the assembly, starting by lifting the immediately top container and in this way proceed until the last one, without the risk that they will uncollapse when performing this operation.

Figure 71:
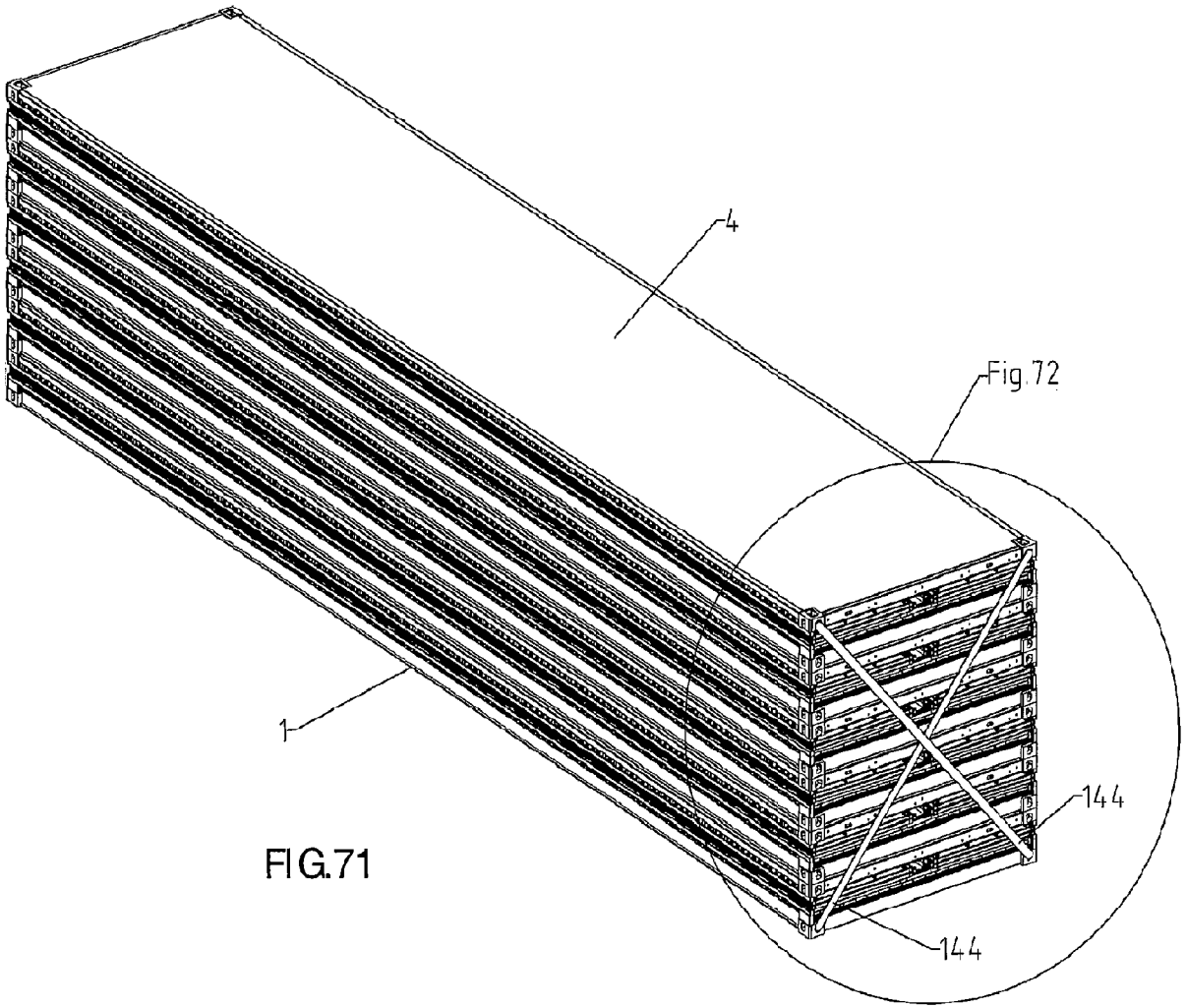
FIGS. 71 and 72—Show perspective views and details of a set of collapsed and stacked containers vertically bound together by a single rectangular multi-container vertical securing plate in the shape of an external blade.
Figure 72:
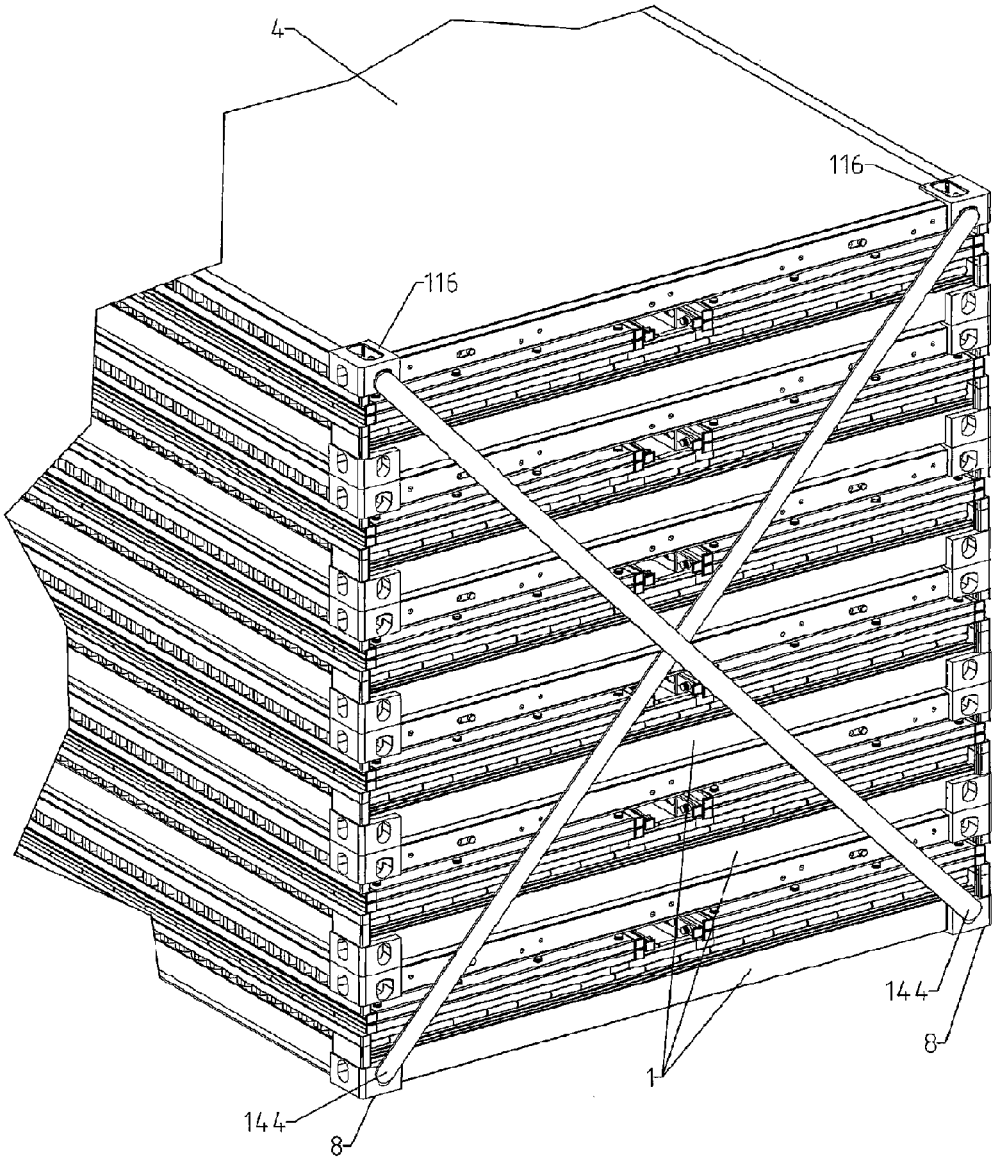

Additionally and as shown in FIGS. 71 and 72, for the transport of a predetermined number of stacked collapsed containers, a set of multi-container vertical securing plates (144) are provided identical in composition to those described above but adapted in its total length to vertically tighten a pack formed by a predetermined number of containers vertically stacked one on top of other. For this purpose, the resulting set of stacked containers are tightened with said multi-container vertical securing plates (144) by means of the hooks or barbs of their ends, one of them inserted in the opening of the outer face of the top corner anchor fitting (116) of the last or top container of the stack, and the other end the hook linking through the opening of the outer face of the opposite bottom corner anchor fitting (8) of the first collapsed container of the stack. As it can be clearly seen, by placing both multi-container vertical securing plates (144), the blade form that joins and braces the outside diagonals of the pack formed by the collapsed containers in this set is vertically compacted by this bracing and by jointly using with the same the consolidation towers (141) for vertically connecting these containers with each other, horizontal slippage is avoided and essentially forms a consolidated pack for an easy handling of the assembly using the same means with which a single uncollapsed or assembled container, or a standard ISO container of the market, is handled.

These multi-container vertical securing plates (144) are made in various lengths depending on the number of collapsed containers which the pack will have, said lengths being the resultant of the distances of the external diagonals. The smaller the number of stacked containers, the smaller the distance between its opposite corner fittings and the highest number, the greater the distance.

Figure 73:
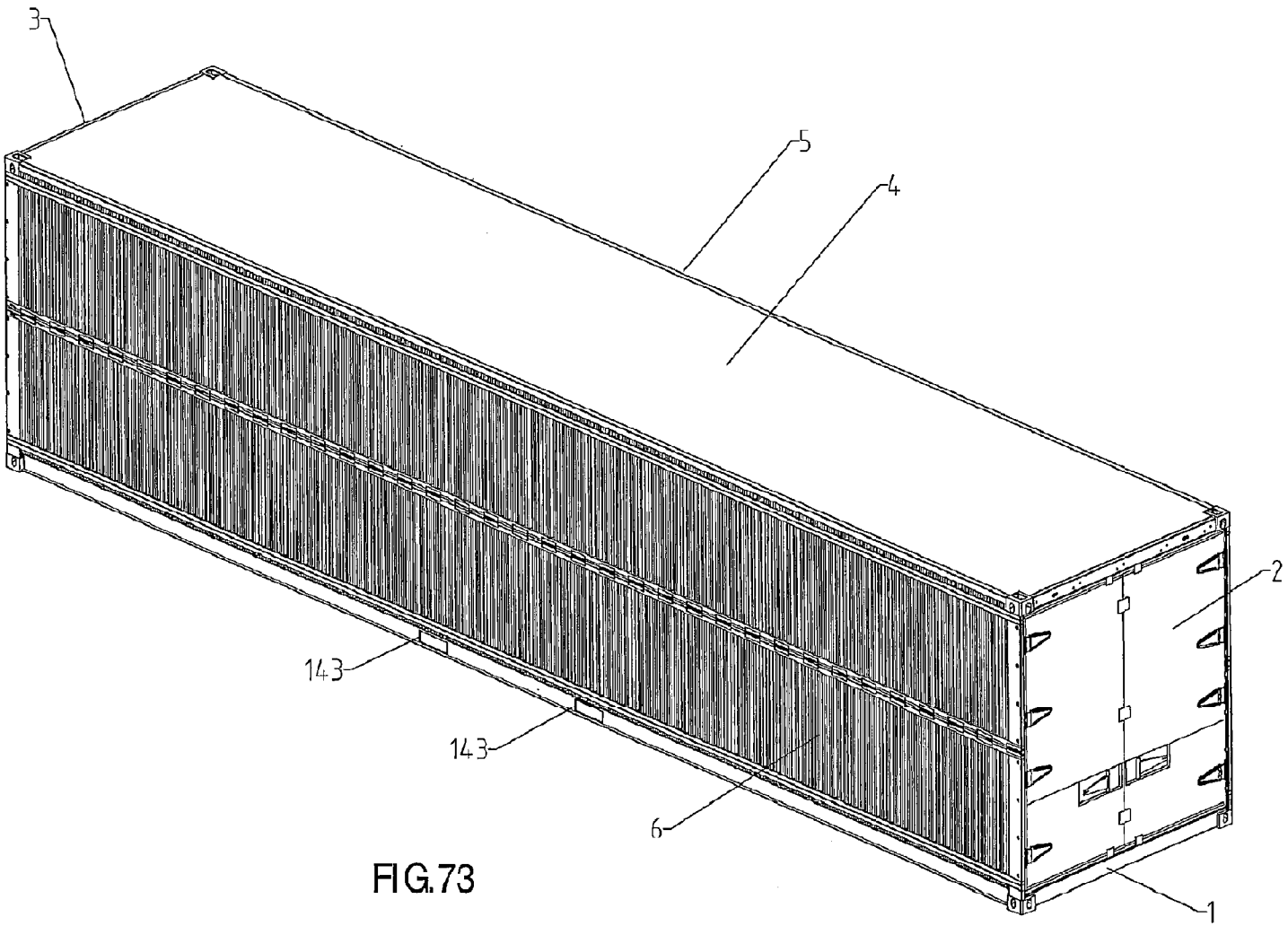
FIG. 73—Shows a perspective view of a fully assembled container with rectangular windows or cuts made on the outer rail of the floor to allow handling and lifting of the container from its base by cranes or forklifts.

To end the description of the preferred embodiments of this invention and by way of reference, the collapsible container described in this invention may include on its profile U profile that acts as the longitudinal tension member (7) of the floor, as needed and depending on the application, a pair of rectangular through-slots (143) on each of its larger opposite faces and aligned with each other in the rectangular outer structural frame (28) of the foldable side panels (69, 70), as shown in FIG. 73. These rectangular through-slots (143) serve as a window for the introduction of elements for lifting the container from its base, or as an anchor point for an external lifting crane.

Uncollapsed Container

Having described the possible preferred embodiments of this invention, only remains emphasizing that the uncollapsing or assembling a the collapsible container is performed by reversing the order of the collapsing operations previously described, beginning with the operation of raising the roof (4) by a external means and from the vertical, which will automatically unfold the set of hinges contained in the side walls (5) (6) and which connect these to the floor (1) and roof (4), until the side walls (5) (6) reach the vertical position. Subsequently the sliding latch mechanism (93) is locked and then the rear (3) and front (2) panels are raised to their vertical position, wherein the cylindrical pins (36) are fitted in the outer cross beams (119) (119') of the roof (4) and the lateral anchor bolts (77) (77') (98) are fitted in their cuts (27). Finally, the anti-fold latch locks located on said outer transverse beams (119) (119') are closed, resulting in a fully assembled collapsible container that meets all the standards of the ISO norms for shipping containers and is ready to be internally loaded by accessing therein through its front doors (2).

It is of noteworthy that the techniques used for the development and assembling of collapsible containers for maritime and/or land use described herein is applicable in its structural realization and solely dependent on the dimensions of the component parts, to all ISO defined containers in the 1AAA, 1AA, 1A, 1AX, 1BBB, 1B, 1B, 1BX, 1CCC, 1CC, 1C, 1CX 1D, 1DX categories, these being the ones which can be easily parametrized and emulated with the system proposed in this invention, but not excluding its application to other models of containers that the market may require, whether standardized or not standardized, and to which the technique herein disclosed can be applied.

The invention claimed is:

1. Collapsible container for sea and/or land consolidated freight transportation, characterized in that it comprises:

a horizontal bed or floor (1);

a front panel (2) with access doors (43,44);

a rear panel (3);

a roof (4); and a right side wall (5) and an equal and opposite left side wall (6);

wherein the floor (1), rear panel (3) and roof (4) are delimited by respective rectangular outer frame structures (15, 24, 16);

wherein the front panel (2) comprises a rectangular outer structural subframe (42) and the doors (43, 44) are hingedly secured in the interior space generated by said outer structural rectangular subframe (42);

wherein each of the side walls (5, 6) comprises a top foldable side panel (69) and a bottom foldable side panel (70) which are symmetrical to each other relative to a central pivoting, anti-fold locking and connecting element of the side panels (71) that is located along the bisector of said foldable side panels (69, 70), each foldable side panel (69, 70) being defined by a rectangular outer frame structure (28);

wherein the collapsible container further comprises:

hinged joints or links operatively connecting the floor (1) with the front panel (2), the floor (1) with the rear panel (3), the flour (1) with the side walls (5, 6), the roof (4) with the side walls (5, 6) and the foldable side panels (69, 70) with the central pivoting, anti-fold locking and connecting element of the side panels (71);

releasable lateral anchoring means between the front panel (2) and side walls (5, 6), and between the rear panel (3) and the side walls, arranged in the respective structures that delimit the front and rear panels (2, 3) and the foldable side panels (69, 70) of the side walls (5, 6);

means to lock or unlock the folding of the rear (3) and front (2) panels, respectively arranged in the short or transverse sides (119, 119') of the rectangular outer roof frame structure (4) and in the top side (35, 46) of the rectangular outer structural frame (24) of the rear panel (3) and the outer structural rectangular subframe (42) of the front panel (2); and means for locking or unlocking the folding of the foldable side panels (69, 70) arranged in the central pivoting, anti-fold locking and connecting element of the side panels (71) and in the longer sides or longitudinal rails (73, 73') of the outer structural frame of the foldable rectangular side panels (69, 70) which are located adjacent to said central pivoting, anti-fold locking and connecting element of the side panels (71);

wherein such hinged joints, releasable lateral anchor means and means for locking or unlocking are designed to allow the folding of said front and rear panels (2, 3) and said walls (5, 6) with the roof (4) attached, into the collapsible container and, conversely, to allow the unfolding of said front and rear panels (2, 3) and said walls (5, 6) with the roof (4) attached, from within the collapsible container until the position, wherein the container is uncollapsed;

wherein the floor (1) includes a support structure of the hinged joint of the floor with the side walls which is located on each side of the rectangular outer frame structure of the floor (1);

wherein the roof includes support means of the hinged joint of the roof with the side panels;

wherein the means for locking or unlocking the folding of the front (2) and rear (3) panels and the foldable side panels (69, 70) are accessible from outside the container through elements of the sliding latch lock type with mobile pins; and wherein the central pivoting, anti-fold locking and connecting element of the side panels (71), the means for locking and unlocking the folding of the foldable side panels (69, 70) and the height of said support structure is designed to allow the side walls (5, 6) to fold into the collapsible container above the previous folding of the rear panel (3) and front panel (2) with access doors onto the floor (1) container collapsing in the collapsing process of the container until the too and bottom foldable sidle panels folded with the roof attached reach a position parallel with the floor above and in contact with the front and rear panels.

2. The Collapsible container of claim 1, characterized in that the width and length of the container, respectively defined by the width and length of the rectangular outer structural frames (15)(16) of the floor (1) and the roof (4) of the collapsible container, and the height of the assembled container, defined by the height of said outer rectangular structural frames (15)(16) of the floor (1) and the roof (4), plus the height of the side walls (5, 6) of the container, have measures adapted to the ISO standards for shipping containers and the vertices of the container are formed by top (116) and bottom (8) corner fittings that form part of the roof (4) and floor (1) and are dimensioned and shape equal to those commonly used in ISO shipping containers for maritime use in the market.

3. The collapsible container of claim 2, characterized in that the corner fittings (8, 166) are of metal and the respective longitudinal sides (7, 7', 117, 117') and transverse sides (4, 9', 119, 119') of the rectangular outer structural frame (13) (16) of the floor (1) and the roof (4) are formed by structural metal profiles attached to the corner fittings by welding.

4. The collapsible container of claim 1, characterized in that the total height from the floor to the roof of the container when it is in the uncollapsed position is the same for any model of ISO container and independently of its height, whereby the stacking of six containers one above the other when these are collapsed always has the same height independently of the model of ISO container.

5. The collapsible container of claim 1, characterized in that the height (A) generated from the inside level of the floor (1) of the container, formed and defined by the plane of the top face of the longitudinal floor boards (11), until the top face of the support structure of the hinged joint of the floor with the side walls is equal, at least, to the maximum level of the assembly defined by the rear pastel (3) and the front panel (2) with access doors and the respective hinged joints with the floor (1) when said panels (2, 3) are folded on the container floor (1).

6. The collapsible container of claim 1, characterized in that the supporting structure of the hinged joint of the floor with the side walls comprise, on each side of the floor, floor column pillars (13) disposed on each bottom corner anchor fittings (8) and a floor side crossbar (14) extending between floor corner pillars (13), further being closure means (19) in the intermediate space longitudinally generated between said floor side crossbar (14) and the longitudinal floor rail (7, 7').

7. The collapsible container of claim 1, characterized in that the longer or longitudinal sides and the shorter or transverse sides of the outer rectangular structural framework or perimeter (16) of the roof (4) are respectively formed by outer longitudinal tension members made of square metal profiles (117, 117') and outer transverse beams (119, 119') consists of a C-shaped metal profile; and the roof (4) further comprises means for supporting the hinged joint of the roof with the side panels (81, 124, 125) consisting of square structural metal profiles (126, 126') that are welded to the underside of the top anchorage corner fittings (116) and externally and longitudinally aligned beneath the longitudinal metal profiles (117, 117') of the roof.

8. The collapsible container of claim 1, characterized in that the rectangular outer structural frame (28) of foldable side panels (69, 70) comprises an extreme rail (72, 72') and, adjacent to the central pivoting, anti-fold locking and connecting element (71) of the foldable panels, a ventral rail (73, 73') which constitutes the longer sides of the structural frame (28) of the foldable side panels (69, 70), and a pair of outer vertical pillars (75, 75') which constitute the bottom side of the structural frame (28) of the foldable side panels (69, 70); in that the releasable anchoring means between the front panel (2) and side walls (5, 6), and between the rear panel (3) and side walls (5, 6), comprise anchor bolts (77, 77', 98) placed vertically aligned on the inner face of the outer vertical pillars (75, 75') of the side walls (5, 6) and cut-outs (27) made in lateral profiles (26, 26') of the rectangular outer frame structure (24) of the rear panel (3) and on the lateral profiles (47, 47') of the outer structural rectangular subframe (42) of the front panel (2), the cut-outs (27) having a shape adapted to receive, as a female elements, the anchor bolts (77, 77', 98) to lock and secure the joining of the rear (3) and front (2) panels with the side walls (5)(6) in the process of uncollapsing or assembly of the collapsible container.

9. The collapsible container of claim 1, characterized in that the central pivoting, anti-fold locking and connecting element collapsing plates (71) includes:

a central support plate (91) for the means for locking or unlocking the folding of the foldable plates (93) and for the hinged joint of the foldable side panels (69, 70) with the central pivoting, anti-fold locking and connecting element (71) of the foldable panels; and handling means (104, 104') operable from the outside the collapsible container through a rectangular window or through-cut (86) performed on the central beam (73, 73') for performing the sliding and subsequent locking or unlocking of the folding of the foldable side panels (69, 70).

10. The collapsible container of claim 1, characterized in that the doors (43, 44) are joined to the outer metal structural subframe (42) of the from panel (2) by means of a set of cap hinges (45) of triple-action or three phases installed on the outside of the sides of the outer metal structural subframe (42) and configured for a full opening with 270 degree turn of the door (43, 44) of the collapsible container.

11. The collapsible container of claim 1, characterized in that the doors (43, 44) are made on the basis of a metal structural frame (49) and external (53) and internal (55) panels riveted or bolted to the metal and have a closure system comprising: a vertical locking axle bar (50) with locking pawls at the ends thereof, which internally traverses holes aligned with the metal structural frame (49) which forms the inside of the doors (43, 44) and it is integrated in the interior thereof; an opening and closing handle (51) fixed to the vertical locking axle bar (50) and disposed on an inner rectangular cavity (52) of the doors (43, 44); and lock bushings (54) embedded in the top (46) and bottom (48) sides of the subframe (42); whereby the elements of said closure are all placed within the interior of the outer plane or face of the doors (43)(44) without protruding outwardly thereof.

12. Method of collapsing a collapsible container according to claim 1, characterized in that it comprises the steps of:

a) unlocking the locking and unlocking means disposed between the roof (4) and the front (2) and rear (3) panels operating from outside of the container;

b) rotating said panels (2, 3) around the respective mobile hinged joints with the floor (4), release the panels from their anchorage with the side walls (5, 6) and fold them over the floor (1) until contacting with the inner plane of the floor (1);

c) the means to unlock locked or unlocked from the foldable side panels (69, 70) and the central pivoting, anti-fold and connecting element side panel (71);

d) produce the simultaneous rotation of the foldable side panels (69, 70) around the hinged joints of said panels (69, 70) with the central pivoting, anti-fold locking and connecting element (71) of the side panel and of the foldable side panels (69, 70) around the hinged joints of said panels (69, 70) with the floor (1) and the roof (4); and e) folding inwards of the container and so as to bringing them together, the side walls (5, 6) with the roof (4) pivotally attached, until reaching said walls (5, 6) and roof (4) a position parallel to the floor (1) on top of the previously folded front (2) and rear (3) panels.

13. The method according to claim 12, characterized in that the locking and unlocking means between the roof (4) and the front (2) and rear (3) panels comprise a sliding type latch and anti-fold locking mechanism which includes a sliding plate (129) and handling pins (137) (137') integral with the sliding plat (129), the sliding type latch and anti-fold locking mechanism being located on the transverse sides (119, 199') of the rectangular structural frame (117, 117', 119, 119', 8) of die roof (4) and adapted to interact with a cylindrical pin (36) installed on the top side (35) of rectangular outer structural frame (24) of the rear panel (3) and the top side (46) of the outer structural rectangular subframe (42) of the front panel (2), wherein the pins are provided with grooves (40) on its heads (39) adapted to slide on them the sliding plate (129), wherein step a) comprises moving b) means the handling pins (137)(137') the slide plate (129) through the outer transverse beams (119) (119') from a locked position of the latch and anti-fold locking mechanism, in which the slide plate (129) is inserted in a tongue and groove fashion in the grooves (40) of the heads of the cylindrical pins (36), to an unlocked position of the latch and anti-fold blocking mechanism, in which the cylindrical pins (36) are released and the heads (39) are faced to machining or cuts located on the bottom edge of the sliding plate (129).

14. The method according to claim 12, characterized in that step b) comprises pushing from the outside and at right angles, the front (2) and rear (3) panels into the container using machinery adapted for collapsing of the container so panels (2, 3) then fall by gravity onto the inside of the floor (1).

15. The method according to claim 14, characterized in that it further comprises securing said front (2) and rear (3) panel with an external tension member, clip or flange during the folding on top of the floor (1) so that the fall of said panels (2, 3) is performed by gravity, but in a controlled manner.

16. The method according to claim 12, characterized in that step c) comprises accessing the means for locking or unlocking the folding of the side panels (69, 70) through rectangular through-cuts (86, 86') made in the outside of the side walls (5, 6).

* * * * *